US009391409B2

(12) United States Patent
Abe et al.

(10) Patent No.: US 9,391,409 B2
(45) Date of Patent: Jul. 12, 2016

(54) ELECTRONIC DEVICE CONNECTOR

(71) Applicant: Yazaki Corporation, Tokyo (JP)

(72) Inventors: Shintaro Abe, Susono (JP); Isao Kameyama, Susono (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/718,622

(22) Filed: May 21, 2015

(65) Prior Publication Data

US 2015/0340816 A1 Nov. 26, 2015

(30) Foreign Application Priority Data

May 22, 2014 (JP) ..... 2014-106470
Jul. 16, 2014 (JP) ..... 2014-146064
Mar. 31, 2015 (JP) ..... 2015-072762

(51) Int. Cl.

*H01R 24/50* (2011.01)
*H01R 13/6582* (2011.01)
*H01R 13/42* (2006.01)
*H01R 12/71* (2011.01)
*H01R 24/38* (2011.01)
*H01R 103/00* (2006.01)

(52) U.S. Cl.

CPC ..... *H01R 13/6582* (2013.01); *H01R 12/714* (2013.01); *H01R 13/42* (2013.01); *H01R 24/38* (2013.01); *H01R 2103/00* (2013.01)

(58) Field of Classification Search

CPC .... H01R 13/6582; H01R 13/42; H01R 24/38; H01R 2103/00
USPC ..... 439/607.34, 620.03, 579, 76.1, 581, 63, 439/71, 862, 640
See application file for complete search history.

(56) References Cited

U.S. PATENT DOCUMENTS 4,453,796 A * 6/1984 Monroe ..... H01R 9/0518 439/581
4,773,879 A * 9/1988 Pauza ..... H01R 9/034 174/88 C
5,215,470 A * 6/1993 Henry ..... H01R 13/5045 439/581
5,769,652 A * 6/1998 Wider ..... H01R 24/50 439/248
6,299,479 B1 * 10/2001 Tang ..... H01R 9/05 439/578
6,942,491 B2 * 9/2005 Khemakhem ..... H01R 24/52 439/544
7,153,160 B2 * 12/2006 Montena ..... H01R 9/0509 439/536
7,341,458 B1 * 3/2008 Koh ..... H01R 13/2421 439/39
7,753,689 B1 * 7/2010 Wu ..... H01R 13/648 439/490

(Continued)

FOREIGN PATENT DOCUMENTS

JP 2007-220511 A 8/2007
JP 2011-258422 A 12/2011

*Primary Examiner* — Abdullah Riyami
*Assistant Examiner* — Nelson R Burgos-Guntin
(74) *Attorney, Agent, or Firm* — Sughrue Mion, PLLC

(57) ABSTRACT

An electronic device connector includes a connector housing that is combined with a case of an electronic device and a terminal fitting that is held by the connector housing. When the connector housing is combined with the case, the terminal fitting is electrically connected to a contact portion of the electronic device. The terminal fitting includes an internal conductor, an external conductor disposed around the internal conductor, and a dielectric disposed between the internal conductor and the external conductor which are concentrically disposed. The internal conductor and the external conductor are integrally provided with spring portions capable of being elastically deformed in contact with the contact portion of the electronic device.

11 Claims, 44 Drawing Sheets

(56) References Cited

U.S. PATENT DOCUMENTS 7,909,614 B1 * 3/2011 Chang ..... H01R 13/41 439/581
8,105,117 B2 * 1/2012 Ikegami ..... H01R 13/2421 439/700
8,740,629 B1 * 6/2014 Hall ..... H01R 13/6456 439/63
2002/0061676 A1 * 5/2002 Kameyama ..... H01R 4/2429 439/404
2007/0123085 A1 * 5/2007 Kameyama ..... H01R 13/521 439/277
2015/0255908 A1 * 9/2015 Takamura ..... H01R 13/2414 439/370
2015/0340816 A1 * 11/2015 Abe ..... H01R 13/6582 439/607.34

* cited by examiner

ELECTRONIC DEVICE CONNECTOR

BACKGROUND

The present invention relates to an electronic device connector.

Further, the present invention relates to an electronic device connector, and more particularly, to a connector terminal for an electronic device for connecting an electronic device such as a camera device to an external device through a relay contact.

FIG. 31 shows an electronic device connector disclosed in Patent Document 1.

An electronic device connector 1100 includes a connector housing 1110 that is combined with an end (in FIG. 31, an upper end) 1211 of a case 1210 of an electronic device 1200, and a linear conductor 1120 which is a terminal fitting supported by the connector housing 1110.

The electronic device 1200 is provided with a circuit board 1220 in an internal space on a side of an end 1211 of the case 1210. Further, a relay terminal 1230 is provided in a mounting hole 1214 formed through a partition wall 1213 which corresponds to the end 1211.

In the technique disclosed in Patent Document 1, the electronic device 1200 is an on-vehicle camera. Although not shown, a camera lens is provided at the other end (in FIG. 31, a lower end) 1212 of the case 1210, and an imaging element that is disposed coaxially with the lens is mounted on the circuit board 1220.

On a surface of the circuit board 1220 on a side of the relay terminal 1230, a contact portion 1221 which is an output terminal portion of the imaging element is provided.

The relay terminal 1230 is pinched by the contact portion 1221 and the linear conductor 1120 to electrically connect the contact portion 1221 and the linear conductor 1120. The relay terminal 1230 includes a cylindrical rubber 1231 that is tightly fitted into the mounting hole 1214, and a conductor part 1232 that is buried into the rubber 1231. The conductor part 1232 is an aggregation of plural particle-shaped conductors 1232*a*, which is extendable in an axial direction (in FIG. 27, an arrow Y1 direction), and absorbs an error in a separation distance between the linear conductor 1120 and the contact portion 1221 due to an assembly error or the like.

FIGS. 32 and 33 show an electronic device connector disclosed in Patent Document 2.

An electronic device connector 1140 includes a connector housing 1141 that is combined with an end (in FIG. 32, a lower end) 1241*a* of a case 1241 of an electronic device 1240, and a terminal fitting 1142 that is supported by the connector housing 1141.

The electronic device 1240 is an on-vehicle camera. As shown in FIG. 32, a camera lens 1242, and a circuit board 1243 on which an imaging element that converts light incident from the lens 1242 into a video image signal are provided inside the case 1241 of the electronic device 1240. The circuit board 1243 is provided at one end 1241*a* which is an end portion of the case 1241 on a side of the electronic device connector 1140. Further, a contact portion which comes into contact with the terminal fitting 1142 is provided on an outer surface (surface on the side of the electronic device connector 1140) 1243*a* of the circuit board 1243.

The terminal fitting 1142 is configured by two components, that is, a terminal body 1143 that is fixed and supported to the connector housing 1141, and a spring piece 1144 that is fitted and connected to one end of the terminal body 1143.

The terminal body 1143 includes a fit connecting portion 1143*a* that protrudes into a connector fitting portion 1141*a* of the connector housing 1141, and a spring piece connecting portion 1143*b* that protrudes from a rear side of the connector housing 1141. The fit connecting portion 1143*a* is a portion to which the terminal fitting in the other party connector to be fitted to the connector fitting portion 1141*a* is fitted and connected. Further, the spring piece connecting portion 1143*b* is a portion to which the spring piece 1144 is fitted and connected.

As shown in FIG. 33, the spring piece 1144 includes a base end portion 1144*a* that is fitted and connected to the spring piece connecting portion 1143*b* of the terminal body 1143, a bending portion 1144*c* that extends from the base end portion 1144*a* and is bent in an approximately V-shaped form, a tip side arm portion 1144*d* that extends from the bending portion 1144*c*, and a contact connecting portion 1144*e* that is provided on a tip of the tip side arm portion 1144*d* to be in contact with a contact portion on the circuit board 1243.

The bending portion 1144*c* in the spring piece 1144 supports the tip side arm portion 1144*d* to be flexibly deformable in an axis direction of the terminal fitting (an arrow X3 direction in FIG. 29), and generates, when the contact connecting portion 1144*e* comes into contact with the contact portion on the circuit board 1243, an elastic force for pressing the contact connecting portion 1144*e* against the contact portion with a predetermined contact pressure, so that a state where the contact portion on the circuit board 1243 and the terminal body 1143 are in an electrical connection state is maintained.

The terminal fitting 1142 absorbs an assembly error generated between the circuit board 1243 and the terminal fitting 1142 by flexible deformation of the tip side arm portion 1144*d*.

The connector disclosed in Patent Document 2 is provided to reduce the number of components, to effectively simplify its assembly for miniaturization, and to improve reliability of an electrical connection.

To this end, specifically, a mounting portion for a substrate on which a module device is mounted and a connector fitting portion for an external connection are provided in a case of an electronic device. Further, a connector terminal of the electronic device includes a connector connecting portion at one end thereof and a locking portion for a relay contact at the other end thereof. Further, the connector connecting portion is provided to the case to protrude towards the connector fitting portion of the case, and the locking portion is provided to the case to protrude towards the substrate mounting portion of the case. Further, the relay contact includes an elastic pinching piece and an elastic contact piece, is connected to the locking portion of the connector terminal by the elastic pinching piece, and is electrically connected to the substrate by the elastic contact piece.

Thus, by merely inserting one end of the connector terminal into the relay contact to pinch the locking portion of the connector terminal by the elastic pinching piece provided in the relay contact, it is possible to connect the contact terminal and the relay contact, and to perform an electrical connection to the substrate by the elastic contact piece of the relay contact. Thus, the structure becomes simple, the number of components is reduced to easily achieve miniaturization, and the assembly is simply performed to reduce the number of processes of assembly.

Further, if the relay contact is configured to include plural elastic contact pieces, it is possible to effectively prevent a connection error.

In addition, if the lengths of the plural elastic contact pieces are set to be different from each other, resonance frequency varies for each elastic contact piece, and thus, it is possible to effectively prevent a connection error due to vibrations during traveling when a module device is an in-vehicle monitor camera, for example.

However, since an internal conductor of the connector is made of a solid cylindrical member, a method for connecting members other than the connector connecting portion to the substrate is necessary.

Further, an external conductor is formed by a plate material and has a hollow cylindrical shape, but similarly, the members other than the connector portion should have a substrate connecting portion for welding or the like. Thus, although the connection of the coaxial connector portion and the substrate is performed by direct wielding, a connecting portion (welded portion) is not movable (up and down, right and left, forward and backward).

Further, the relay contact has a difficulty in achieving miniaturization since the member is necessary for each electrode and a connecting portion with respect to the electrode becomes large.

[Patent Document 1] JP-A-2011-258422

[Patent Document 2] JP-A-2007-220511

SUMMARY

However, in the technique disclosed in Patent Document 1, the electrical connection between the linear conductor 1120 of the electronic device connector 1100 and the contact portion 1221 on the circuit board 1220 are performed through the relay terminal 1230. Thus, when the relay terminal 1230 is extended or contracted, the conductor part 1232 in the relay terminal 1230 is buckled, and thus, a mutual contact state of the plural particle-shaped conductors 1232*a* that form the conductor part 1232 is changed, to thereby lower the stability of electrical connection performance. Further, in the technique disclosed in Patent Document 1, since the relay terminal 1230 is necessary, the number of components increases.

In addition, in the technique disclosed in Patent Document 2, since the terminal fitting 1142 has a structure in which two components of the terminal body 1143 and the spring piece 1144 are assembled, the number of components increases and a cumulative assembly error easily occurs. Further, due to the cumulative assembly error, the amount of deformation of the spring piece 1144 easily shows variation. Due to the variation in the amount of deformation of the spring piece 1144, the contact pressure of the spring piece 1144 varies, and thus, it is difficult to secure reliability of the electrical connection.

In order to solve the above problems, an object of the invention is to provide an electronic device connector capable of enhancing reliability and durability of a connection between a terminal fitting in a connector housing and an electronic device and suppressing an increase in the number of components.

Another object of the invention is to provide an electronic device connector capable of simply connecting a connector connecting portion, respective members and a substrate without welding, in which even though the substrate is slightly movable upward and downward, rightward and leftward, and forward and backward, an assembly of electrodes is simply performed without cutoff of an electrical connection to thereby contribute to miniaturization.

The above object of the invention is achieved by the following configurations.

(1) An electronic device connector includes: a connector housing that is combined with a case of an electronic device; and a terminal fitting that is held by the connector housing, in which when the connector housing is combined with the case, the terminal fitting is electrically connected to a contact portion of the electronic device. Here, the terminal fitting includes an internal conductor, an external conductor disposed around the internal conductor, and a dielectric disposed between the internal conductor and the external conductor which are concentrically disposed, and the internal conductor and the external conductor are integrally provided with spring portions capable of being elastically deformed in contact with the contact portion of the electronic device.

(2) In the electronic device connector according to (1), the spring portion of the internal conductor and the spring portion of the external conductor are orthogonal in their extending directions in a plane orthogonal to the axes of the internal conductor and the external conductor.

(3) In the electronic device connector according to (1) or (2), the electronic device is an on-vehicle camera.

(4) In the electronic device connector according to any one of (1) to (3), each of the internal conductor and the external conductor includes a terminal body that is fixed and supported in the connector housing, and the spring portion that extends from a base end of the terminal body disposed on a side of the case of the electronic device, and the spring portion includes a flexible portion that extends in a tilted straight line that connects one end of the base end of the terminal body and the contact portion in a plane that extends along an axis of the terminal body, and generates a contact pressure with respect to the contact portion due to flexible deformation in an axial direction of the terminal body.

(5) In the electronic device connector according to (4), the flexible portion is formed in the tilted straight line shape that extends from one end of the base end of the terminal body disposed on a side separated from the contact portion and is directed toward the contact portion.

(6) In the electronic device connector according to any one of (1) to (5), the external conductor includes a shielding portion that shields an opening formed in the external conductor.

(7) An electronic device connector includes: an escutcheon configured to be combined with an electronic device; and a connector assembly configured to be held by the escutcheon, in which the connector assembly includes a conductor portion that includes an external conductor, an insulator including a cylinder portion that is protrudingly provided and is inserted into the external conductor and an internal conductor that is inserted into the cylinder portion of the insulator, and a substrate connecting spring that comes into contact with both the external conductor and the internal conductor, the external conductor is provided with a conductive holding portion that protrudes from an end portion thereof disposed on a side of the electronic device towards the electronic device, a holding portion inserting hole that passes through the holding portion is formed in a base of the insulator, the substrate connecting spring is provided in an outlet port of the holding portion inserting hole on the side of the electronic device and an end portion of the internal conductor on the side of the electronic device, the holding portion of the external conductor and the end portion of the internal conductor on the side of the electronic device come into contact with the substrate connecting spring as the holding portion of the external conductor is fitted into the holding portion inserting hole of the insulator, and a spring inserting groove is provided on a surface of the base of the insulator on the side of the electronic device, and the substrate connecting spring is inserted into the spring inserting groove in a direction orthogonal to an axial direction of the cylinder portion, and a portion that is in contact with a contact portion of the electronic device is exposed from the spring inserting groove.

(8) In the electronic device connector according to (7), the holding portion is formed in a channel shape, one leg portion of the channel shape is provided in the external conductor, a connecting portion of the channel shape is fitted into the holding portion inserting hole of the insulator to come into contact with the substrate connecting spring, an engaging portion is formed at a tip of the other leg portion of the channel shape, a tip inserting hole in which the engaging portion is inserted is formed in the escutcheon, and the engaging portion is inserted and fitted into the tip inserting hole.

(9) In the electronic device connector according to (8), a protrusion to be press-fitted into the insulator is formed in the other leg portion of the channel shape on the side of the connecting portion thereof.

(10) In the electronic device connector according to any one of (7) to (9), the substrate connecting spring includes a plurality of springs each of which includes a bending portion and two leg portions that extend from the bending portion in both directions in which respective end portions of one side leg portions of the springs are integrally formed by a common connecting plate, an end portion of the leg portion of the spring that is connected to the internal conductor, among the plurality of springs that are integrally formed with the common connecting plate, is cut out to be separated from the common connecting plate, and a spring inserting hole is provided in the surface of the base of the insulator on the side of the electronic device, the bending portion of each of the plurality of springs of the substrate connecting spring is inserted into the spring inserting hole, and a portion that comes into contact with a contact portion of the electronic device is exposed from the spring inserting hole.

(11) In the electronic device connector according to any one of (7) to (10), as the bending portions of the springs each of which includes the bending portion and two leg portions that extend from the bending portion in both directions are inserted into the spring inserting holes and the one leg portion including the portion that comes into contact with the contact portion of the electronic device is exposed from the spring inserting hole, the one leg portion is formed into a cantilevered spring, and the other leg portion is formed into a both-side fixed spring.

According to the above-described configuration of (1), when the connector housing is combined with the case of the electronic device, the spring portions of the internal conductor and the external conductor come to a state of being electrically connected to the contact portion of the electronic device. Since the spring portions of the internal conductor and the external conductor are elastically connected to the contact portion of the electronic device, even though a relative position thereof is minutely adjusted in the axial direction or in the direction orthogonal to the axis when the electronic device connector and the electronic device are connected to each other, the spring portions are deformed to follow the adjustment of the relative position, to thereby maintain an excellent contact state. Thus, it is possible to enhance reliability and durability of the electrical connection between the terminal fitting and the contact portion of the electronic device, and to allow positional deviation of the electronic device connector and the electronic device for assembly without an increase in the number of components.

According to the above-described configuration of (2), since the spring portion of the internal conductor and the spring portion of the external conductor are orthogonal in their extending directions in the plane orthogonal to the axis of the internal conductor and the external conductor, it is possible to dividedly allow positional deviation according to the extending directions of the spring portions.

According to the above-described configuration of (3), when a lens of the on-vehicle camera and an optical axis of an imaging element accurately match each other, even though a contact portion of the on-vehicle camera deviates in position, it is possible to allow the positional deviation for assembly when connecting the on-vehicle camera and the electronic device connector.

According to the above-described configuration of (4), since the spring portions of the internal conductor and the external conductor that come into elastic contact with the contact portion of the electronic device include the linear flexible portions that are flexibly deformed when being in contact with the contact portion of the electronic device, it is not necessary to perform a bending process for a large angle that exceeds 90 degrees in forming a V shape or U shape for which processing is difficult, to achieve easy processing and high accuracy manufacturing. Thus, it is possible to enhance contact reliability with high accuracy. Further, since the processing is easy, it is possible to reduce the processing cost, and to enhance the productivity.

According to the above-described configuration of (5), since the flexible portion extends from one end of the base end of the terminal body disposed on the side separated from the contact portion of the electronic device, it is possible to increase the length of the flexible portion, compared with a configuration in which the flexible portion extends from one end of the base end of the terminal body disposed on a side close to the contact portion. Thus, it is possible to reduce variation in the contact pressure when the spring portions are deformed by a predetermined amount in the axial direction of the terminal body due to contact with the contact portion, thereby maintaining a stable contact pressure and enhancing reliability of the electrical connection.

Further, it is possible to reduce the size of the terminal even when the length of the flexible portion is the same, compared with the configuration in which the flexible portion extends from one end of the base end of the terminal body disposed on the side close to the contact portion.

According to the above-described configuration of (6), since the external conductor that comes into elastic contact with the contact portion of the electronic device includes the shielding portion that shields the opening formed in the external conductor, it is possible to block external noise, and to achieve accurate signal transmission.

According to the above configuration of (7), as the holding portion of the external conductor is fitted into the holding portion inserting hole of the insulator, the holding portion of the external conductor and the end portion of the internal conductor on the side of the electronic device come into contact with the substrate connecting spring, respectively, the substrate connecting spring is inserted into the spring inserting groove in a direction orthogonal to an axial direction of the cylinder portion of the insulator without welding, and the connection of the connector connecting portion, each member and the substrate is simply performed. Further, even though the substrate is slightly movable upward and downward, rightward and leftward, and forward and backward, an assembly of electrodes is simply performed without cutoff of an electrical connection.

According to the above configuration of (8), as the holding portion is formed in the channel shape, one leg portion of the channel shape of the press-fit holding portion is integrally formed with the external conductor, the connecting portion of the channel shape is in contact with the substrate connecting spring, the tip inserting hole in which the other leg portion of the channel shape is inserted is formed in the escutcheon, and the other leg portion of the channel shape of the press-fit holding portion of the external conductor is inserted into the tip inserting hole of the escutcheon, an assembly of electrodes can be simply performed, and the escutcheon and the connector assembly can be simply mechanically coupled.

According to the above configuration of (9), as the protrusion to be press-fitted into the insulator is formed in the leg portion of the channel shape of the holding portion of the external conductor on the side of the connecting portion thereof, the external conductor and the insulator are reliably coupled.

According to the above configuration of (10), as the plural springs are integrally formed by the common connecting plate and the end portion of the leg portion of the spring that is connected to the internal conductor, among the plural springs that are integrally formed with the common connecting plate, is cut out to be separated from the common connecting plate, handling thereof becomes simple, and the manufacturing process is simplified, which is preferable.

According to the above configuration of (11), since one leg portion is formed into the cantilevered spring, the one leg portion is easily movable by a weak pressing force to improve follow-up performance. Further, since the other leg portion is formed into the both-side fixed spring, the other leg portion is firmly connected and held to the holding portion by a strong pressing force.

BRIEF DESCRIPTION OF DRAWINGS

FIGS. 34A to 34C are perspective views of a camera module in a state where an electronic device connector is assembled into an on-vehicle camera, according to an exemplary embodiment of the invention, in which FIG. 34A is a perspective view when seen from a connector assembly side, FIG. 34B is a perspective view when seen from a camera lens side, and FIG. 34C is a sectional view taken along an arrow 1C-1C in FIG. 34B.

FIGS. 42A to 42E are diagrams illustrating the appearance of an insulator 2040 shown in FIG. 35, in which FIG. 42A is a perspective view of the insulator, FIG. 42B is a side view of the insulator shown in FIG. 42A, FIG. 42C is a rear view of the insulator shown in FIG. 42A, FIG. 42D is a front view of the insulator shown in FIG. 42A, and FIG. 42E is a sectional view taken along an arrow 5E-5E in FIG. 42C.

FIGS. 43A to 43F are diagrams illustrating an appearance of a substrate connecting spring 2060 shown in FIG. 35, in which FIG. 43A is a perspective view of the substrate connecting spring, FIG. 43B is a rear view of the substrate connecting spring shown in FIG. 43A when seen in a direction of an arrow 6B, FIG. 43C is a side view of the substrate connecting spring shown in FIG. 43A when seen in a direction of an arrow 6C, FIG. 43D is a front view of the substrate connecting spring shown in FIG. 43A when seen in a direction of an arrow 6D, and FIG. 43E is a sectional view taken along an arrow 6E-6E shown in FIG. 43D.

DETAILED DESCRIPTION OF EXEMPLIFIED EMBODIMENTS

Hereinafter, an electronic device connector according to exemplary embodiments of the invention will be described with reference to the accompanying drawings.

First Exemplary Embodiment

Figure 1:
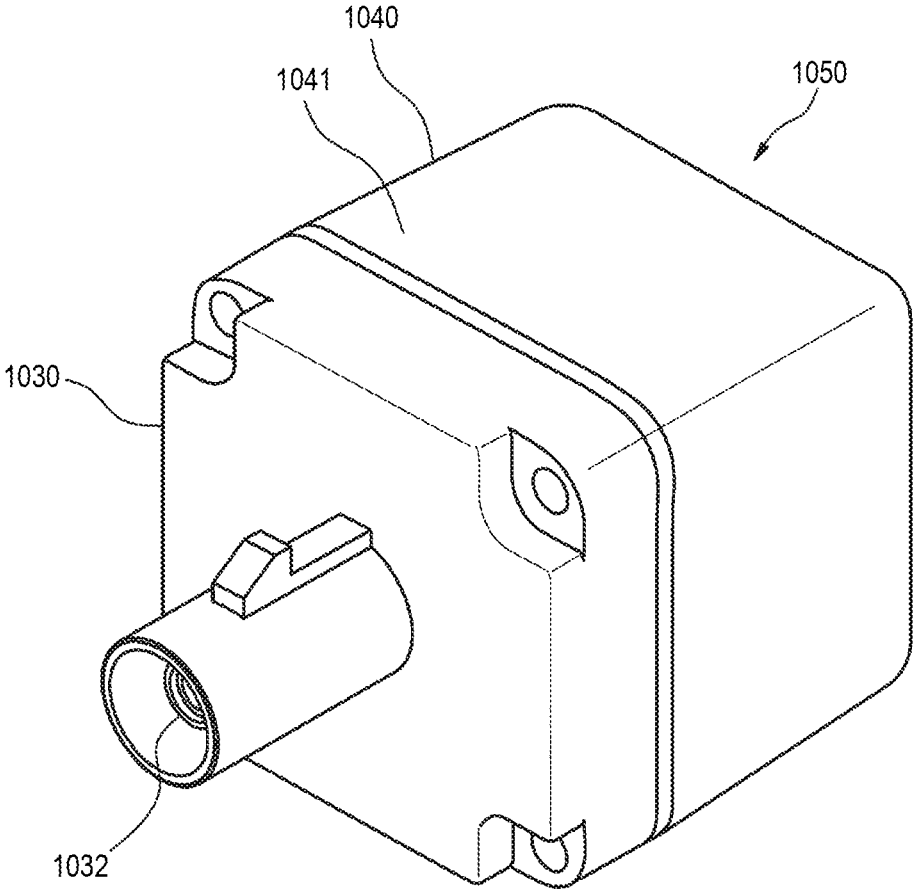
FIG. 1 is a perspective view of a camera module in a state where an electronic device connector according to a first exemplary embodiment of the invention is combined with an on-vehicle camera.
Figure 2:
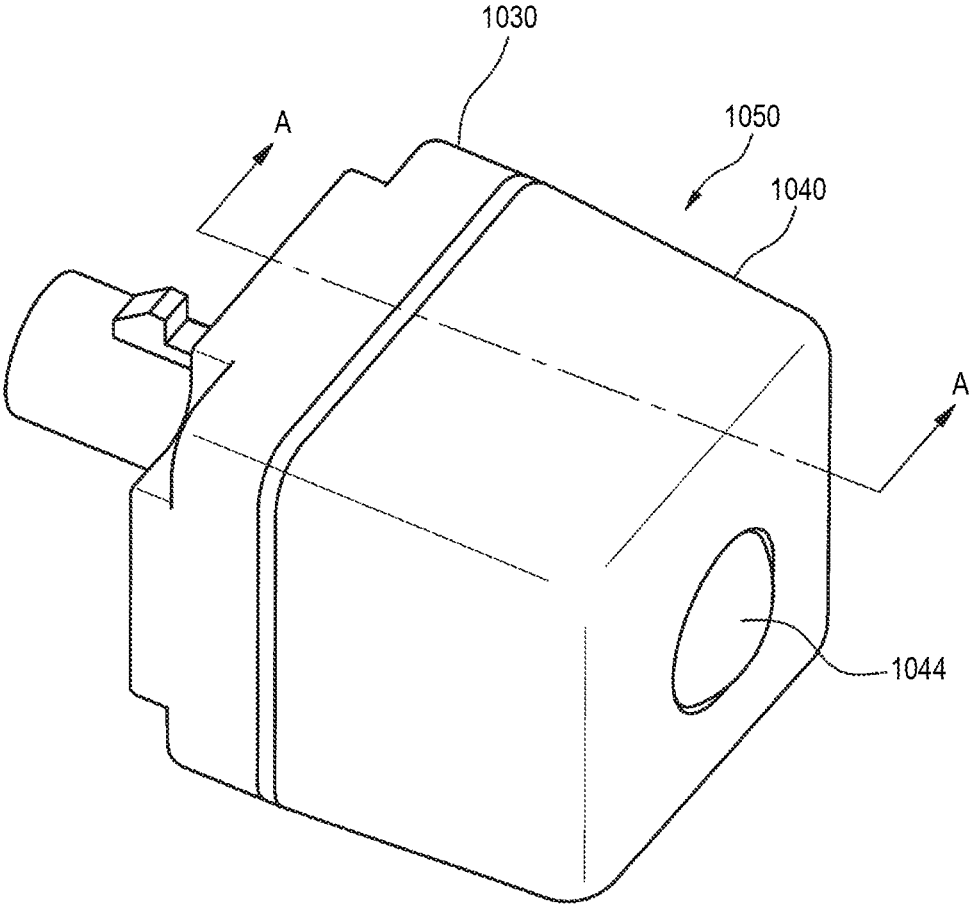
FIG. 2 is a perspective view of the camera module shown in FIG. 1 when seen from an angle different from FIG. 1.
Figure 3:
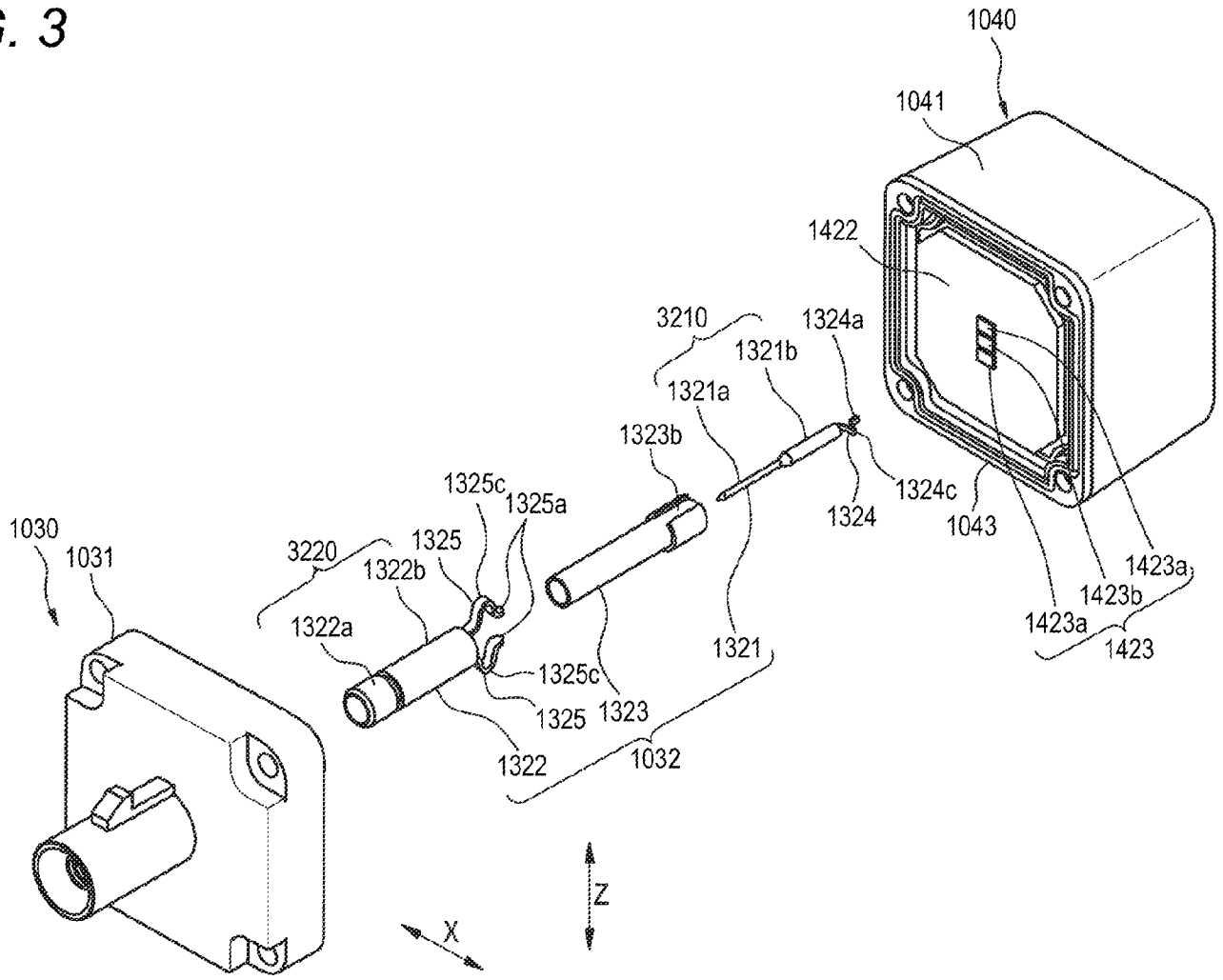
FIG. 3 is an exploded perspective view of the camera module shown in FIG. 1.
Figure 4:
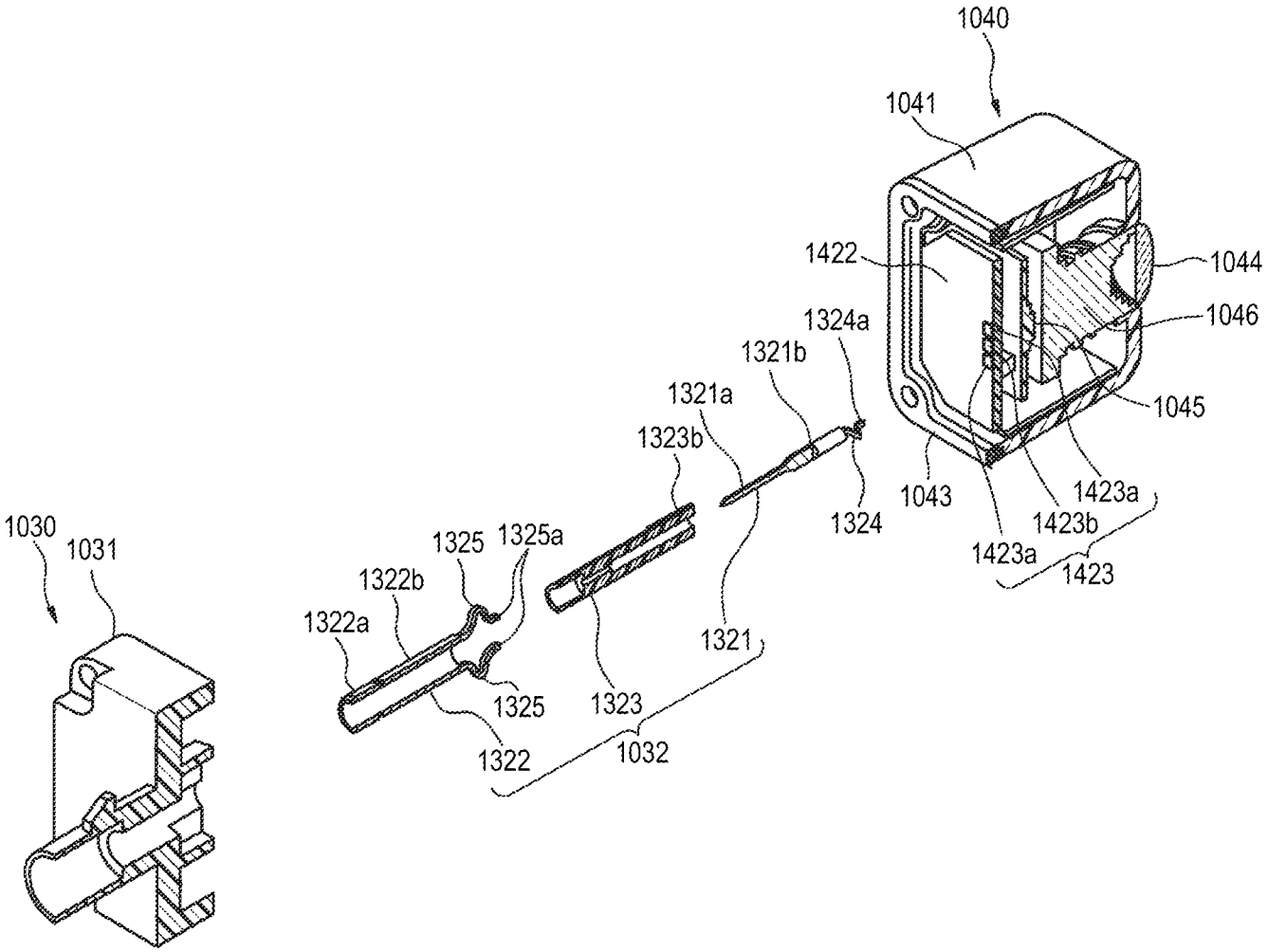
FIG. 4 is a partial sectional perspective view of the camera module shown in FIG. 3.
Figure 5:
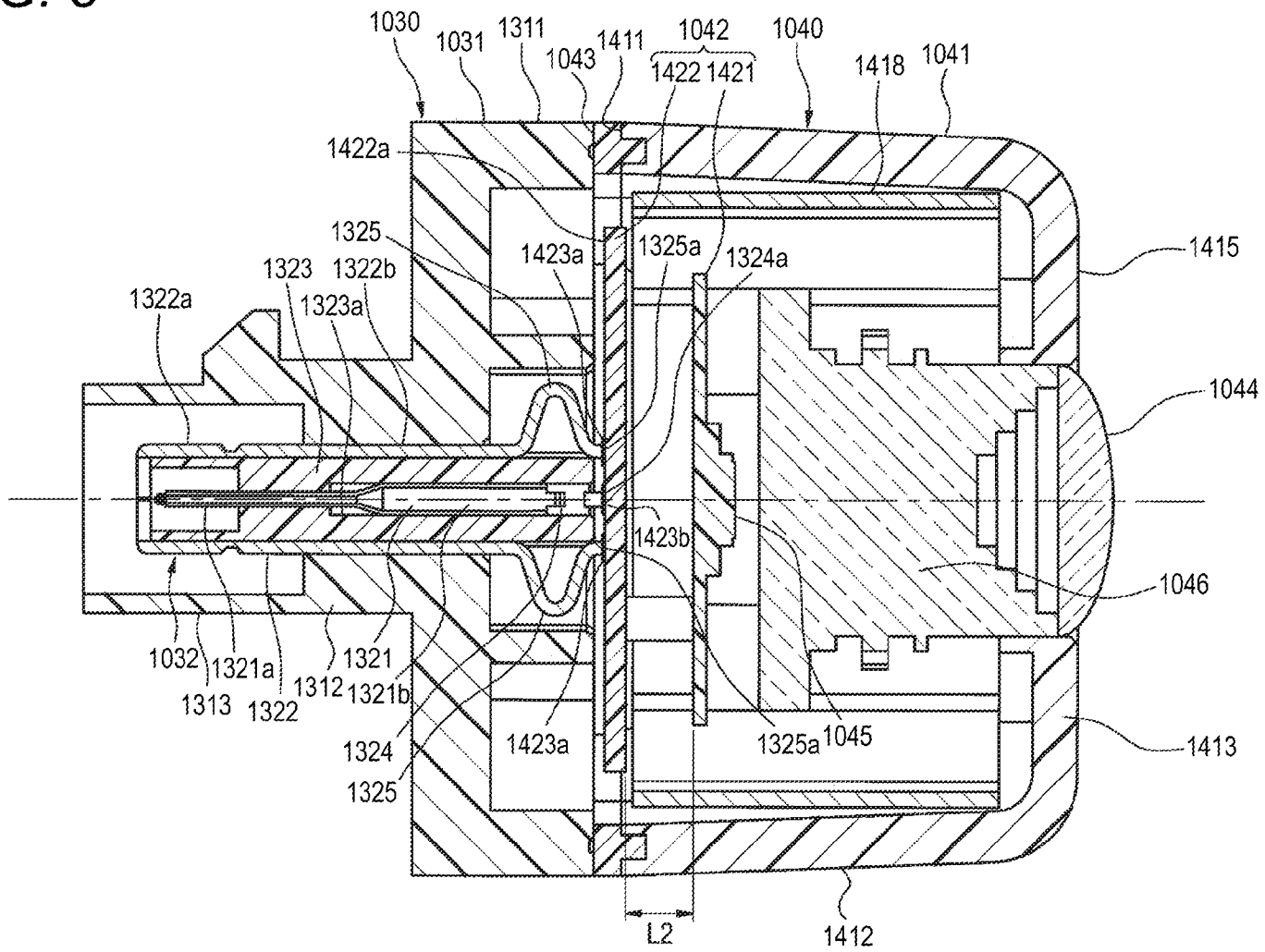
FIG. 5 is a sectional view of the camera module shown in FIG. 2, taken along line A-A.
Figure 6:
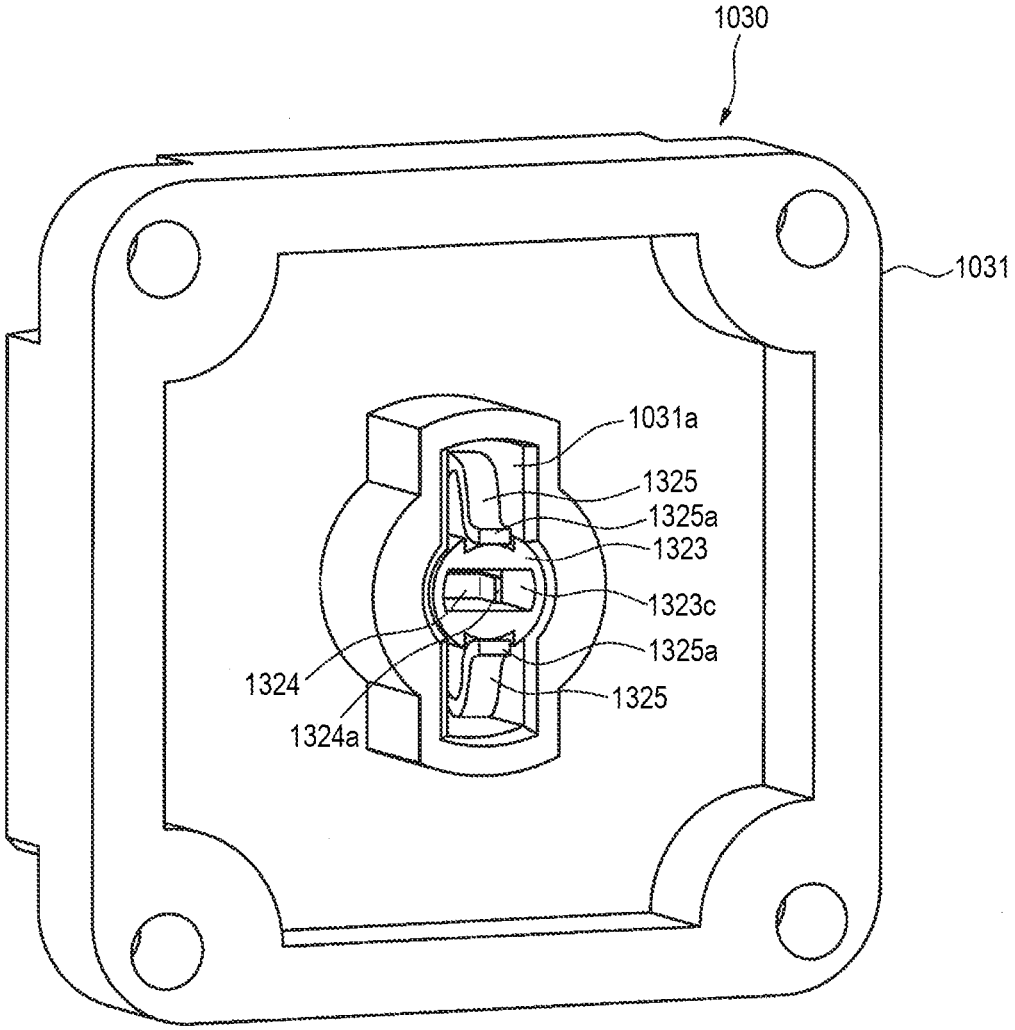
FIG. 6 is a perspective view of the electronic device connector shown in FIG. 1, when seen from a front surface side thereof.

FIGS. 1 to 6 show an electronic device connector according to a first exemplary embodiment of the invention, in which FIG. 1 is a perspective view of a camera module in a state where the electronic device connector is combined with an on-vehicle camera, FIG. 2 is a perspective view of the camera module when seen from an angle different from FIG. 1, FIG. 3 is an exploded perspective view of the camera module shown in FIG. 1, FIG. 4 is a partial sectional perspective view of the camera module shown FIG. 3, FIG. 5 is a sectional view of the camera module shown in FIG. 2, taken along line A-A, and FIG. 6 is a perspective view of the electronic device connector shown in FIG. 1, when seen from a front surface side thereof.

An electronic device connector 1030 according to the first exemplary embodiment includes a connector housing 1031 combined with an end (a left end in FIG. 5) 1411 of a case 1041 of an electronic device 1040, and a terminal filling 1032 held in the connector housing 1031. A sealed packing 1043 made of rubber is mounted on an end 1411 of the case 1041, and the connector housing 1031 is combined with the end 1411 of the case 1041 through the sealed packing 1043 for discharging water.

Before describing the configuration of the electronic device connector 1030 in detail, the configuration of the electronic device 1040 will be described.

The electronic device 1040 shown in the first exemplary embodiment is provided with a circuit board 1042 in an inner space of the case 1041 on a side of the one end 1411.

As shown in FIG. 5, the case 1041 includes a peripheral wall portion 1412 of an approximately square cylindrical shape, and a tip wall portion 1413 that covers the other end side (a right end side in FIG. 5) of the peripheral wall portion 1412.

In the case of the electronic device 1040 of the present exemplary embodiment, the circuit board 1042 is configured by two circuit boards 1421 and 1422 that are separated from each other in a length direction of a central axis O1 of the electronic device 1040. The two circuit boards 1421 and 1422 are disposed in parallel, and are assembled to the case 1041 in a direction where their surfaces are orthogonal to the central axis O1.

The two circuit boards 1421 and 1422 are combined to face each other at a predetermined separation interval L2 by connecting means (not shown). The two circuit boards 1421 and 1422 are assembled into the case 1041 as a single component.

As shown in FIG. 5, the electronic device 1040 of the present exemplary embodiment is an on-vehicle camera, a lens 1044 is mounted at the other end 1415 of the case 1041, and an imaging element 1045 that converts light incident through the lens 1044 into a video image signal is provided on the circuit board 1421 disposed on the side of the other end 1415. The lens 1044 is provided as a part of a lens unit 1046.

The circuit board 1421 provided with the imaging element 1045 is movable in a vertical direction or in a horizontal direction in a plane orthogonal to an optical axis. By finely adjusting the position of the imaging element 1045, the lens 1044 and the imaging element 1045 are assembled so that their optical axes match each other.

On an outer surface 1422*a* (a surface on the side of the electronic device connector 1030) of the circuit board 1422 disposed on the side of the one end 1411 of the case 1041, among the two circuit boards 1421 and 1422 that form the above-described circuit board 1042, a contact portion 1423 that is an output terminal portion of the imaging element 1045 is provided. The contact portion 1423 is a contact portion of the electronic device in the present exemplary embodiment. The contact portion 1423 is an electrode pattern. The contact portion 1423 is formed of a conductive member having a flat contact surface. The terminal fitting 1032 of the electronic device connector 1030 (to be described later) is electrically connected to the contact portion 1423 of the outer surface 1422*a* of the circuit board 1422, and receives an output signal of the imaging element 1045.

The lens 1044 and the circuit board 1422 are surrounded by an electromagnetic shield member 1418.

Next, the configuration of the electronic device connector 1030 will be described in detail.

The connector housing 1031 of the electronic device connector 1030 is an integrally molded article made of an insulating resin, and includes a flange portion 1311 that is combined with the one end 1411 of the case 1041, a terminal holding portion 1312 that is formed at a central part of the flange portion 1311, and a cylindrical cable accommodating portion 1313 that extends from the terminal holding portion 1312 toward a rear side (in a left direction in FIG. 5).

The flange portion 1311 of the connector housing 1031 is fixed to the one end 1411 of the case 1041 by fastening means or engaging means (not shown).

The cable accommodating portion 1313 is a portion that accommodates an end portion of a shield cable connected to the terminal fitting 1032.

As shown in FIG. 5, the terminal fitting 1032 is a shielded terminal that includes an internal conductor 1321 that is made of metal and is electrically connected to a contact portion 1423*b* on the circuit board 1422, a cylindrical external conductor 1322 that surrounds an outer periphery of the internal conductor 1321, is made of metal and is electrically connected to a contact portion 1423*a* on the circuit board 1422, and a dielectric 1323 that is made of a resin and fills a gap between the internal conductor 1321 and the external conductor 1322. The external conductor 1322 is connected with a braid or the like for shielding of a shield cable to be connected to the terminal fitting 1032.

The internal conductor 1321 has an approximately cylindrical solid shape, and includes a connecting portion 1321*a* with respect to a core wire of the shield cable, and a fixing portion 1321*b* that is formed to have a diameter larger than that of the connecting portion 1321*a* and is press-fitted and fixed into a terminal fixing hole 1323*a* of the dielectric 1323. One spring portion 1324 which is elastically deformable is integrally molded on a base side of the fixing portion 1321*b*. A tip portion 1324*a* of the spring portion 1324 comes into contact with the contact portion 1423*a* on the circuit board 1422 to be electrically connected thereto. The spring portion 1324 of the internal conductor 1321 extends from a base end of the fixing portion 1321*b* toward the circuit board 1422 along an axial direction (direction along the central axis O1 of the electronic device 1040) of the internal conductor 1321. Accordingly, in the present exemplary embodiment, the tip portion 1324*a* (tip surface) of the spring portion 1324 of the internal conductor 1321 is directed toward the circuit board 1422.

In other words, the connecting portion 1321*a* and the fixing portion 1321*b* in the internal conductor 1321 of the present exemplary embodiment form a terminal body 3210 that is fixed into the connector housing 1031. Accordingly, the internal conductor 1321 of the present exemplary embodiment has a configuration in which the spring portion 1324 is integrally formed with a base end of the terminal body 3210 fixed into the connector housing 1031.

Further, as shown in FIG. 3, the spring portion 1324 of the present exemplary embodiment includes a bending portion 1324*c* for giving an elastic property to an intermediate portion which is a portion in the middle of extending toward the circuit board 1422. The bending portion 1324*c* is a V-shaped (or "<" shaped) bending portion that protrudes toward one side thereof (in FIG. 3, for example, the right side from a planar view). The bending portion 1324*c* gives an extendable spring characteristic in the axial direction of the internal conductor 1321 to the spring portion 1324. An angle of a valley portion in the V-shaped bending portion 1324*c* is set to a narrow angle of 90 degrees or smaller, for example. Accordingly, when the bending portion 1324*c* is formed, a process of bending a plate piece for the spring portion 1324 to a large angle that exceeds 90 degrees is necessary.

In the internal conductor 1321 of the present exemplary embodiment, as the tip portion 1324*a* of the spring portion 1324 comes into contact with the contact portion 1423*b*, a contact pressure increases, and a stable electrical connection state is obtained. By sharpening the tip portion 1324*a* of the spring portion 1324, the contact pressure further increases, and a more stable electrical connection state is obtained.

The external conductor 1322 has a hollow cylindrical shape, and includes a connecting portion 1322*a* with respect to the braid for shielding of the shield cable, and a fixing portion 1322*b* fixed to the terminal holding portion 1312 of the connector housing 1031. On a base side of the fixing portion 1322*b*, a pair of elastically deformable spring portions 1325 is integrally formed to face each other. A tip portion 1325*a* of the spring portion 1325 is a portion that comes into contact with the contact portion 1423*a* on the circuit board 1422 to be electrically connected thereto. The spring portion 1325 of the external conductor 1322 extends from the base end of the fixing portion 1322*b* toward the circuit board 1422 along the axial direction of the external conductor 1322 (along the direction along the central axis O1 of the electronic device 1040). Accordingly, in the present exemplary embodiment, the tip portion 1325*a* (tip surface) of the spring portion 1325 of the external conductor 1322 is directed toward the circuit board 1422.

In other words, the connecting portion 1322*a* and the fixing portion 1322*b* in the external conductor 1322 of the present exemplary embodiment form a terminal body 3220 that is fixed into the connector housing 1031. Accordingly, the external conductor 1322 of the present exemplary embodiment has a configuration in which the spring portion 1325 is integrally formed with a base end of the terminal body 3220 that is fixed into the connector housing 1031.

Figure 7:
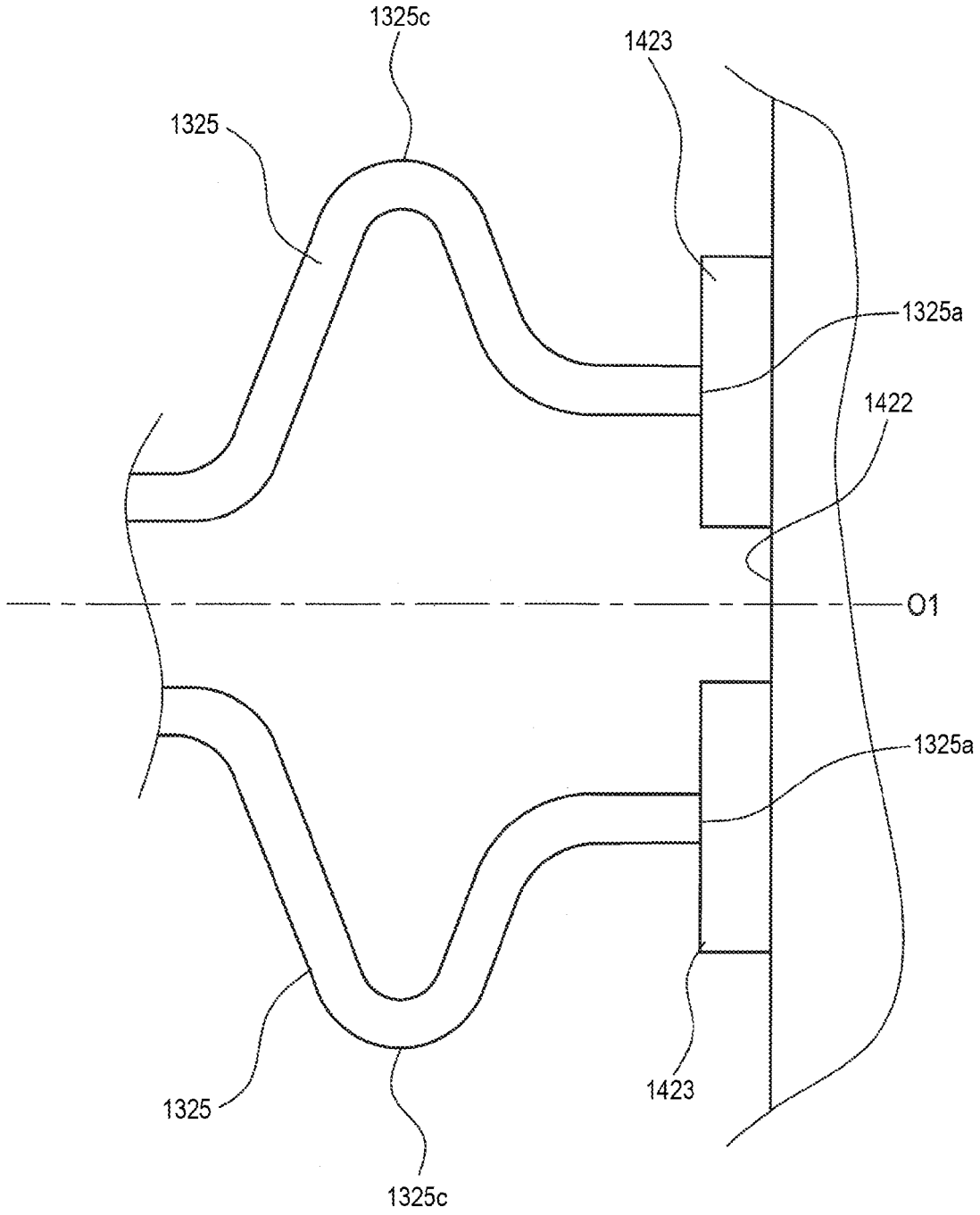
FIG. 7 is a schematic view of a spring portion.

Further, as shown in FIG. 7, the spring portion 1325 of the present exemplary embodiment has a bending portion 1325*c* for giving a spring property to an intermediate portion which is a portion in the middle of extending toward the circuit board 1422. The bending portion 1325*c* is a U-shaped (or V-shaped) bending portion that protrudes toward one side (in FIG. 4, for example, an upper side or a lower side in the vertical direction). The bending portion 1325*c* gives an extendable spring characteristic in the axial direction of the external conductor 1322 to the spring portion 1325. A valley portion in the U-shaped bending portion 1325*c* is formed by a process of bending a plate piece for the spring portion 1325 by about 180 degrees.

In the external conductor 1322 of the present exemplary embodiment, as shown in FIG. 7, as the tip portion 1325*a* of the spring portion 1325 comes into contact with the contact portion 1423*a*, a contact pressure increases, and a stable electrical connection state is obtained. By sharpening the tip portion 1325*a* of the spring portion 1325, the contact pressure further increases, and a more stable electrical connection state is obtained.

The dielectric 1323 is formed in an approximately hollow cylindrical shape, and the fixing portion 1321*b* of the internal conductor 1321 is fitted and fixed into the terminal fixing hole 1323*a*. The dielectric 1323 to which the internal conductor 1321 is fitted and fixed is fitted and fixed into the external conductor 1322. A groove portion 1323*b* capable of being engaged with the spring portion 1325 of the external conductor 1322 is formed on a peripheral surface of the dielectric 1323 on a base part side thereof. As the spring portion 1325 of the external conductor 1322 is engaged with the groove portion 1323*b* of the dielectric 1323, a relative rotation between the external conductor 1322 and the dielectric 1323 is prevented. Thus, a relative rotation between the internal conductor 1321 fixed to the dielectric 1323 and the external conductor 1322 is prevented.

The dielectric 1323 in which the internal conductor 1321 is fixed is press-fitted and fixed into the external conductor 1322, so that the terminal fitting 1032 is formed.

As shown in FIG. 6, an opening 1323*c* through which the spring portion 1324 of the internal conductor 1321 is exposed is formed on a tip side (electronic device side) of the dielectric 1323. As shown in FIG. 6, an opening 1031*a* through which the spring portion 1324 of the internal conductor 1321 and the spring portion 1325 of the external conductor 1322 are exposed is formed on a tip side (electronic device side) of the connector housing 1031.

The spring portion 1324 of the internal conductor 1321 is formed to be bent in a valley shape in the Xa-directional plane in FIG. 3. The spring portion 1325 of the external conductor 1322 is formed to be bent in a chevron shape in the Za-directional plane in FIG. 3. Accordingly, in the state of being mounted on the connector housing 1031, as shown in FIG. 6, the spring portion 1324 of the internal conductor 1321 and the spring portion 1325 of the external conductor 1322 are arranged in a cross form when seen from the axial direction. That is, the spring portion 1324 of the internal conductor 1321 and the spring portion 1325 of the external conductor 1322 are orthogonal to each other in their extension directions (Xa-direction and Za-direction in FIG. 3) in the plane orthogonal to the axial center (O1). The tip portions 1324*a* and 1325*a* of both the spring portions 1324 and 1325 protrude from the surface of the connector housing 1031.

Since the spring portion 1324 of the internal conductor 1321 and the spring portion 1325 of the external conductor 1322 are orthogonal to each other in their extension directions in the plane orthogonal to the central axis (axial center) O1, it is possible to dividedly allow positional deviation according to the extension direction of the spring portions 1324 and 1325.

According to the configuration of the electronic device connector 1030 of the above-described first exemplary embodiment, when the connector housing 1031 is combined with the one end 1411 of the case 1041 of the electronic device 1040, the terminal fitting 1032 and the contact portion 1423 on the circuit board 1042 in the electronic device 1040 elastically come into contact with each other, to thereby be in an electrical connection state.

Thus, even though the terminal fitting 1032 and the circuit board 1042 slightly deviate in their positions, since the spring portions 1324 and 1325 of the internal conductor 1321 and the external conductor 1322 are elastically deformed, the positional deviation is allowed to maintain a stable connection state.

Further, according to the configuration of the electronic device connector 1030 of the first exemplary embodiment, since the spring portions 1324 and 1325 of the internal conductor 1321 and the external conductor 1322 are elastically deformed, a dimensional error due to an assembly error or the like is absorbed. Thus, it is possible to obtain a stable electrical connection state between the terminal fitting 1032 in the electronic device connector 1030 and the contact portion of the circuit board 1042.

Second Exemplary Embodiment

Figure 9:
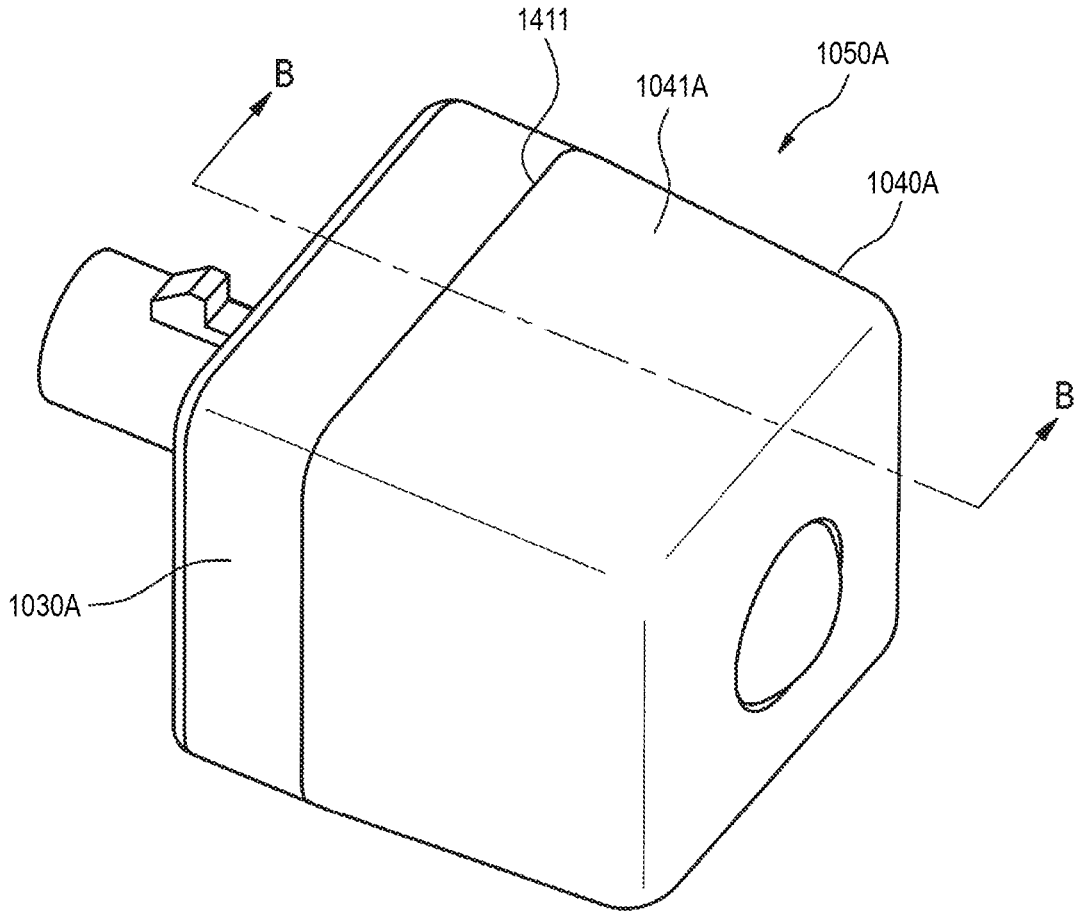
FIG. 9 is a perspective view of a camera module in a state where an electronic device connector according to a second exemplary embodiment of the invention is combined with an on-vehicle camera.
Figure 10:
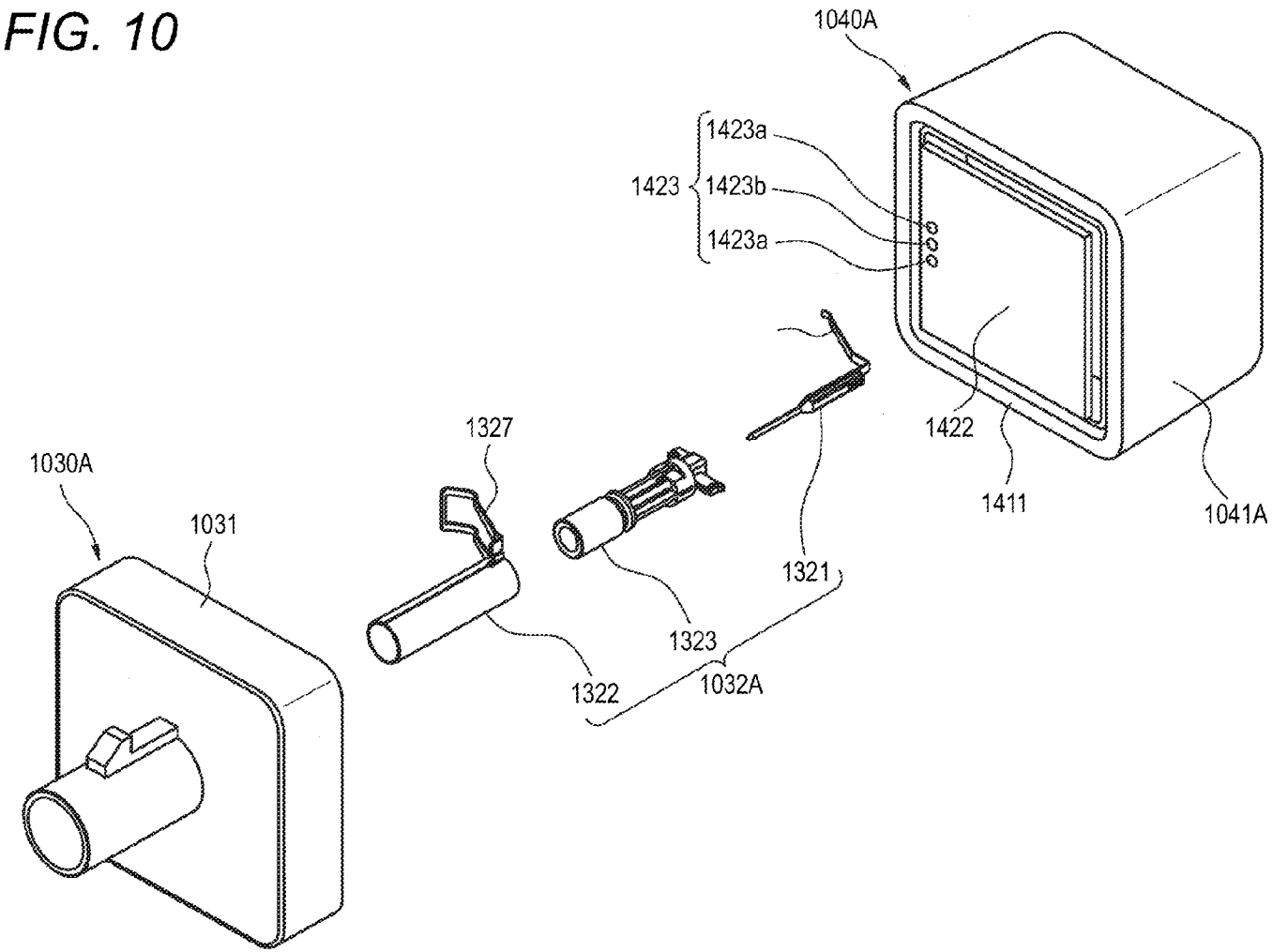
FIG. 10 is an exploded perspective view of the camera module shown in FIG. 9.
Figure 11:
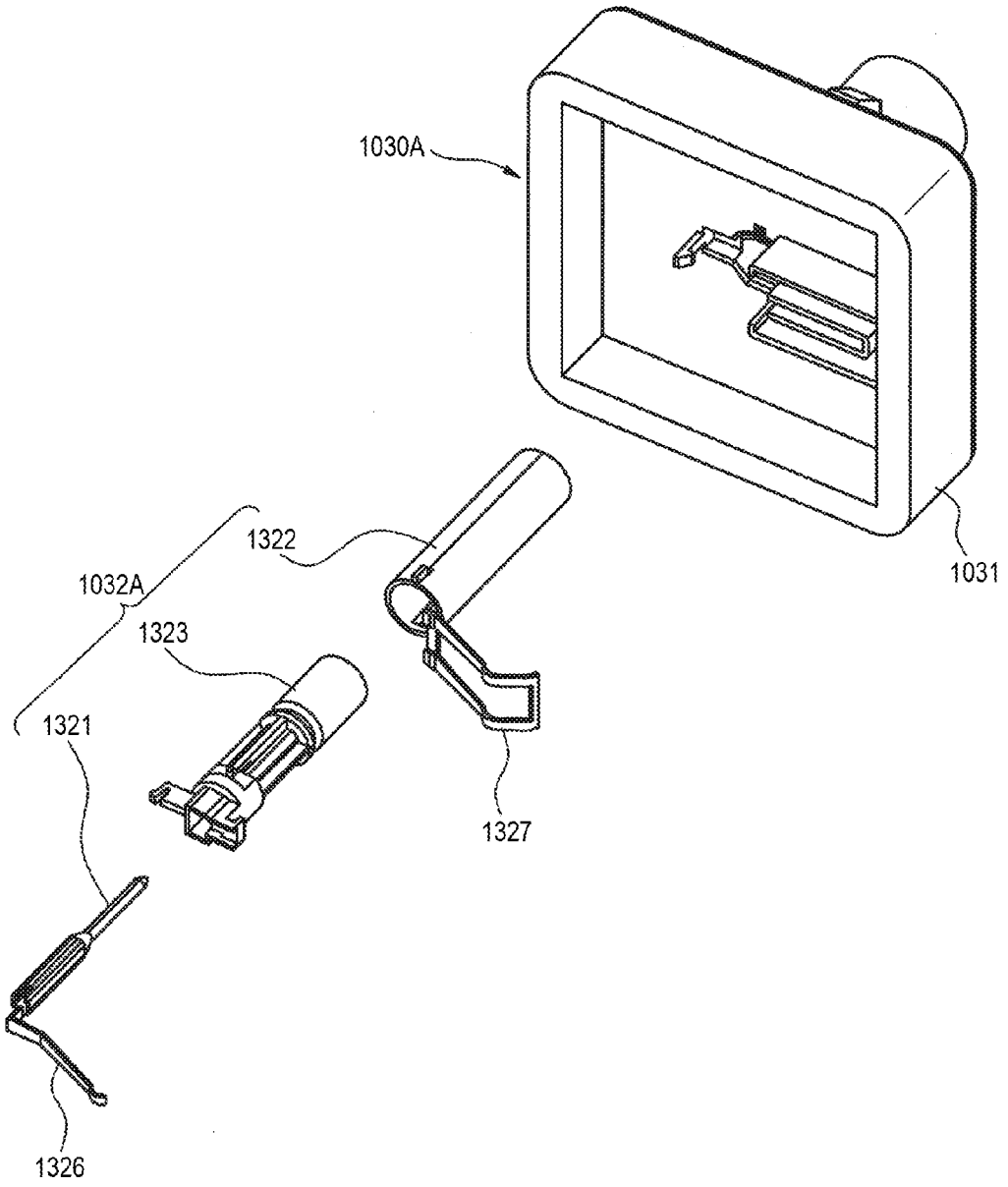
FIG. 11 is an exploded perspective view of the electronic device connector according to the second exemplary embodiment of the invention, when seen from a rear surface side thereof.
Figure 12:
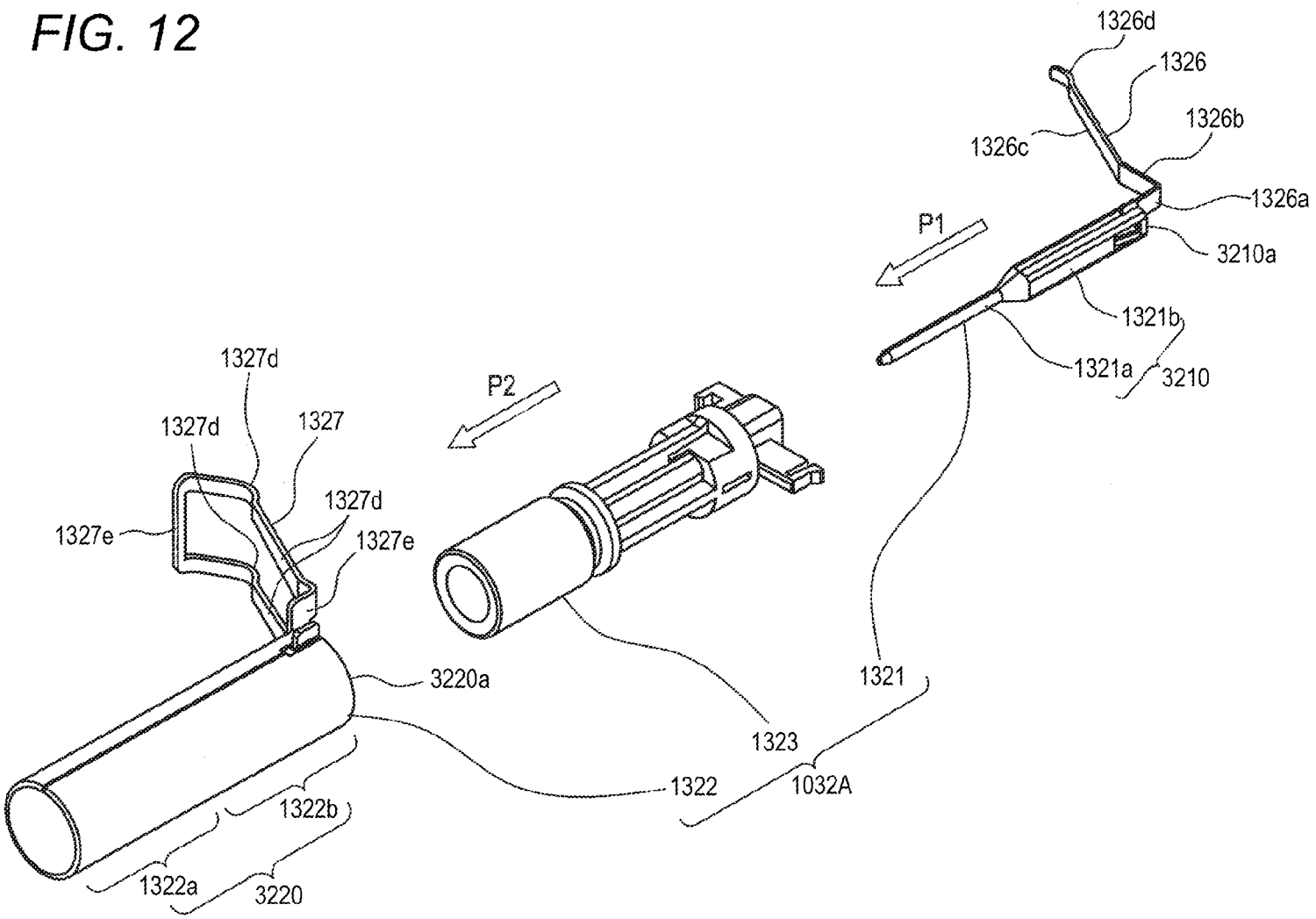
FIG. 12 is an enlarged exploded perspective view of a terminal fitting in the electronic device connector according to the second exemplary embodiment of the invention.
Figure 13:
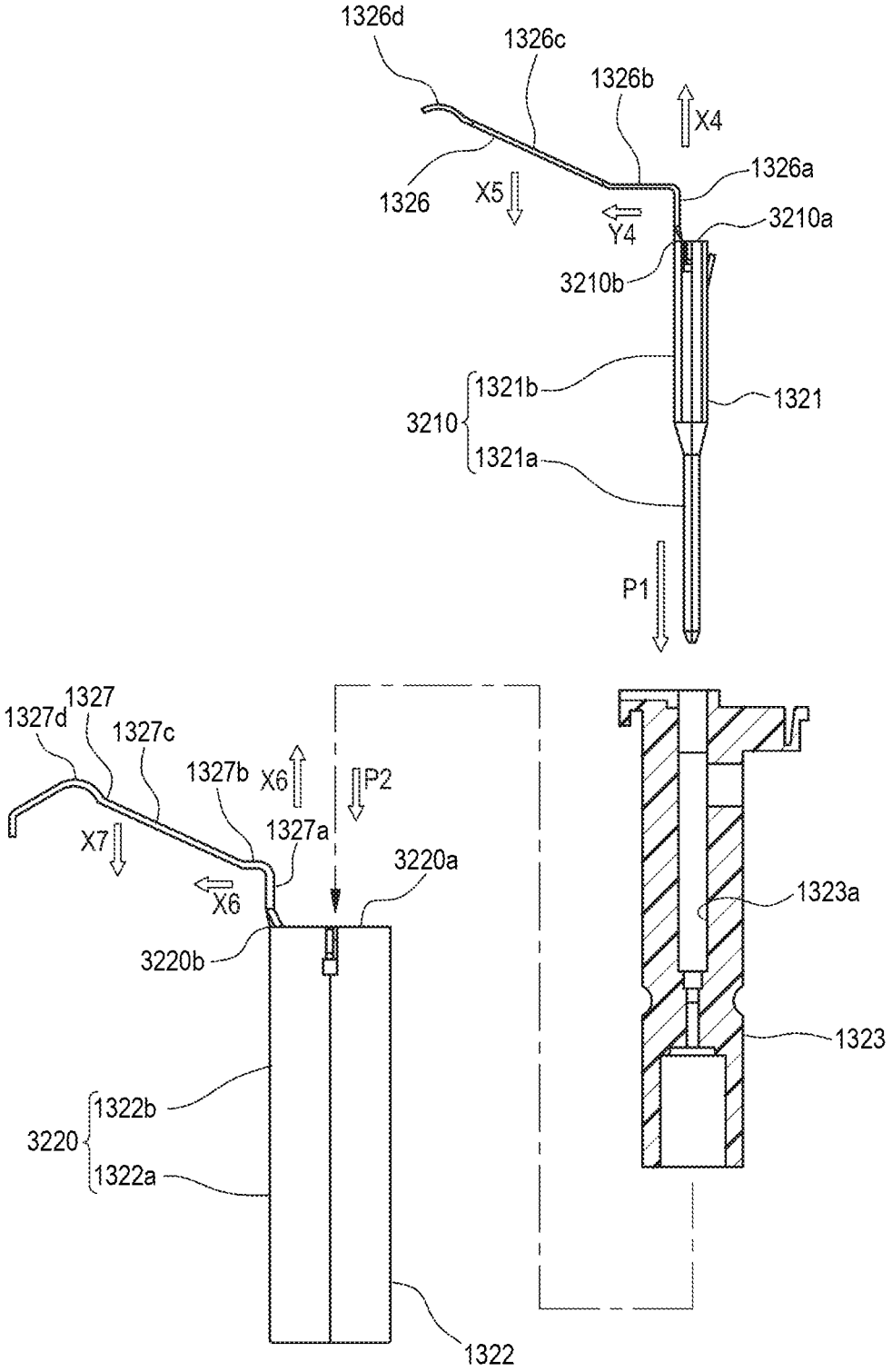
FIG. 13 is a plan view of each component of the terminal fitting shown in FIG. 12.
Figure 14:
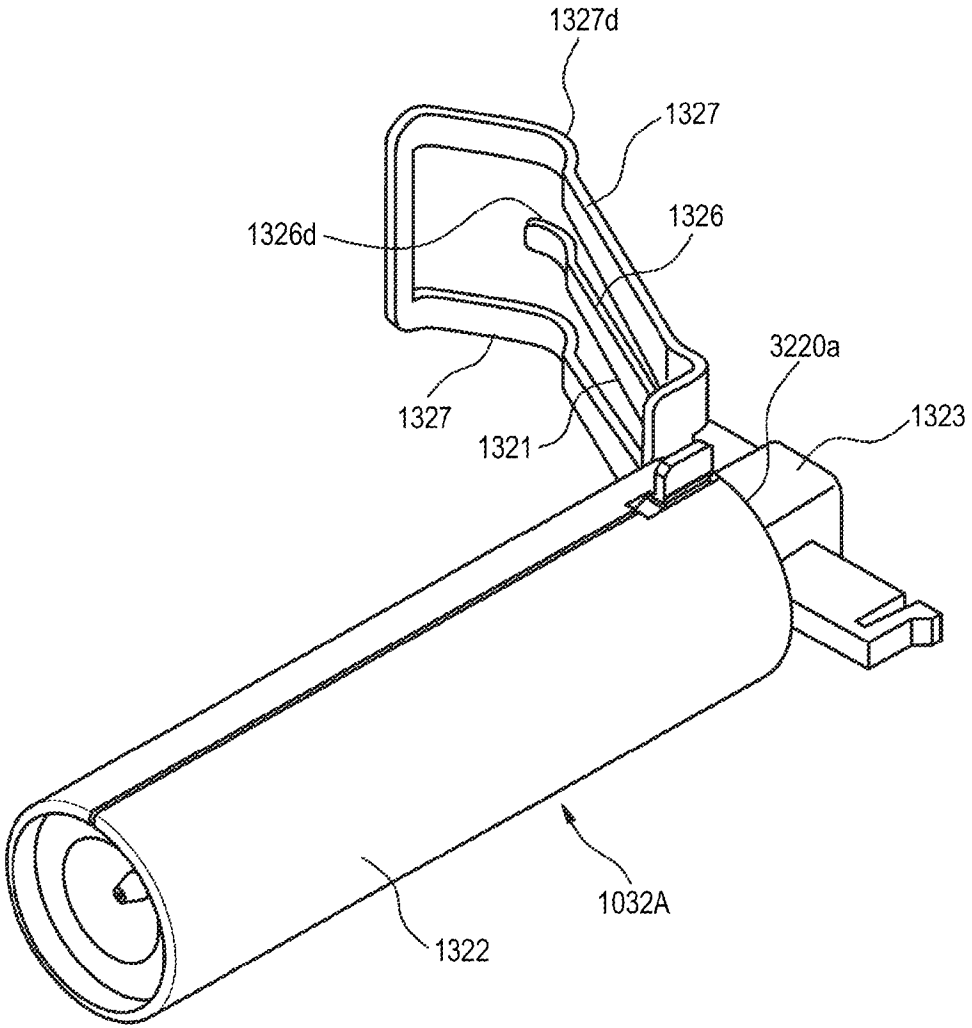
FIG. 14 is a perspective view of an assembly state of the terminal fitting shown in FIG. 12.
Figure 15:
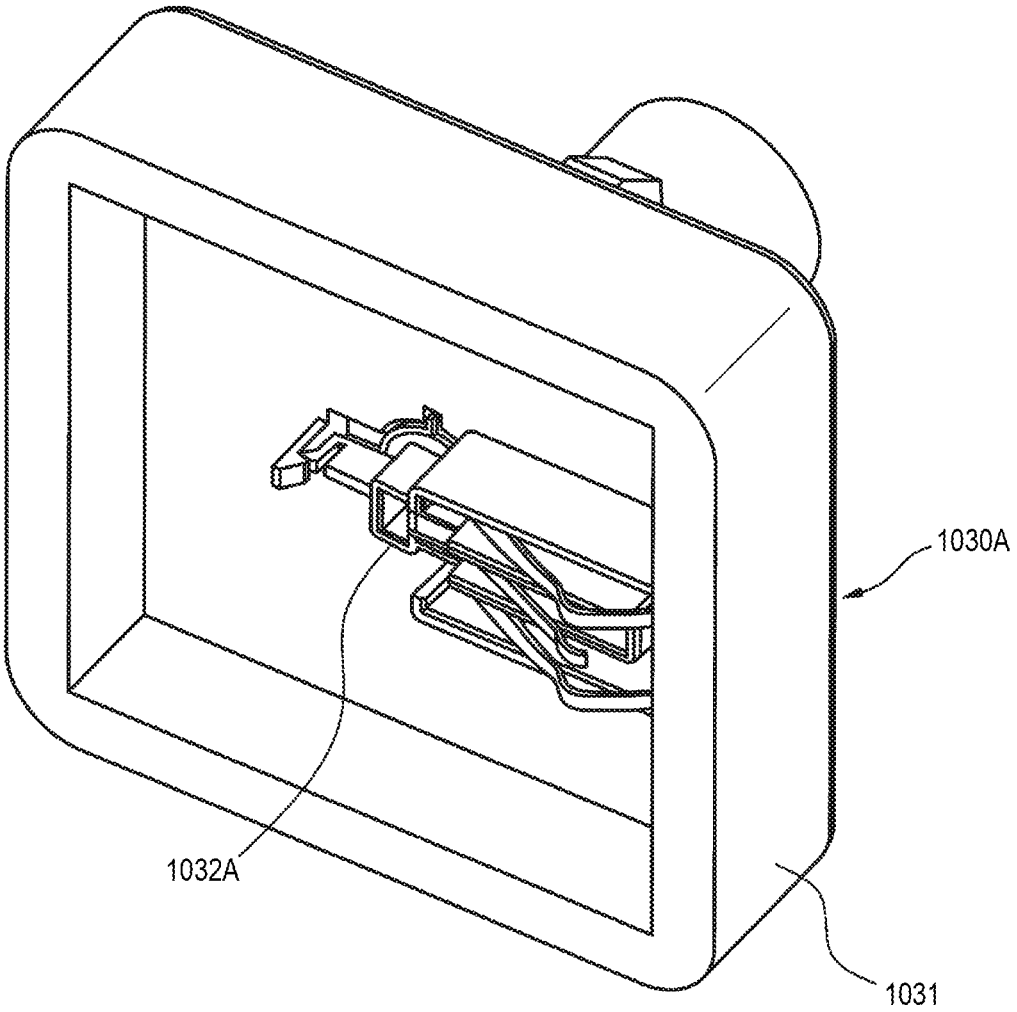
FIG. 15 is an exploded perspective view of the electronic device connector according to the second exemplary embodiment of the invention, when seen from a rear surface side thereof.
Figure 16:
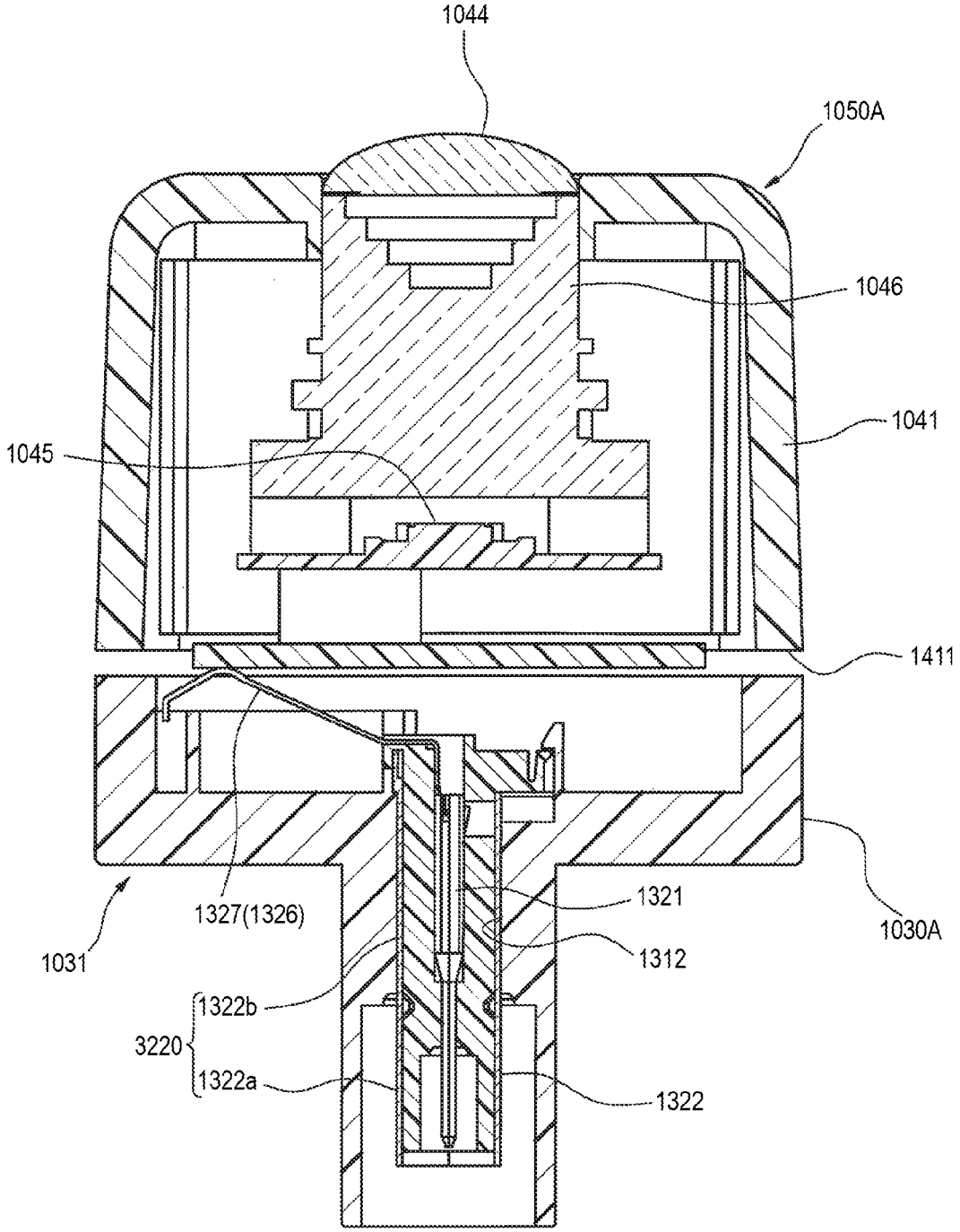
FIG. 16 is a longitudinal sectional view illustrating a state before the electronic device connector according to the second exemplary embodiment of the invention is combined with the on-vehicle camera.
Figure 17:
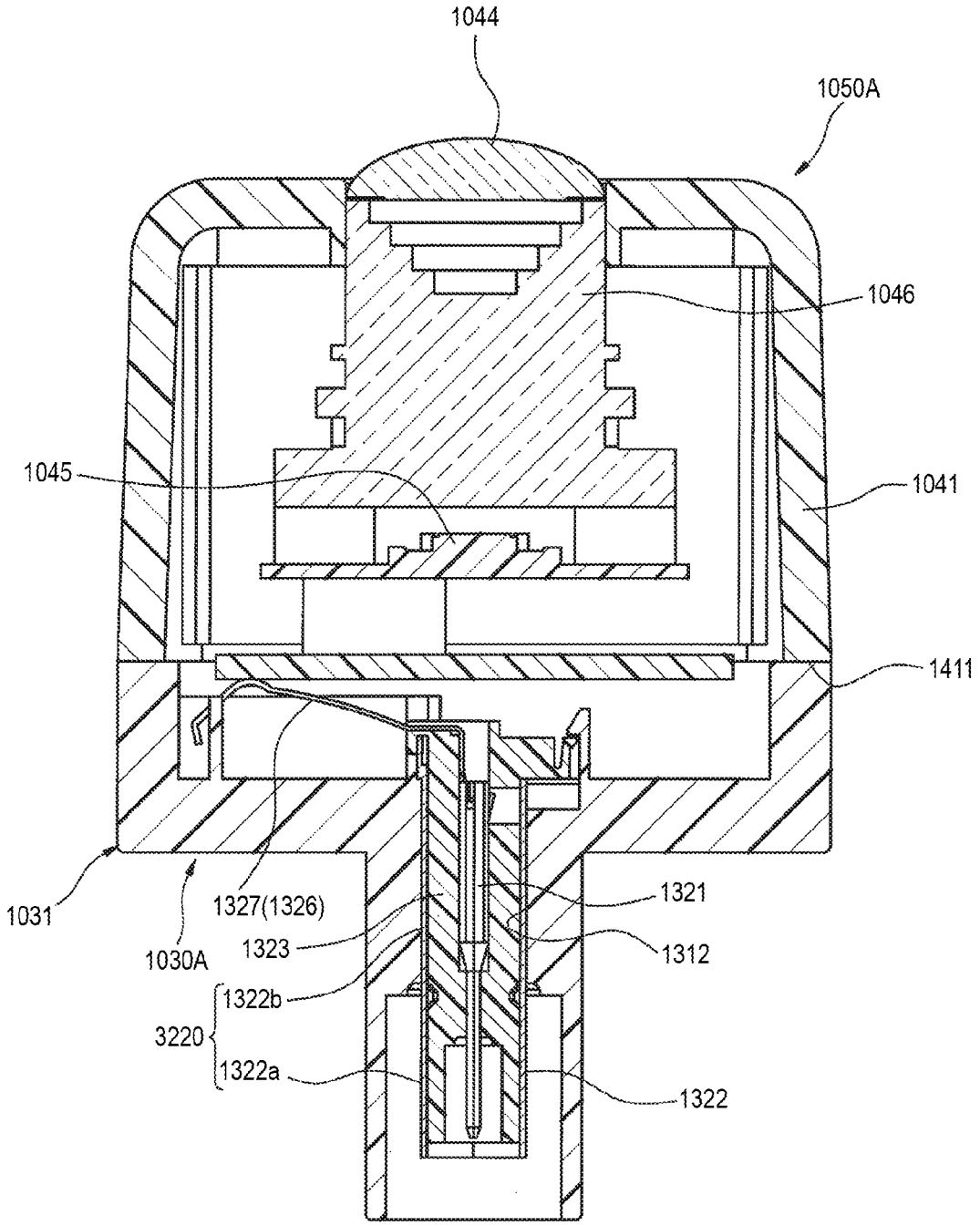
FIG. 17 is a longitudinal sectional view illustrating a state where the electronic device connector according to the second exemplary embodiment of the invention is combined with the on-vehicle camera, taken along line B-B in FIG. 9.

FIGS. 9 to 17 show an electronic device connector according to a second exemplary embodiment of the invention, in which FIG. 9 is a perspective view of a camera module in a state where the electronic device connector according to the second exemplary embodiment is combined with an on-vehicle camera, FIG. 10 is an exploded perspective view of the camera module shown in FIG. 9, FIG. 11 is an exploded perspective view of the electronic device connector according to the second exemplary embodiment of the invention, when seen from a rear surface side thereof, FIG. 12 is an enlarged exploded perspective view of a terminal fitting in the electronic device connector according to the second exemplary embodiment of the invention, FIG. 13 is a plan view of each component of the terminal fitting shown in FIG. 12, FIG. 14 is a perspective view of an assembly state of the terminal fitting shown in FIG. 12, FIG. 15 is an exploded perspective view of the electronic device connector according to the second exemplary embodiment of the invention, when seen from a rear surface side thereof, FIG. 16 is a longitudinal sectional view illustrating a state before the electronic device connector according to the second exemplary embodiment of the invention is combined with the on-vehicle camera, and FIG. 17 is a longitudinal sectional view illustrating a state where the electronic device connector according to the second exemplary embodiment of the invention is combined with the on-vehicle camera, taken along line B-B in FIG. 9.

A camera module 1050A shown in FIG. 9 has a configuration in which an electronic device connector 1030A of the second exemplary embodiment of the invention is assembled in one end 1411 of a case 1041A of an electronic device 1040A which is an on-vehicle camera.

The electronic device connector 1030A of the second exemplary embodiment has the same configuration as that of the first exemplary embodiment, except that the spring portions 1324 and 1325 of the terminal fitting 1032 in the electronic device connector 1030 of the first exemplary embodiment are changed to spring portions 1326 and 1327.

Further, the electronic device 1040A shown in FIG. 10 has a configuration in which the mounting position of the contact portion 1423 on the circuit board 1422 in the electronic device 1040 of the first exemplary embodiment is changed to a position corresponding to the spring portions 1326 and 1327. The electronic device 1040A has the same configuration as that of the electronic device 1040 of the first exemplary embodiment except that the mounting position of the contact portion 1423 is changed.

In the electronic device connector 1030A and the electronic device 1040A of the second exemplary embodiment, the same reference numerals are given to the same components as those of the electronic device connector 1030 and the electronic device 1040 of the first exemplary embodiment, and a description thereof will not be repeated, or will be simplified.

The electronic device connector 1030A of the second exemplary embodiment includes a connector housing 1031 that is combined with the case 1041A of the electronic device 1040A which is the on-vehicle camera, and a terminal fitting 1032A that is held by the connector housing 1031. Further, when the connector housing 1031 is combined with the case 1041A, the terminal fitting 1032A of the electronic device connector 1030A is electrically connected to the contact portion 1423 of the electronic device 1040A.

As shown in FIGS. 11 to 14, the terminal fitting 1032A of the present exemplary embodiment is provided with an internal conductor 1321, an external conductor 1322 that is disposed around the internal conductor 1321, and a dielectric 1323 that is disposed between the internal conductor 1321 and the external conductor 1322 on the same axis, similar to the terminal fitting 1032 of the first exemplary embodiment.

Further, the internal conductor 1321 and the external conductor 1322 are independent terminal fittings, and are integrally provided with the spring portions 1326 and 1327 capable of being elastically deformed in contact with a contact portion 1423 of the electronic device 1040A.

The internal conductor 1321 and the external conductor 1322 of the present exemplary embodiment include terminal bodies 3210 and 3220 that are fixedly supported in the connector housing 1031, and the spring portions 1326 and 1327 that extend from base ends of the terminal bodies 3210 and 3220.

The terminal body 3210 in the internal conductor 1321 includes a connecting portion 1321*a* with respect to a core wire of a shield cable, and a fixing portion 1321*b* that is formed to have a diameter larger than that of the connecting portion 1321*a* and is fitted and fixed into a terminal fixing hole 1323*a* (see FIG. 13) of the dielectric 1323.

The spring portion 1326 provided in the internal conductor 1321 extends from a base end 3210*a* of the terminal body 3210 disposed on the side of the case 1041A of the electronic device 1040A at a portion where the internal conductor 1321 is electrically connected to a contact portion 1423*b* on the circuit board 1422.

As shown in FIG. 13, the spring portion 1326 extends from one end 3210*b* disposed in the vicinity of the contact portion 1423 of the base end 3210*a* of the terminal body 3210 in a plane (paper surface in FIG. 13) that extends along the axis of the terminal body 3210. Further, the spring portion 1326 of the second exemplary embodiment includes an axially extending portion 1326*a* that extends in the axis direction (an arrow X4 direction in FIG. 13) of the terminal body 3210 from the one end 3210*b* of the base end 3210*a* of the terminal body 3210, a radially extending portion 1326*b* that extends from a tip of the axially extending portion 1326*a* in the above-mentioned plane in a radially outward direction (an arrow Y4 direction in FIG. 13) of the terminal body 3210, and a flexible portion 1326*c* that extends in a tilted straight line shape that connects a tip of the radially extending portion 1326*b* and the contact portion 1423*b*, and a contact portion 1326*d* that protrudes from a tip of the flexible portion 1326*c* to come into contact with the contact portion 1423*b*. The flexible portion 1326*c* generates a contact pressure with respect to the contact portion 1423*b* due to flexible deformation in the axial direction (an arrow X5 direction in FIG. 13) of the terminal body 3210.

The spring portion 1326 may have a structure in which the axially extending portion 1326*a* and the radially extending portion 1326*b* are not provided. That is, the spring portion 1326 may include the flexible portion 1326*c* that extends in the tilted straight line that connects one end 3210*b* of the base end 3210*a* of the terminal body 3210 to the contact portion 1423*b* in the plane that extends along the axis of the terminal body 3210 and generates a contact pressure with respect to the contact portion 1423 due to flexible deformation in the axial direction of the terminal body 3210, and the contact portion 1326*d* that protrudes from the tip of the flexible portion 1326*c* to come into contact with the contact portion 1423.

As indicated by an arrow P1 in FIGS. 12 and 13, the internal conductor 1321 is inserted into the terminal fixing hole 1323*a* of the dielectric 1323 to be fixed to the dielectric 1323. Accordingly, the internal conductor 1321 is fixed to the connector housing 1031 through the dielectric 1323 and the external conductor 1322.

The entire terminal body 3220 in the external conductor 1322 is formed in a hollow cylindrical shape, and includes a connecting portion 1322*a* with respect to the braid for shielding of the shield cable, and a fixing portion 1322*b* fixed to a terminal holding portion 1312 (see FIG. 16) of the connector housing 1031.

The spring portion 1327 provided in the external conductor 1322 extends from a base end 3220*a* of the terminal body 3220 disposed on the side of the case 1041A of the electronic device 1040A at a portion where the external conductor 1322 is electrically connected to the contact portion 1423*a* on the circuit board 1422.

As shown in FIG. 13, the spring portion 1327 extends from one end 3220*b* disposed in the vicinity of the contact portion 1423 of the base end 3220*a* of the terminal body 3220 in a plane (paper surface in FIG. 13) that extends along the axis of the terminal body 3220. Further, the spring portion 1327 includes an axially extending portion 1327*a* that extends in the axis direction (an arrow X6 direction in FIG. 13) of the terminal body 3220 from the one end 3220*b* of the base end 3220*a* of the terminal body 3220, a radially extending portion 1327*b* that extends from a tip of the axially extending portion 1327*a* in the above-mentioned plane in a radially outward direction (an arrow Y6 direction in FIG. 13) of the terminal body 3220, a flexible portion 1327*c* that extends in a tilted straight line shape that connects a tip of the radially extending portion 1327*b* and the contact portion 1423*a*, and a contact portion 1327*d* that protrudes from a tip of the flexible portion 1327*c* to come into contact with the contact portion 1423*a*. The flexible portion 1327*c* generates a contact pressure with respect to the contact portion 1423*a* due to flexible deformation in the axial direction (an arrow X7 direction in FIG. 13) of the terminal body 3220.

As shown in FIG. 12, the spring portion 1327 has a frame structure in which both ends of two flexible portions 1327*c* that extend in parallel are combined with a connecting piece 1327*e*. As shown in FIG. 10, the two flexible portions 1327*c* correspond to the two contact portions 1423*a* that are disposed on the circuit board 1422.

The spring portion 1327 may have a structure in which the axially extending portion 1327*a* and the radially extending portion 1327*b* are not provided. That is, the spring portion 1327 may include the flexible portion 1327*c* that extends in a tilted straight line shape that connects one end 3220*b* of the base end 3220*a* of the terminal body 3220 in the plane that extends along the axis of the terminal body 3220 to the contact portion 1423*a* and generates the contact pressure with respect to the contact portion 1423 due to flexible deformation in the axial direction of the terminal body 3220, and the contact portion 1327*d* that protrudes from the tip of the flexible portion 1327*c* to come into contact with the contact portion 1423*a*.

As indicated by an arrow P2 in FIGS. 12 and 13, the dielectric 1323 is inserted into the hollow portion of the external conductor 1322 to be fixed to the external conductor 1322, and thus, as shown in FIG. 14, the assembly is completed to obtain the terminal fitting 1032A. The terminal fitting 1032A is press-fitted into the terminal holding portion 1312 of the connector housing 1031 to be fixed to the connector housing 1031, as shown in FIGS. 15 and 16, so that the electronic device connector 1030A is obtained.

When the connector housing 1031 (that is, the electronic device connector 1030A) to which the terminal fitting 1032A is assembled is assembled to the one end 1411 of the case 1041A of the electronic device 1040A, as shown in FIGS. 16 and 17, the contact portions 1326*d* and 1327*d* of the spring portion 1326 and the spring portion 1327 come into contact with the contact portions 1423*a* and 1423*b* to generate deformation in the flexible portions 1326*c* and 1327*c*. A state where the contact portions 1326*d* and 1327*d* are in contact with the contact portions 1423*a* and 1423*b* is maintained by elastic restoring forces due to the deflection of the flexible portions 1326*c* and 1327*c*, and thus, a state where the internal conductor 1321 and the external conductor 1322 are electrically connected to the contact portion 1423 is obtained.

According to the configuration of the electronic device connector 1030A of the above-described second exemplary embodiment, in the spring portions 1326 and 1327 of the internal conductor 1321 and the external conductor 1322 that are in elastic contact with the contact portion 1423 of the electronic device 1040A, the flexible portion 1326*c* that is deformed when being in contact with the contact portion 1423 of the electronic device 1040A is formed in the straight line shape. Accordingly, for example, it is not necessary to perform a bending process for a large angle that exceeds 90 degrees in forming a V shape or U shape for which processing is difficult, and thus, it is possible to achieve easy processing and high accuracy manufacturing. Thus, it is possible to improve contact reliability with high accuracy. Further, since the processing is easy, it is possible to reduce the cost and to enhance productivity.

Further, according to the configuration of the electronic device connector 1030A of the above-described second exemplary embodiment, the external conductor 1322 includes the two contact portions 1327*d*. When the internal conductor 1321 is used as a signal terminal and the external conductor 1322 is used as a ground terminal, it is possible to reduce unnecessary radiation of electromagnetic waves generated when a signal passes through the internal conductor 1321, compared with an electronic device connector 1030B in which the contact portion 1327*d* includes one external conductor 1322, as in a third exemplary embodiment described below. This is because two spring portions 1327 of the external conductor 1322 are symmetrically positioned on opposite sides of the spring portion 1326 of the internal conductor 1321.

The spring portion 1327 of the external conductor 1322 is not limited to the frame structure shown in the present exemplary embodiment, and may have a simple structure in which one flexible portion 1327*c* simply extends.

Third Exemplary Embodiment

Figure 18:
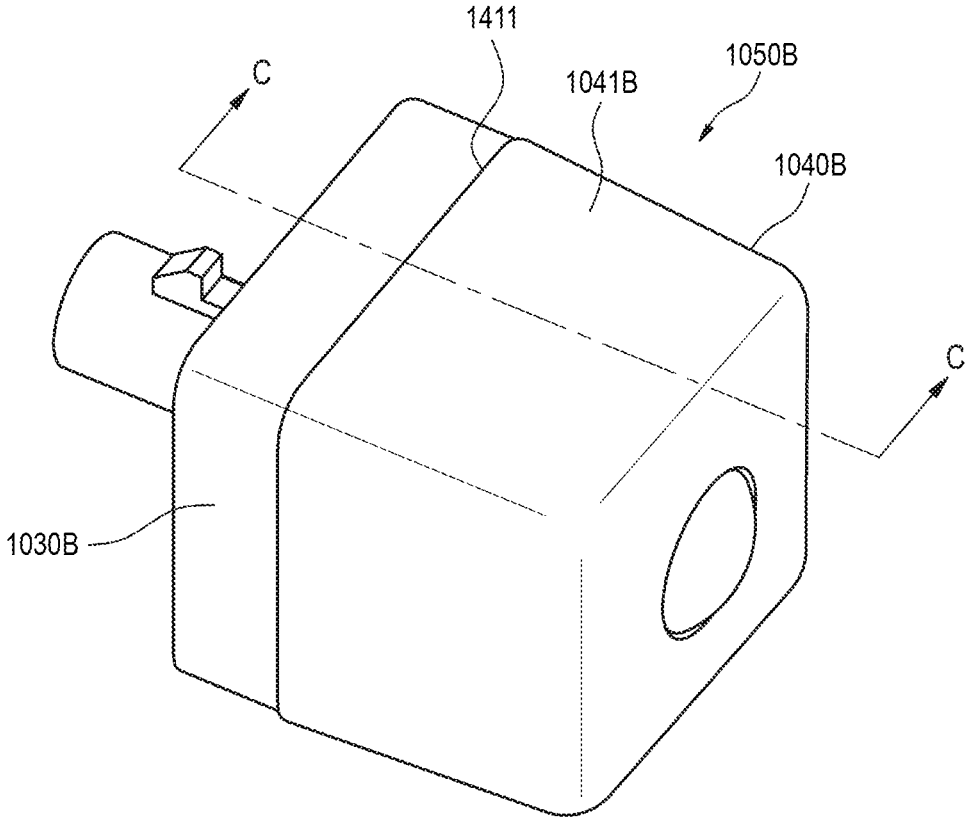
FIG. 18 is a perspective view of a camera module in a state where an electronic device connector according to a third exemplary embodiment of the invention is combined with an on-vehicle camera.
Figure 19:
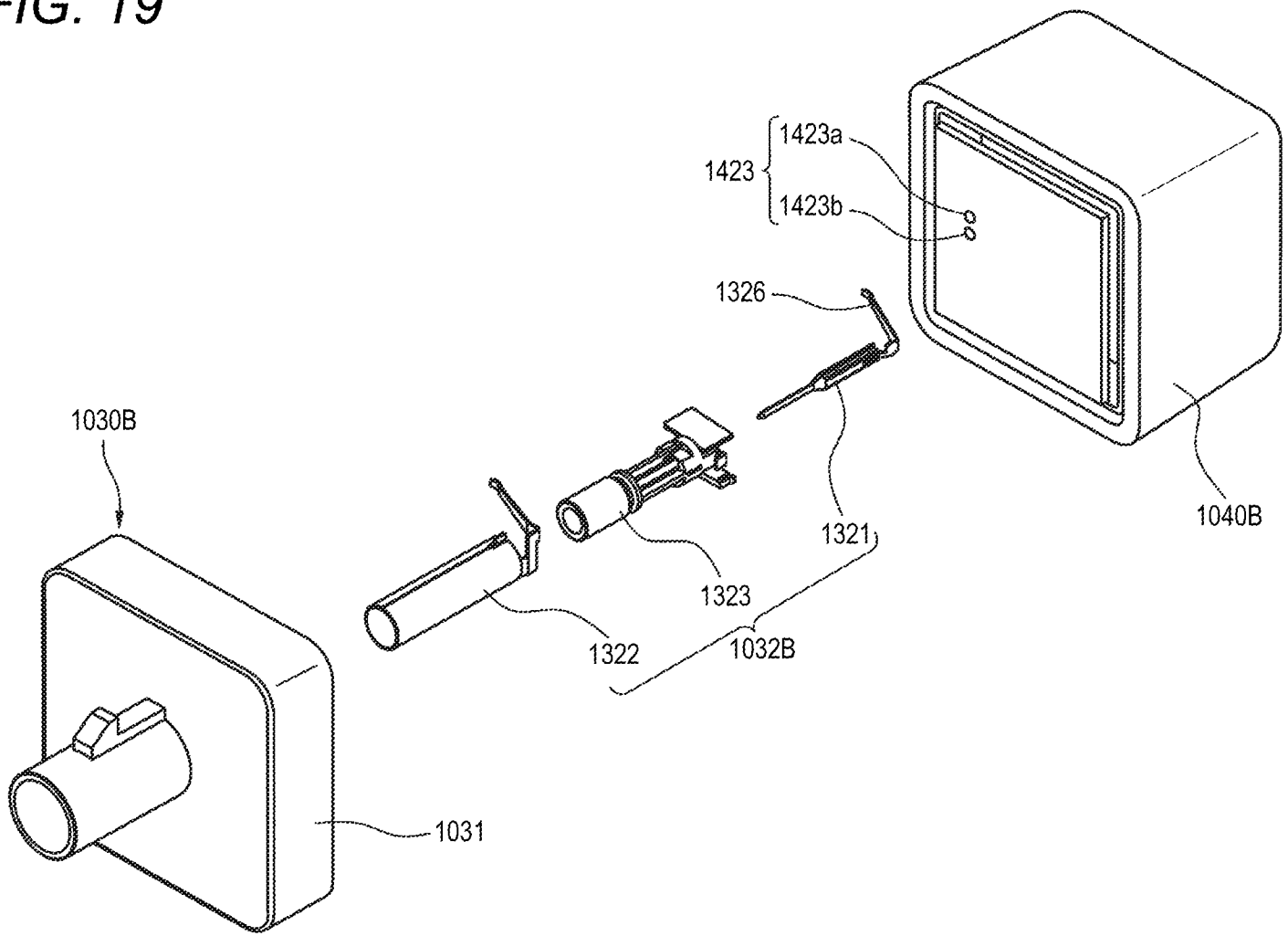
FIG. 19 is an exploded perspective view of the camera module shown in FIG. 18.
Figure 20:
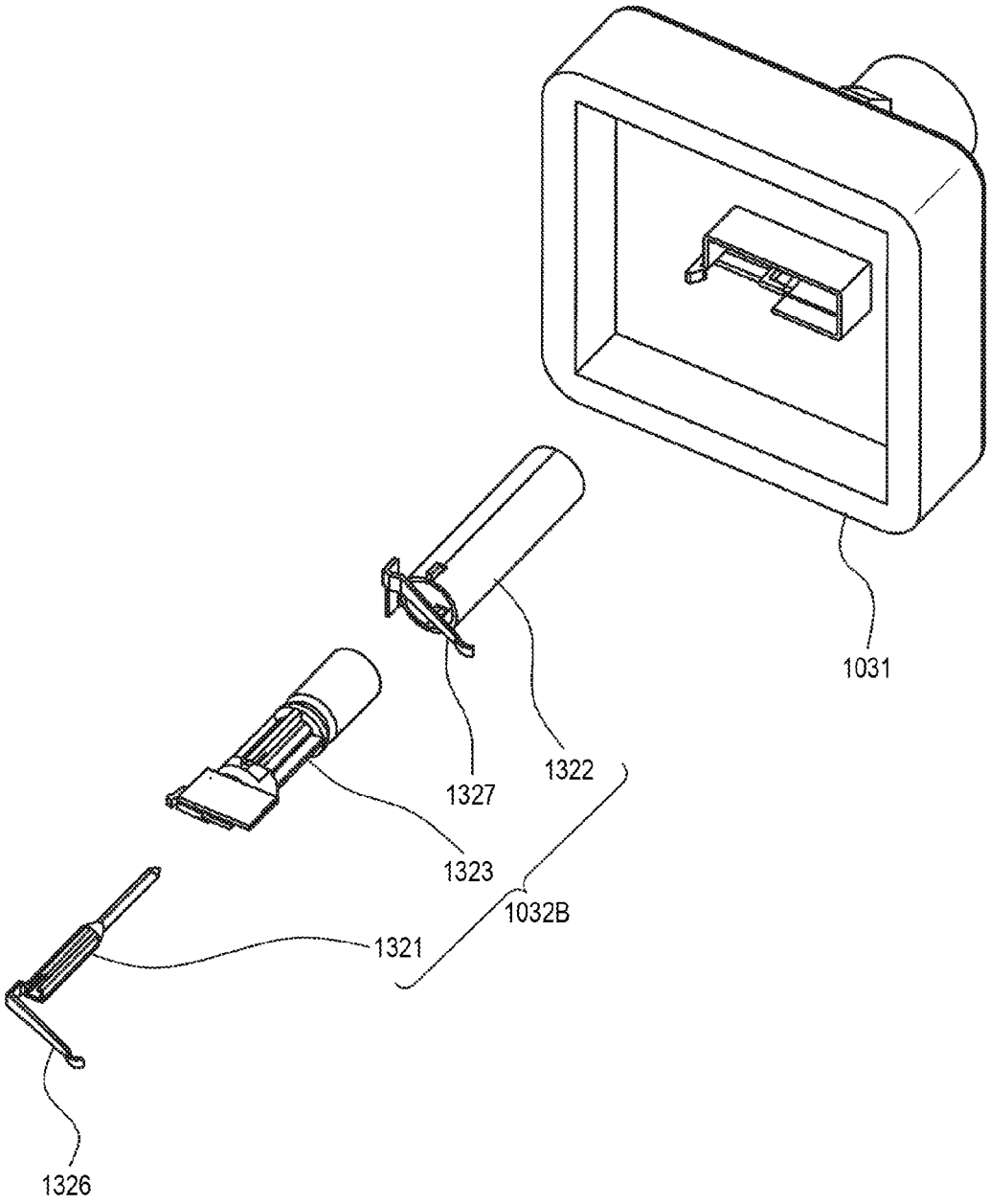
FIG. 20 is an exploded perspective view of the electronic device connector according to the third exemplary embodiment of the invention, when seen from a rear surface side thereof.
Figure 21:
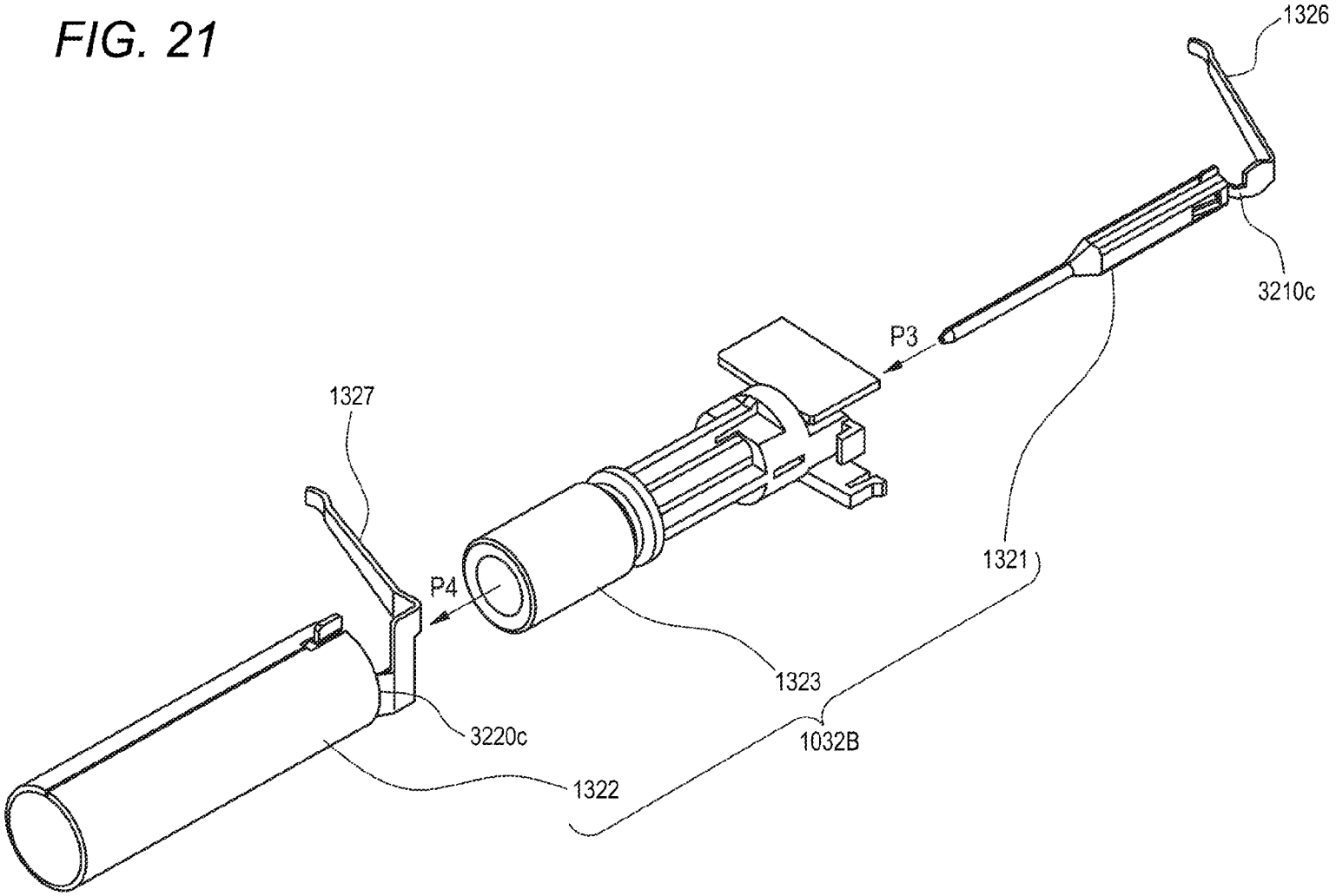
FIG. 21 is an enlarged exploded perspective view of a terminal fitting in the electronic device connector according to the third exemplary embodiment of the invention.
Figure 22:
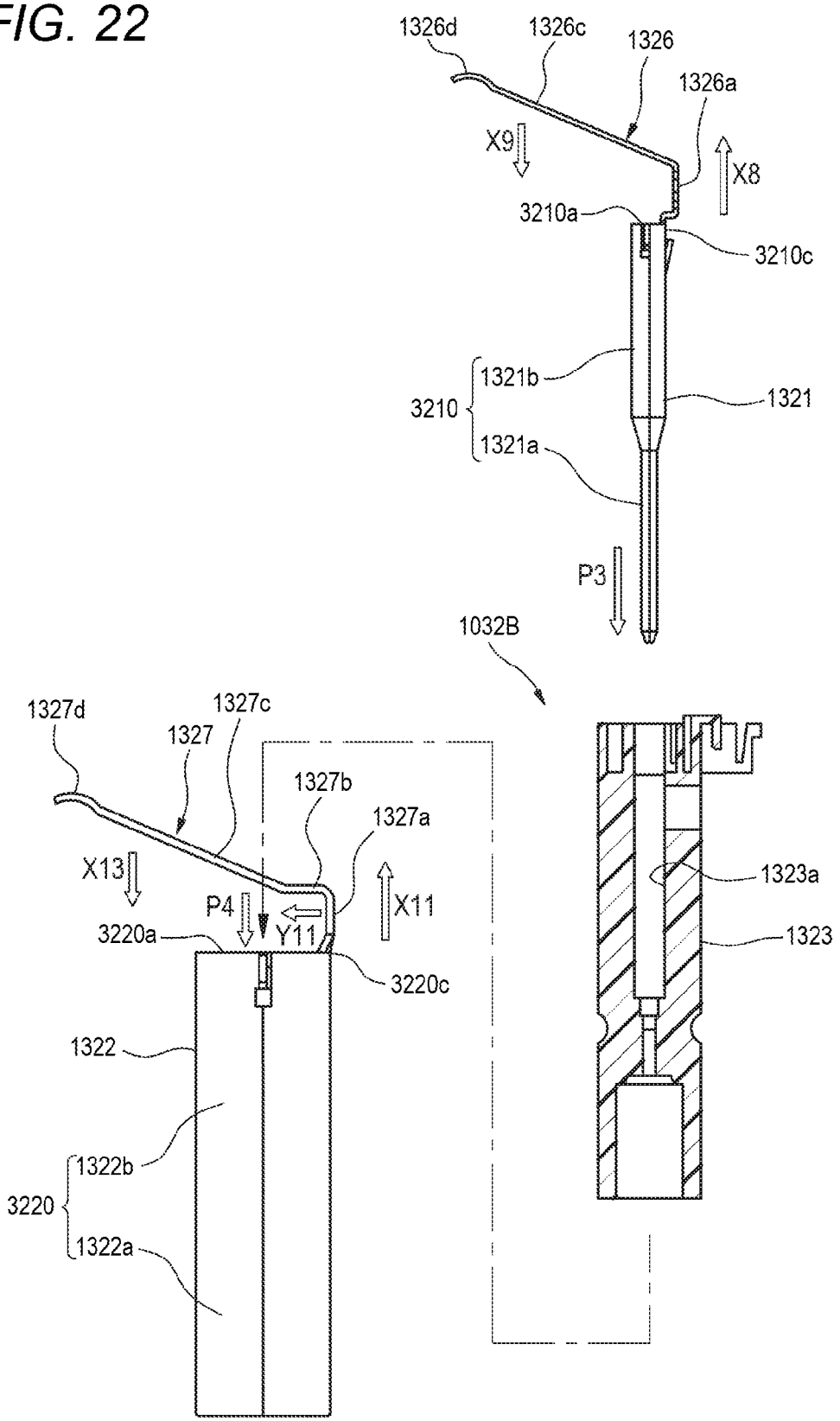
FIG. 22 is a plan view of each component of the terminal fitting shown in FIG. 21.
Figure 23:
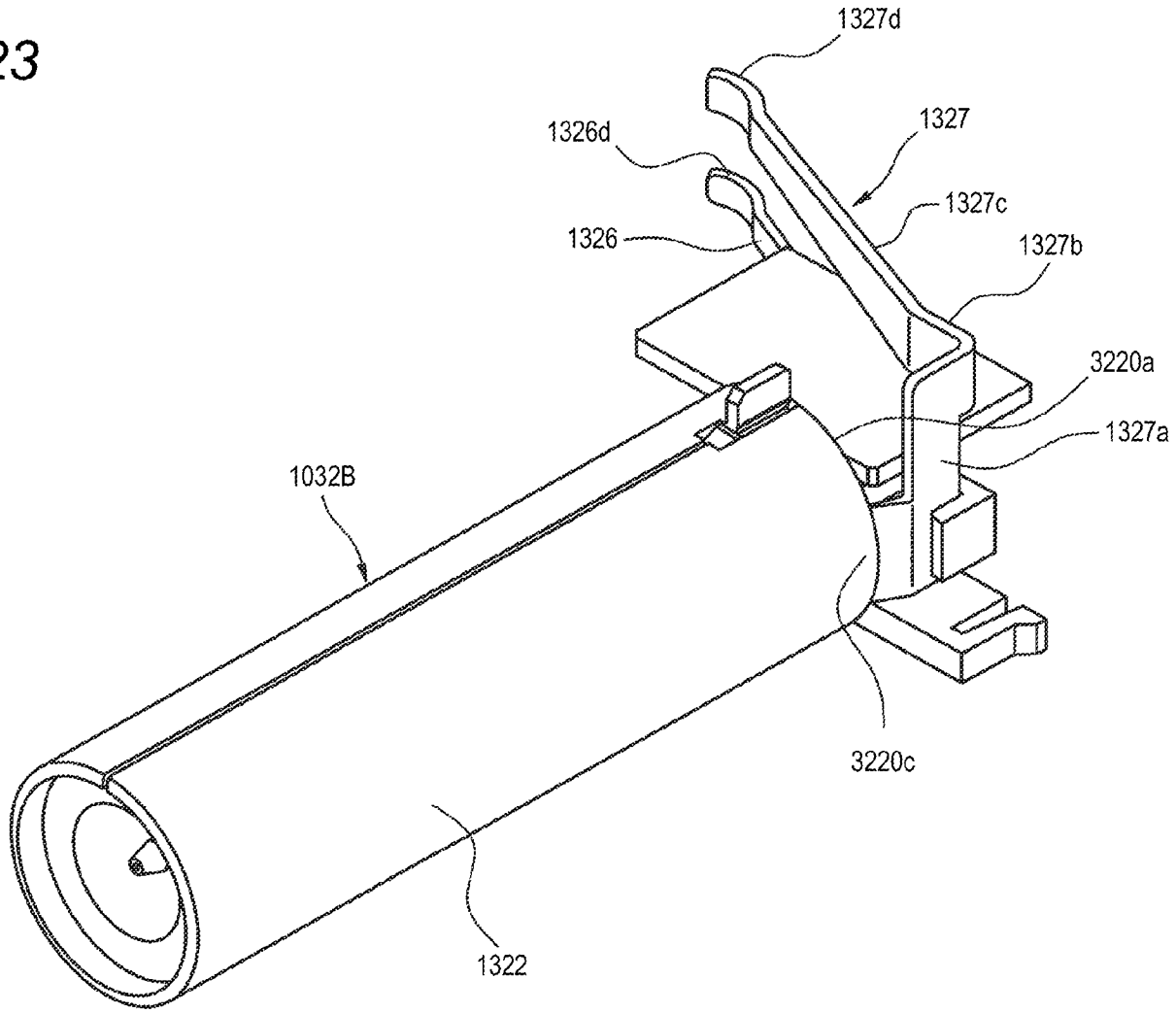
FIG. 23 is a perspective view of an assembly state of the terminal fitting shown in FIG. 21.
Figure 24:
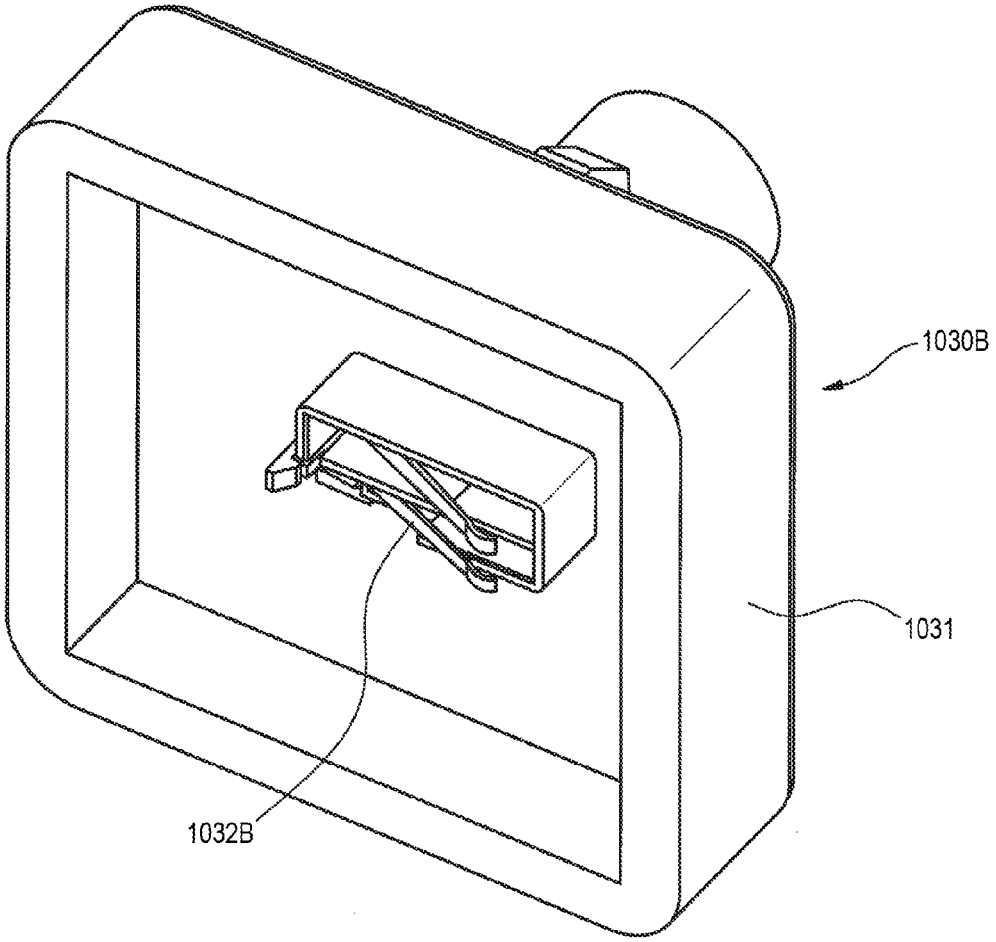
FIG. 24 is a perspective view of the electronic device connector according to the third exemplary embodiment of the invention, when seen from a rear surface side thereof.
Figure 25:
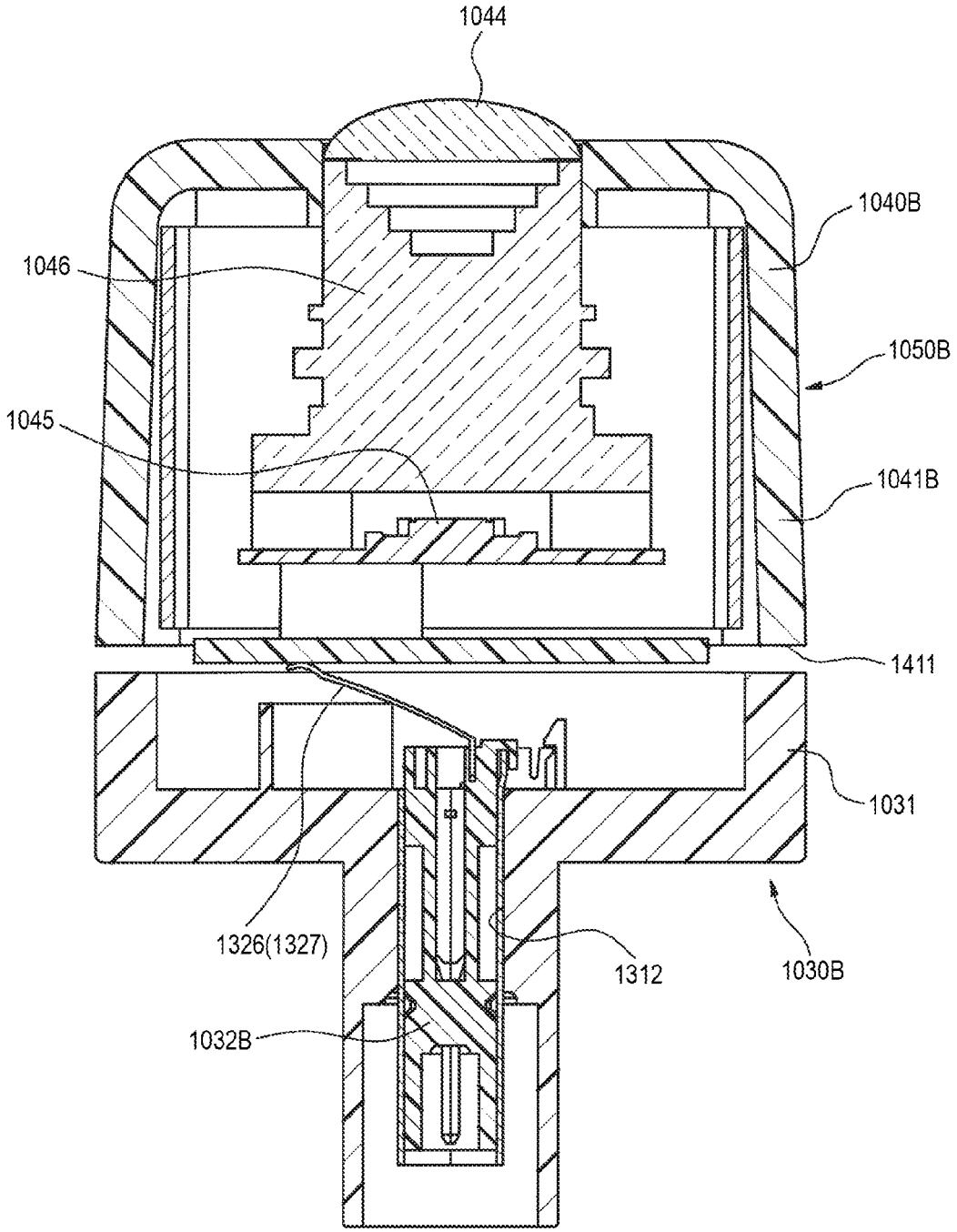
FIG. 25 is a longitudinal sectional view illustrating a state before the electronic device connector according to the third exemplary embodiment of the invention is combined with the on-vehicle camera.
Figure 26:
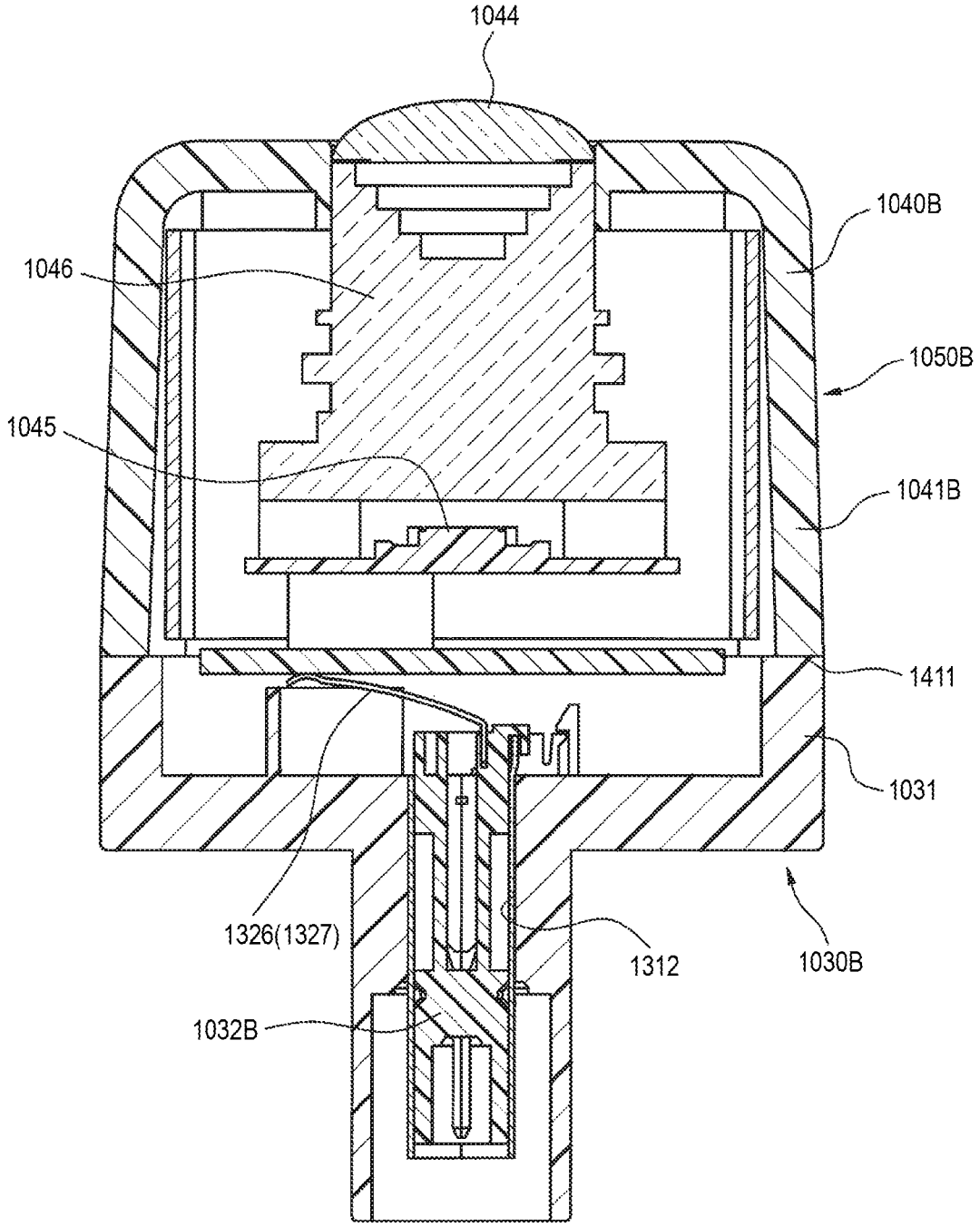
FIG. 26 is a longitudinal sectional view illustrating a state where the electronic device connector according to the third exemplary embodiment of the invention is combined with the on-vehicle camera, taken along line C-C in FIG. 18.

FIGS. 18 to 26 illustrate an electronic device connector according to a third exemplary embodiment of the invention, in which FIG. 18 is a perspective view of a camera module in a state where an electronic device connector according to the third exemplary embodiment of the invention is combined with an on-vehicle camera, FIG. 19 is an exploded perspective view of the camera module shown in FIG. 18, FIG. 20 is an exploded perspective view of the electronic device connector according to the third exemplary embodiment of the invention, when seen from a rear surface side thereof, FIG. 21 is an enlarged exploded perspective view of a terminal fitting in the electronic device connector according to the third exemplary embodiment of the invention, FIG. 22 is a plan view of each component of the terminal fitting shown in FIG. 21, FIG. 23 is a perspective view of an assembly state of the terminal fitting shown in FIG. 21, FIG. 24 is a perspective view of the electronic device connector according to the third exemplary embodiment of the invention, when seen from a rear surface side thereof, FIG. 25 is a longitudinal sectional view illustrating a state before the electronic device connector according to the third exemplary embodiment of the invention is combined with the on-vehicle camera, and FIG. 26 is a longitudinal sectional view illustrating a state where the electronic device connector according to the third exemplary embodiment of the invention is combined with the on-vehicle camera, taken along line C-C in FIG. 18.

A camera module 1050B shown in FIG. 18 has a configuration in which an electronic device connector 1030B according to the third exemplary embodiment of the invention is assembled to one end 1411 of a case 1041B of an electronic device 1040B which is an on-vehicle camera.

The electronic device connector 1030B of the third exemplary embodiment has a configuration in which the extending position of the spring portion 1326 in the internal conductor 1321 of the electronic device connector 1030A and the extending position of the spring portion 1327 in the external conductor 1322 according to the second exemplary embodiment are changed.

In the electronic device connector 1030B of the third exemplary embodiment, as shown in FIGS. 21 and 22, similar to the terminal fitting 1032A of the second exemplary embodiment, a terminal fitting 1032B provided in the connector housing 1031 includes the internal conductor 1321, the external conductor 1322 that is disposed around the internal conductor 1321, and the dielectric 1323 that is disposed between the internal conductor 1321 and the external conductor 1322 on the same axis. Further, the internal conductor 1321 and the external conductor 1322 are independent terminal fittings, and are integrally provided with the spring portions 1326 and 1327 capable of being elastically deformed in contact with the contact portion 1423 of the electronic device 1040B.

Here, the spring portion 1326 provided in the internal conductor 1321 in the electronic device connector 1030B of the third exemplary embodiment extends from one end 3210*c* of the base end 3210*a* of the terminal body 3210 positioned on a side separated from the contact portion 1423 in a plane (in FIG. 22, paper surface) that extends along the axis of the terminal body 3210, as shown in FIG. 22. That is, the spring portion 1326 of the third exemplary embodiment extends from the end opposite to the end 3210*b* from which the spring portion 1326 extends in the second exemplary embodiment. Accordingly, the extending position of the spring portion 1326 of the third exemplary embodiment is separated from the contact portion 1423 by a distance corresponding to the diameter of the terminal body 3210, compared with the extending position of the spring portion 1326 in the second exemplary embodiment.

Further, the spring portion 1326 of the third exemplary embodiment includes an axially extending portion 1326*a* that extends in the axis direction (an arrow X8 direction in FIG. 22) of the terminal body 3210 from one end 3210*c* of the base end 3210*a* of the terminal body 3210, a flexible portion 1326*c* that extends in a tilted straight line shape that is directed from a tip of the axially extending portion 1326*a* toward the contact portion 1423*b*, and a contact portion 1326*d* that protrudes from a tip of the flexible portion 1326*c* and comes into contact with the contact portion 1423*b*. The flexible portion 1326*c* generates a contact pressure with respect to the contact portion 1423*b* due to flexible deformation in the axial direction (an arrow X9 direction in FIG. 22) of the terminal body 3210.

The spring portion 1326 may have a structure in which the axially extending portion 1326*a* is not provided. That is, the spring portion 1326 may include the flexible portion 1326*c* that extends in the tilted straight line shape that connects one end 3210*c* of the base end 3210*a* of the terminal body 3210 distantly separated from the contact portion 1423 to the contact portion 1423*b* in the plane that extends along the axis of the terminal body 3210, and generates the contact pressure with respect to the contact portion 1423 due to flexible deformation in the axial direction of the terminal body 3210, and the contact portion 1326*d* that protrudes from the tip of the flexible portion 1326*c* to come into contact with the contact portion 1423.

As indicated by an arrow P3 in FIGS. 21 and 22, the internal conductor 1321 is inserted into the terminal fixing hole 1323*a* of the dielectric 1323 to be fixed to the dielectric 1323. Accordingly, the internal conductor 1321 is fixed to the connector housing 1031 through the dielectric 1323 and the external conductor 1322 (which will be described later).

Further, as shown in FIG. 22, the spring portion 1327 provided in the external conductor 1322 of the third exemplary embodiment extends from one end 3220*c* of the base end 3220*a* of the terminal body 3220 of the base end 3220*a* of the terminal body 3220 disposed on a side separated from the contact portion 1423 in a plane (paper surface in FIG. 22) that extends along the axis of the terminal body 3220. That is, the spring portion 1327 of the third exemplary embodiment extends from one end opposite to one end 3220*b* from which the spring portion 1327 extends in the second exemplary embodiment.

That is, the spring portion 1327 of the third exemplary embodiment extends from the end opposite to one end 3220*b* from which the spring portion 1327 extends in the second exemplary embodiment. Accordingly, the extending position of the spring portion 1327 of the third exemplary embodiment is separated from the contact portion 1423 by a distance corresponding to the diameter of the terminal body 3220, compared with the extending position of the spring portion 1327 in the second exemplary embodiment.

Further, the spring portion 1327 of the third exemplary embodiment includes an axially extending portion 1327*a* that extends in the axis direction (an arrow X11 direction in FIG. 22) of the terminal body 3220 from one end 3220*c* of the base end 3220*a* of the terminal body 3220, a radially extending portion 1327*b* that extends from a tip of the axially extending portion 1327*a* in the above-mentioned plane in a radially outward direction (an arrow Y11 direction in FIG. 22) of the terminal body 3220, a flexible portion 1327*c* that extends in a tilted straight line shape that connects a tip of the radially extending portion 1327*b* and the contact portion 1423*a*, and a contact portion 1327*d* that protrudes towards a tip of the flexible portion 1327*c* to come into contact with the contact portion 1423*a*. The flexible portion 1327*c* generates a contact pressure with respect to the contact portion 1423*a* due to flexible deformation in the axial direction (an arrow X13 direction in FIG. 22) of the terminal body 3220.

As indicated by an arrow P4 in FIGS. 21 and 22, the dielectric 1323 is inserted into the hollow portion of the external conductor 1322 of the third embodiment to be fixed to the external conductor 1322, and thus, as shown in FIG. 23, the assembly is completed to obtain the terminal fitting 1032B. The assembled terminal fitting 1032B is press-fitted into the terminal holding portion 1312 of the connector housing 1031 to be fixed to the connector housing 1031, as shown in FIGS. 24 and 25, so that the electronic device connector 1030B is obtained.

When the connector housing 1031 (that is, the electronic device connector 1030B) to which the terminal fitting 1032B is assembled is assembled to the one end 1411 of the case 1041A of the electronic device 1040A, as shown in FIGS. 25 and 26, the contact portions 1326*d* and 1327*d* of the spring portion 1326 and the spring portion 1327 come into contact with the contact portions 1423*a* and 1423*b* to generate deformation in the flexible portions 1326*c* and 1327*c*. A state where the contact portions 1326*d* and 1327*d* are in contact with the contact portions 1423*a* and 1423*b* is maintained by elastic restoring forces due to the deformation of the flexible portions 1326*c* and 1327*c*, and thus, a state where the internal conductor 1321 and the external conductor 1322 are electrically connected to the contact portion 1423 is obtained.

According to the configuration of the electronic device connector 1030B of the above-described third exemplary embodiment, it is possible to achieve the following effects in addition to the effects of the electronic device connector 1030A of the second exemplary embodiment. That is, in the electronic device connector 1030B of the third exemplary embodiment, since the flexible portions 1326*c* and 1327*c* extend from the ends 3210*c* and 3220*c* of the base ends 3210*a* and 3220*a* of the terminal bodies 3210 and 3220 that are disposed on the side separated from the contact portion 1423 of the electronic device 1040B, compared with the second exemplary embodiment in which the flexible portions 1326*c* and 1327*c* extend from the ends 3210*b* and 3220*b* of the base ends 3210*a* and 3220*a* of the terminal bodies 3210 and 3220 that are disposed on the side close to the contact portion 1423, it is possible to secure longer lengths in the flexible portions 1326*c* and 1327*c*. Thus, it is possible to reduce fluctuation in the contact pressure when the flexible portions 1326*c* and 1327*c* are deformed by a predetermined amount in the axial direction of the terminal bodies 3210 and 3220 due to the contact of the spring portions 1326 and 1327 with the contact portion 1423, and thus, it is possible to maintain a more stable contact pressure, and to enhance reliability of an electrical connection.

Fourth Exemplary Embodiment

Figure 27:
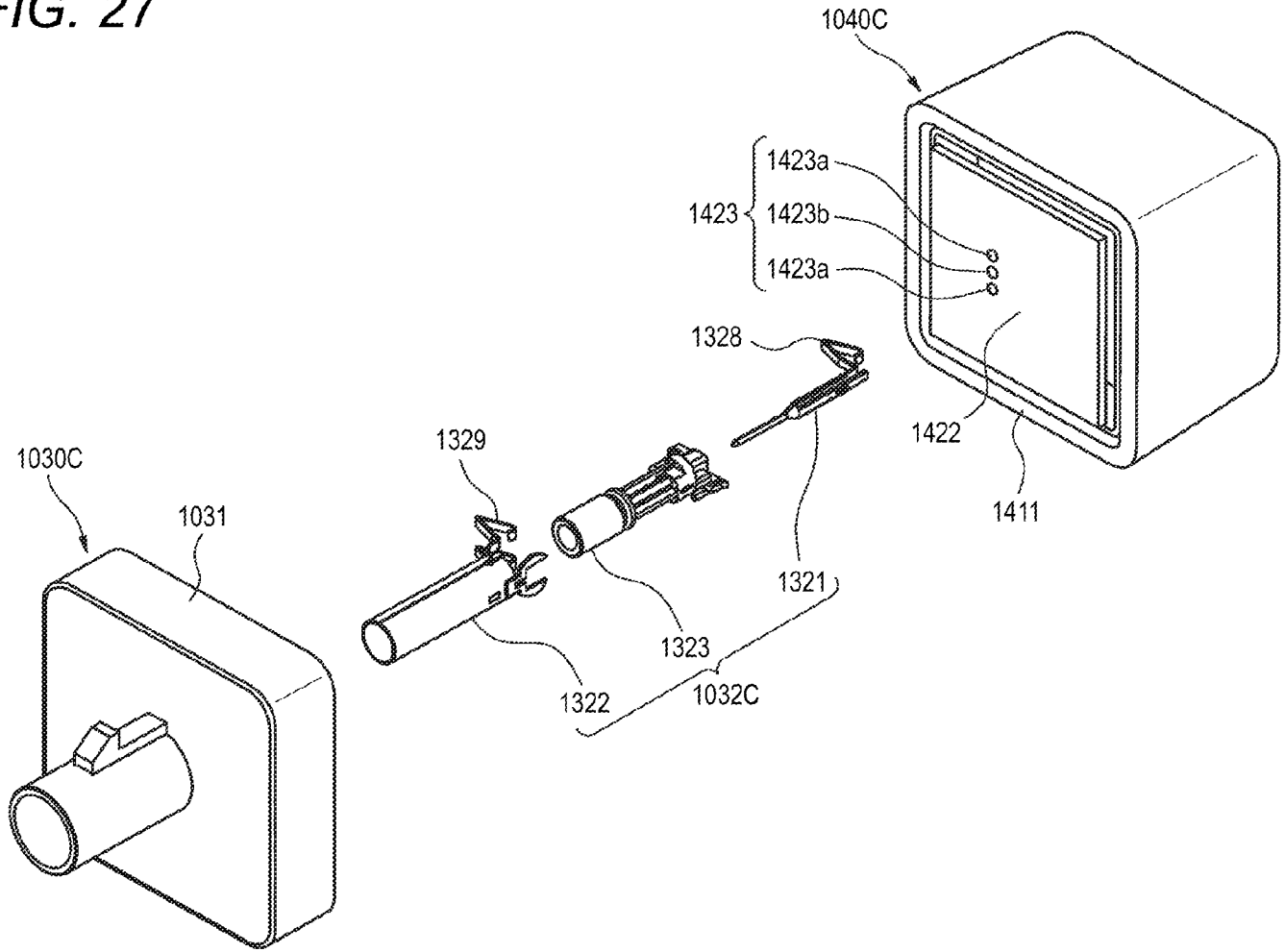
FIG. 27 is an exploded perspective view of a camera module that includes an electronic device connector according to a fourth exemplary embodiment of the invention.
Figure 28:
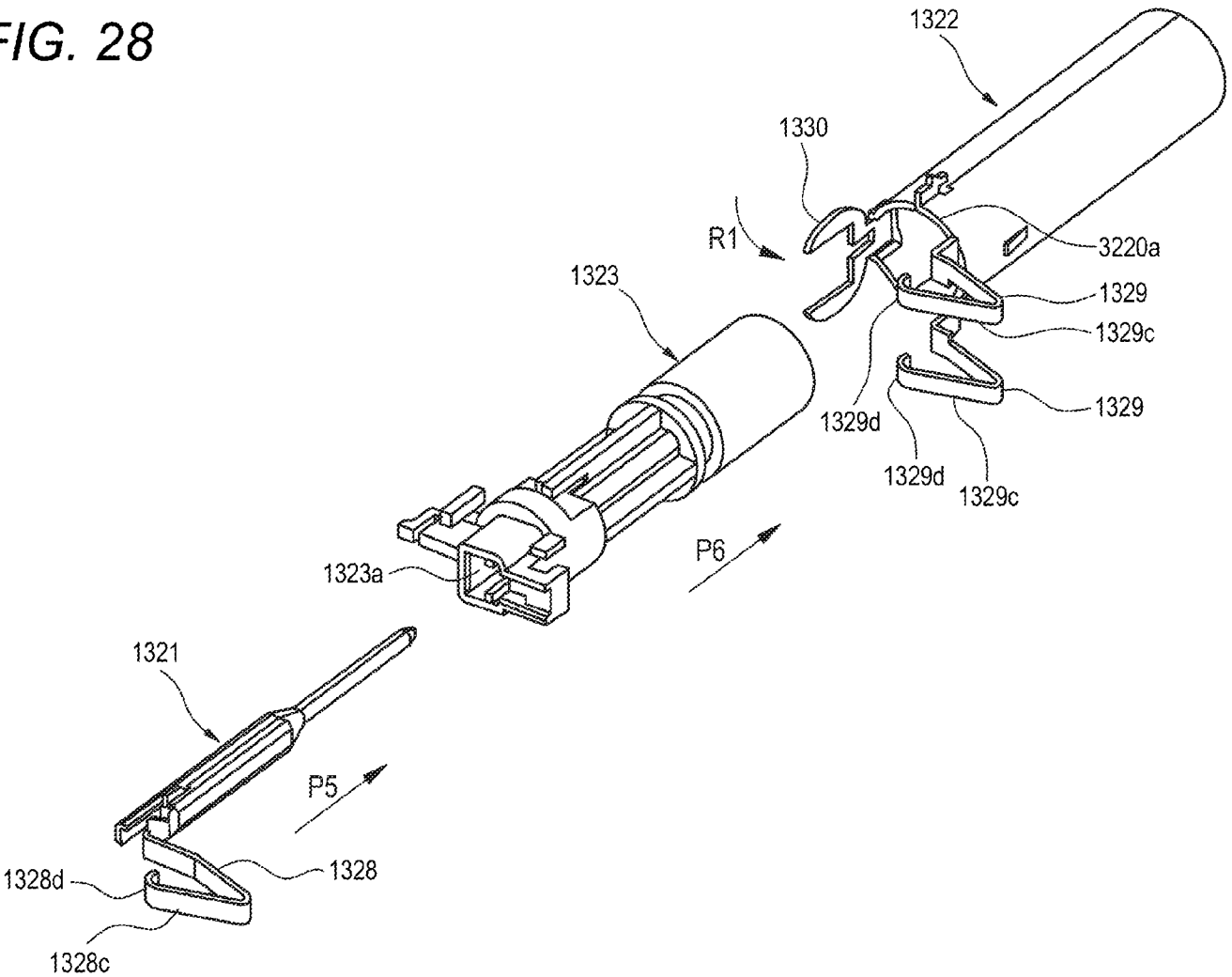
FIG. 28 is an exploded perspective view of the electronic device connector according to the fourth exemplary embodiment of the invention, when seen from a rear surface side thereof.
Figure 29:
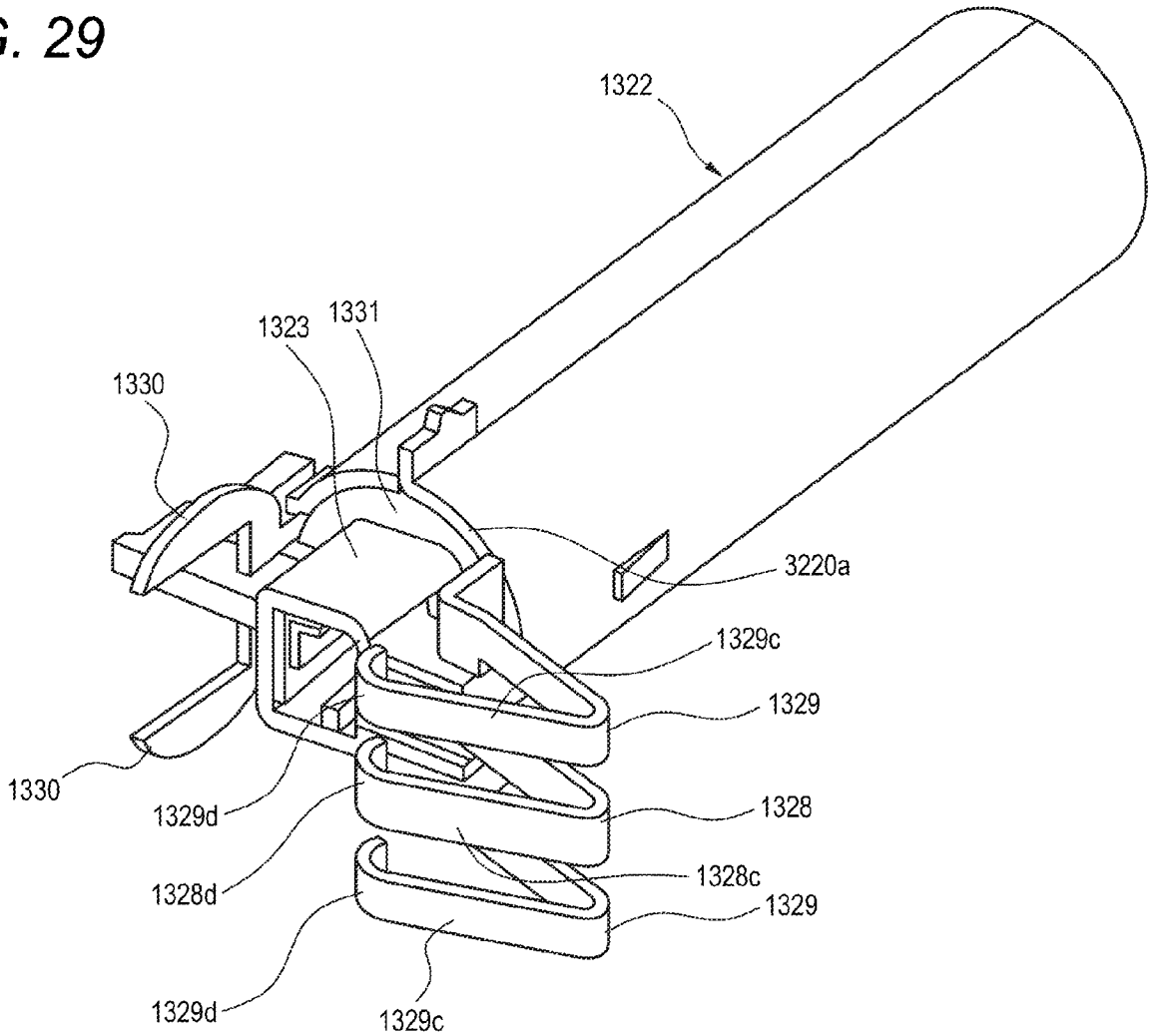
FIG. 29 is a perspective view before a shielding portion is bent in an assembly state of a terminal fitting in the electronic device connector according to the fourth exemplary embodiment of the invention.
Figure 30:
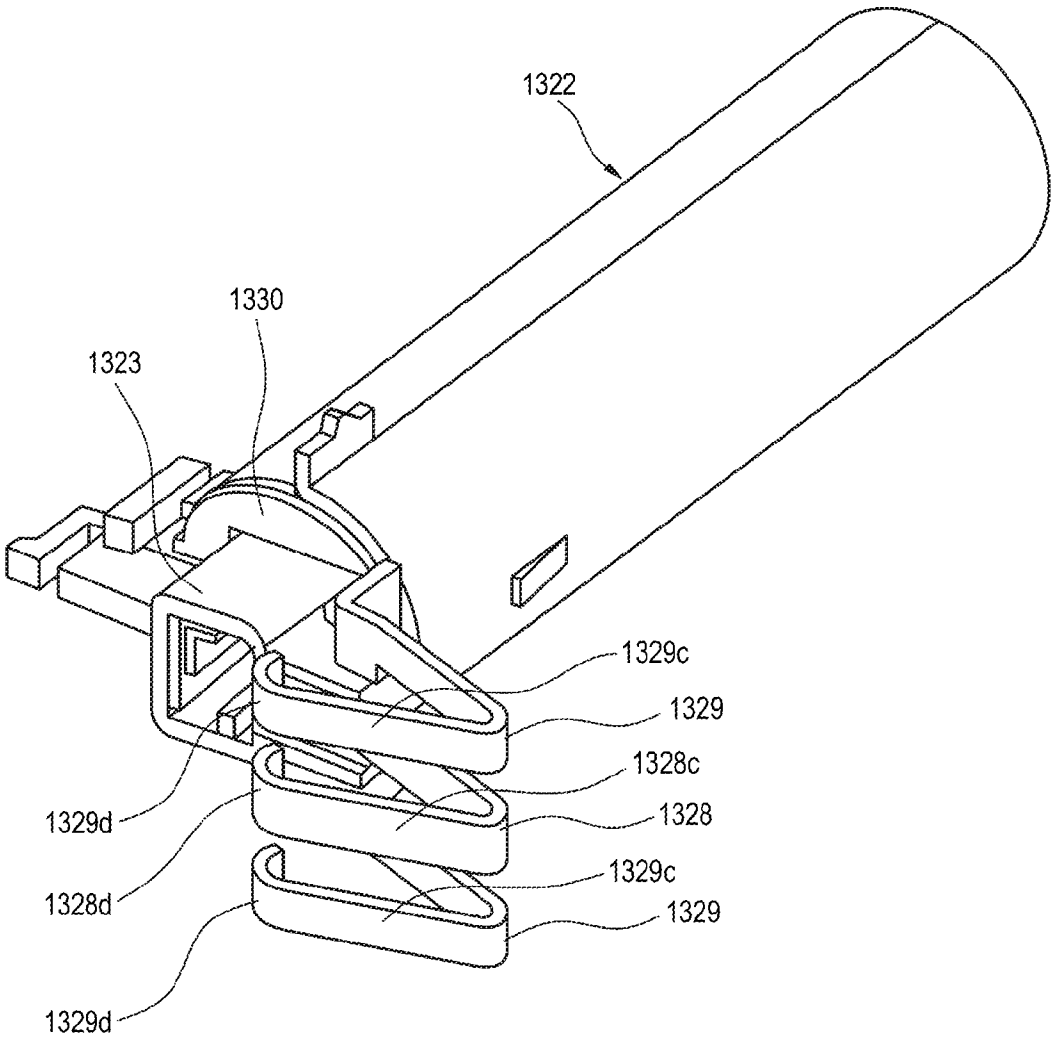
FIG. 30 is a perspective view after the shielding portion is bent in the assembly state of the terminal fitting.
Figure 31:
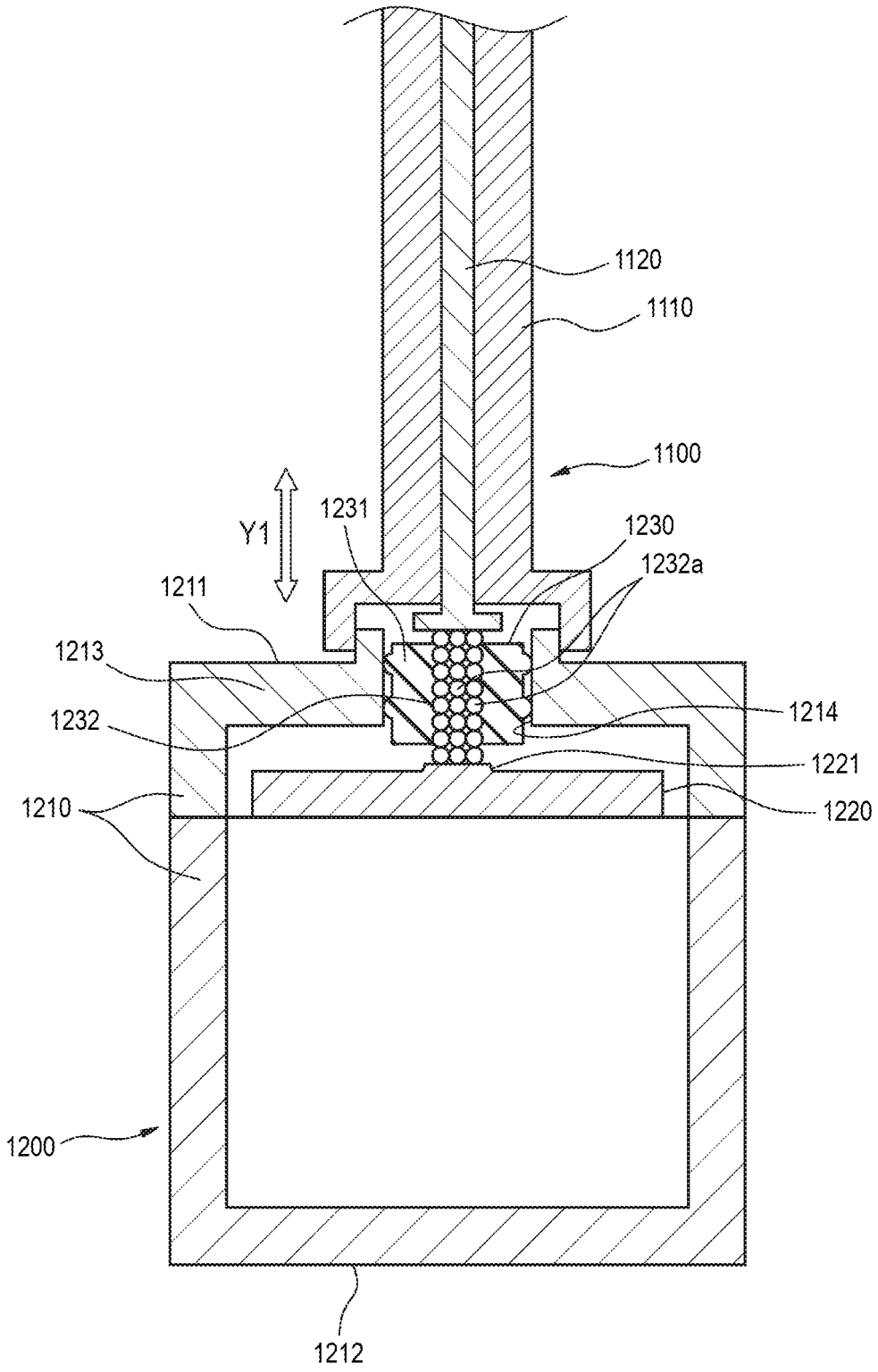
FIG. 31 is a longitudinal sectional view of an electronic device connector in the related art.
Figure 32:
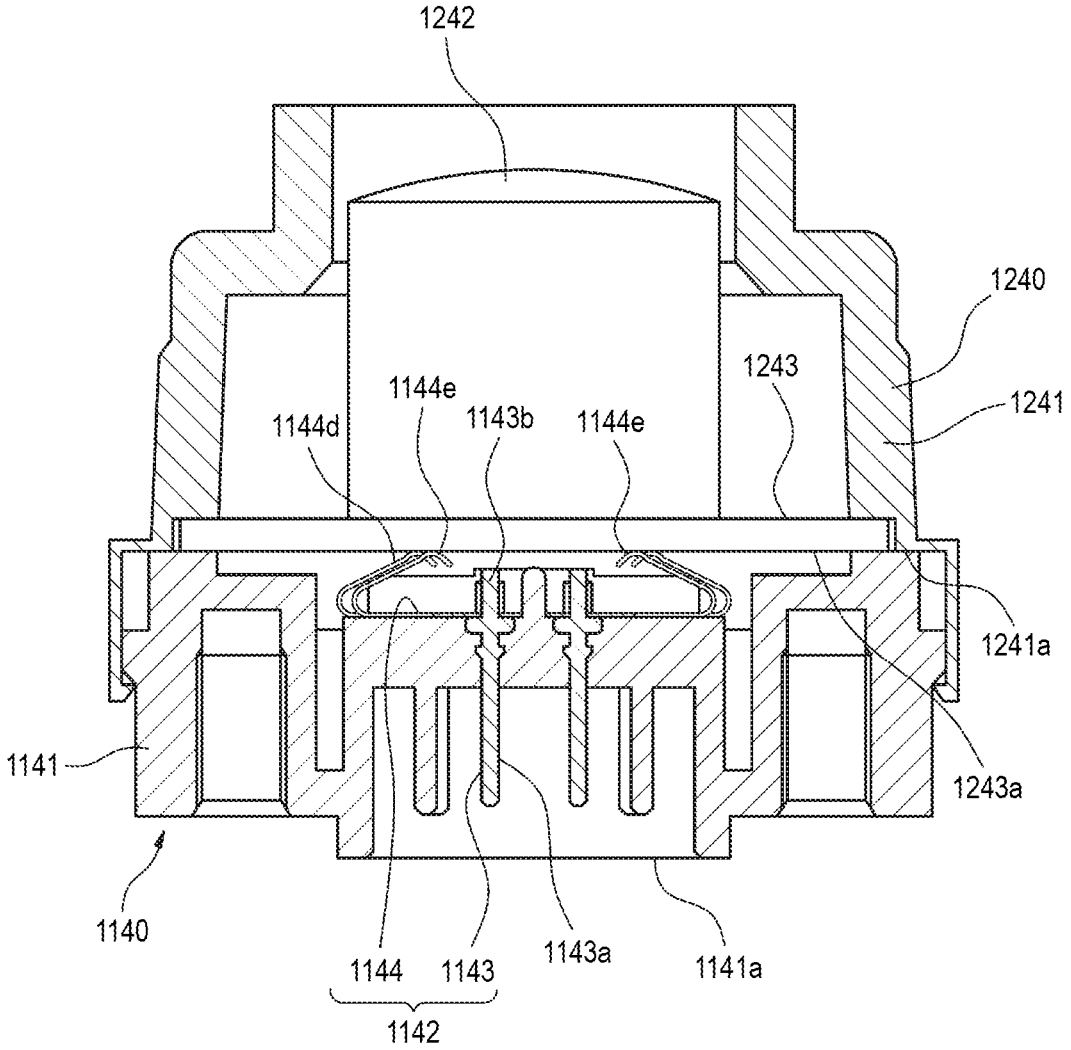
FIG. 32 is a longitudinal sectional view of another electronic device connector in the related art.
Figure 33:
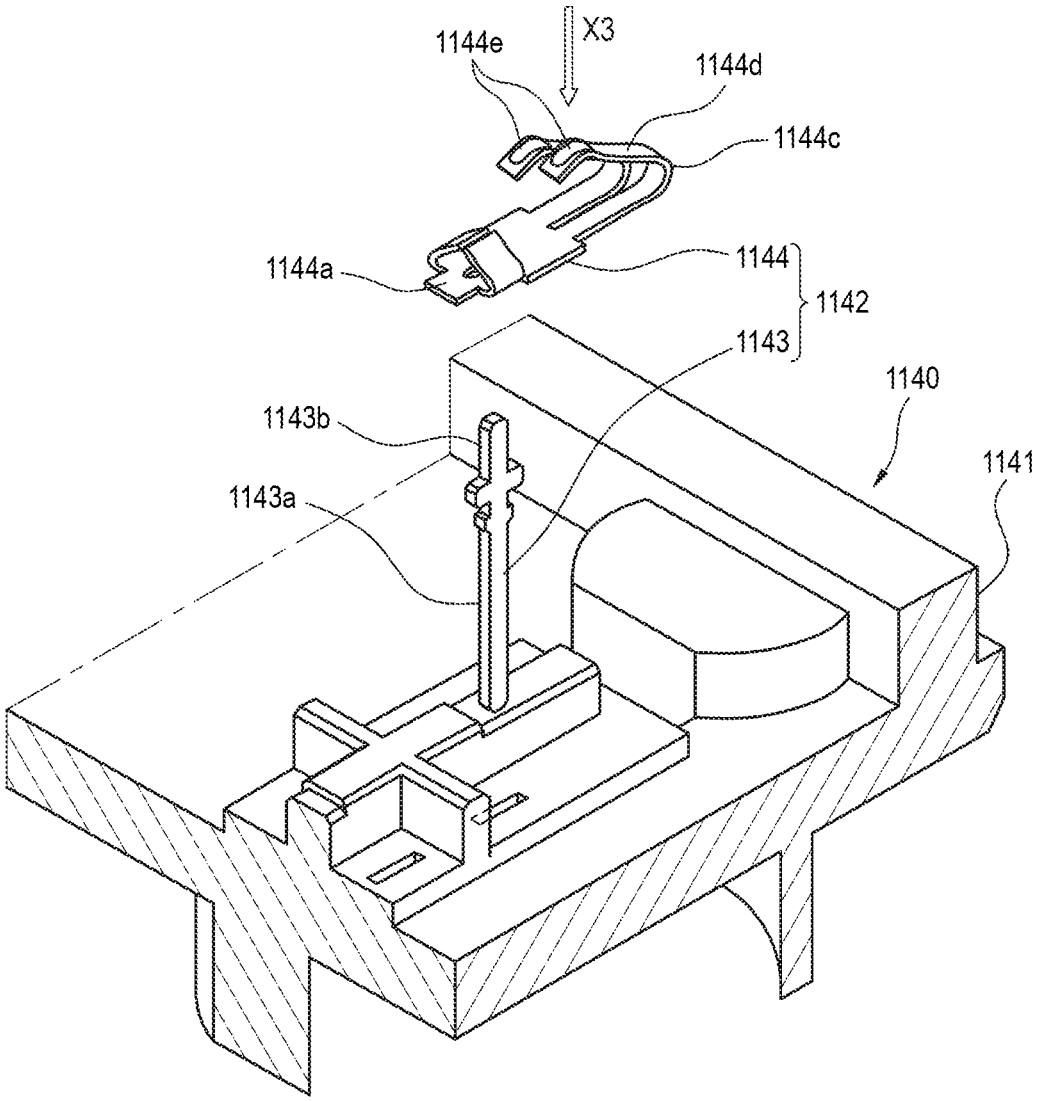
FIG. 33 is a perspective view illustrating a configuration of the terminal fitting of the electronic device connector shown in FIG. 32.

FIGS. 27 to 30 illustrate an electronic device connector according to a fourth exemplary embodiment of the invention, in which FIG. 27 is an exploded perspective view of a camera module that includes the electronic device connector according to the fourth exemplary embodiment of the invention, FIG. 28 is an exploded perspective view of the electronic device connector according to the fourth exemplary embodiment of the invention, when seen from a rear surface side thereof, FIG. 29 is a perspective view before a shielding portion is bent in an assembly state of a terminal fitting in the electronic device connector according to the fourth exemplary embodiment of the invention, and FIG. 30 is a perspective view after the shielding portion is bent in the assembly state of the terminal fitting.

An electronic device connector 1030C of the fourth exemplary embodiment includes a terminal fitting 1032C instead of the terminal fitting 1032 in the electronic device connector 1030A of the second exemplary embodiment, and has a configuration in which a shielding portion 1330 is integrally formed with one end of the base end 3220*a* of the terminal body 3220. Other configurations except for this configuration are the same as those of the second exemplary embodiment.

In the electronic device connector 1030C and an electronic device 1040C of the fourth exemplary embodiment, the same reference numerals as in the third exemplary embodiment are given to the same components as in the electronic device connector 1030B and the electronic device 1040C of the third exemplary embodiment, and a description thereof will not be repeated, or will be simplified.

The internal conductor 1321 of the present exemplary embodiment includes one spring portion 1328. A flexible portion 1328*c* of the spring portion 1328 is bent in a "<" shape toward the terminal body 3210. The internal conductor 1321 is provided with a contact portion 1328*d* on an outer surface of the bent flexible portion 1328*c*.

The external conductor 1322 of the present exemplary embodiment includes a pair of spring portions 1329 at one end of the base end 3220*a* of the terminal body 3220. A flexible portion 1329*c* of the pair of the spring portions 1329 is bent in a "<" shape toward the terminal body 3220. The external conductor 1322 includes a contact portion 1329*d* on an outer surface of the bent flexible portion 1329*c*.

The flexible portion 1328*c* of the spring portion 1328 of the internal conductor 1321 is disposed between the flexible portions 1329*c* of the pair of spring portions 1329 of the external conductor 1322 in an assembled state.

As indicated by an arrow P5 in FIG. 28, the internal conductor 1321 is inserted into the terminal fixing hole 1323*a* of the dielectric 1323 to be fixed to the dielectric 1323. Accordingly, the internal conductor 1321 is fixed to the connector housing 1031 through the dielectric 1323 and the external conductor 1322.

As indicated by an arrow P6 in FIG. 28, the dielectric 1323 is inserted into the hollow portion of the external conductor 1322 to be fixed to the external conductor 1322, and thus, as shown in FIG. 29, the assembly is completed.

Further, the external conductor 1322 includes the shielding portion 1330 at the end opposite to the pair of spring portions 1329 in the base end 3220*a* of the terminal body 3220. Further, the shielding portion 1330 shields an opening 1331 formed in the base end 3220*a* of the external conductor 1322 in the assembled terminal to improve external noise blocking performance. The shielding portion 1330 has a tuning-fork shape, and shields a pair of upper and lower openings 1331 (only the upper opening is shown in FIG. 29) formed in the base end 3220*a* of the external conductor 1322.

The shielding portion 1330 is bent as indicated by an arrow R1 after being assembled as shown in FIG. 29, and shields the openings 1331 formed in the base end 3220*a* of the external conductor 1322. In this way, as shown in FIG. 30, the assembled terminal fitting 1032A is obtained.

According to the configuration of the electronic device connector 10300 of the above-described fourth exemplary embodiment, since the external conductor 1322 that comes into elastic contact with the contact portion 1423 of the electronic device 1040C includes the shielding portion 1330 that shields the openings 1331 formed in the base end 3220*a* of the external conductor 1322, it is possible to block noise from the outside, and to achieve accurate signal transmission.

The invention is not limited to the above-described exemplary embodiments and modifications, improvements or the like thereof may be appropriately made. In addition, materials, shapes, dimensions, numbers, arrangement locations or the like of the respective components in the above-described exemplary embodiments are not particularly limited, and may be arbitrarily selected as long as they can realize the invention.

Figure 8:
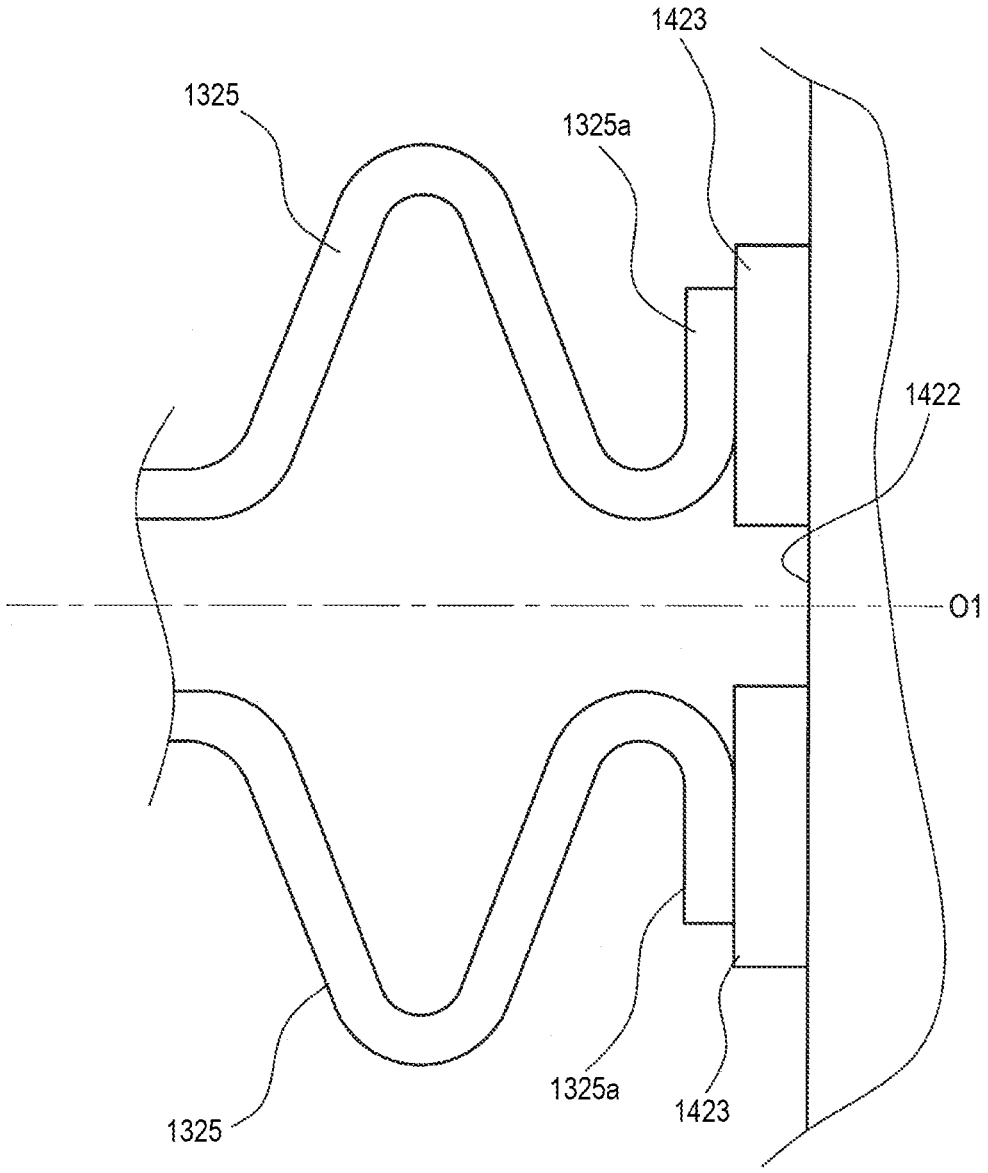
FIG. 8 is a schematic view of a modification example of the spring portion.

For example, as shown in FIG. 8, the tip portion 1325*a* of the spring portion 1325 of the external conductor 1322 may be directed outward in the plane orthogonal to the central axis O1. In this case, the contact portion 1423 of the circuit board 1422 is configured to be in slidable contact with the side surface of the tip portion 1325*a* of the spring portion 1325. This is similarly applied to the spring portion 1324 of the internal conductor 1321.

Further, the contact portion may be a through hole. In this case, in the contact portion, an inner surface that forms the hole and a peripheral edge portion is formed of a conductive material.

Further, in the above-described exemplary embodiments, the imaging element is provided on the circuit board, but the imaging element may not be provided on the circuit board. The imaging element may be provided in the case, instead of being mounted on the circuit board.

In addition, the electronic device used in the electronic device connector of the exemplary embodiments is not limited to the on-vehicle camera shown in the first exemplary embodiment. The electronic device connector of the exemplary embodiments may be used in various electronic devices.

Fifth Exemplary Embodiment

Figure 34A:
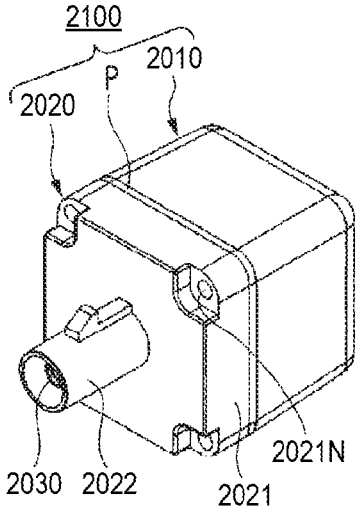
Figure 34B:
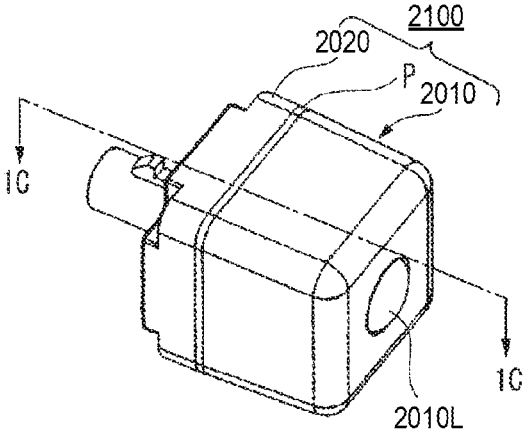
Figure 34C:
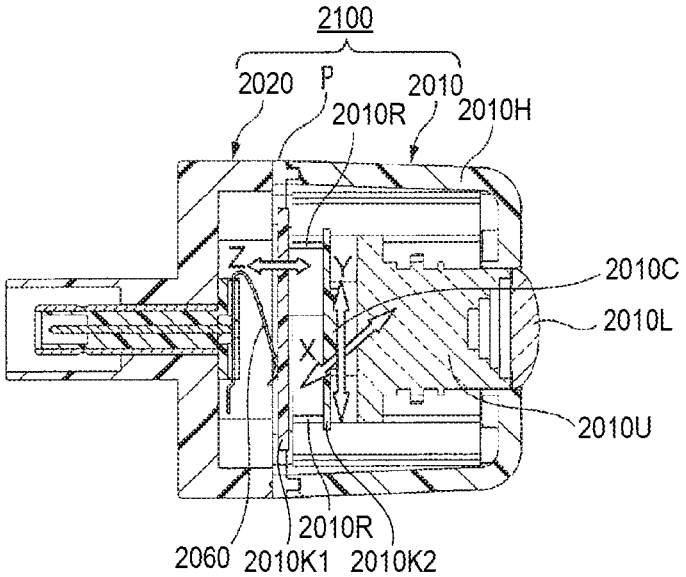

FIGS. 34A to 34C are perspective views of a camera module in a state where an electronic device connector according to a fifth exemplary embodiment of the invention is assembled in an on-vehicle camera, in which FIG. 34A is a perspective view when seen from a connector assembly side, FIG. 34B is a perspective view when seen from a camera lens side, and FIG. 34C is a sectional view taken along an arrow 1C-1C shown in FIG. 34B.

In FIG. 34A, a camera module 2100 according to the present exemplary embodiment has a configuration in which an on-vehicle camera which is an electronic device 2010 and an electronic device connector 2090 according to the present exemplary embodiment are integrally provided by fastening screws into screw holes 2021 through a packing P.

Since the on-vehicle camera 2010 is already known, a description thereof will be briefly made.

In FIG. 34B, in the on-vehicle camera, a lens 2010L is provided at the center of a front surface thereof. As shown in FIG. 34C, light incident through the lens 2010L passes through a light guide body (lens unit) 2010U to reach an imaging element 2010C mounted on a second substrate 2010K2, and is converted into a video image signal by the imaging element 2010C. The video image signal converted by the imaging element 2010C is transmitted to a contact portion 2010S (FIG. 35) that protrudes towards a connector side of a first substrate 2010K1 through conductive means.

First, in a housing 2010H of the on-vehicle camera, the lens 2010L is provided at the center of a front surface thereof. Then, the second substrate 2010K2 on which the imaging element 2010C is mounted and the first substrate 2010K1 disposed opposite to the second substrate 2010K2 at a predetermined separation interval by connection means 2010R and 2010R move in an Xb-direction and a Yb-direction in the figure to match an optical axis of the imaging element 2010C to be minutely adjusted, and then are fixed to the housing 2010H of the on-vehicle camera.

Accordingly, the contact portion 2010S also moves in the Xb-direction and the Yb-direction by the minute adjustment of the first substrate 2010K1 in the Xb-direction and the Yb-direction, and may move in a Zb-direction as necessary. Thus, in the present exemplary embodiment, in order to handle the movement of the contact portion 2010S in three directions, a V-shaped substrate connecting spring 2060 is used so that the contact portion 2010S can move in the Zb-direction, and a movement range of the contact portion 2010S in the Xb-direction and the Yb-direction can be covered by increasing lengths of a contact portion 2060S thereof in the Xb-direction and the Yb-direction.

A configuration of the camera module 2100 will be described with reference to FIGS. 35 and 36.

Figure 35:
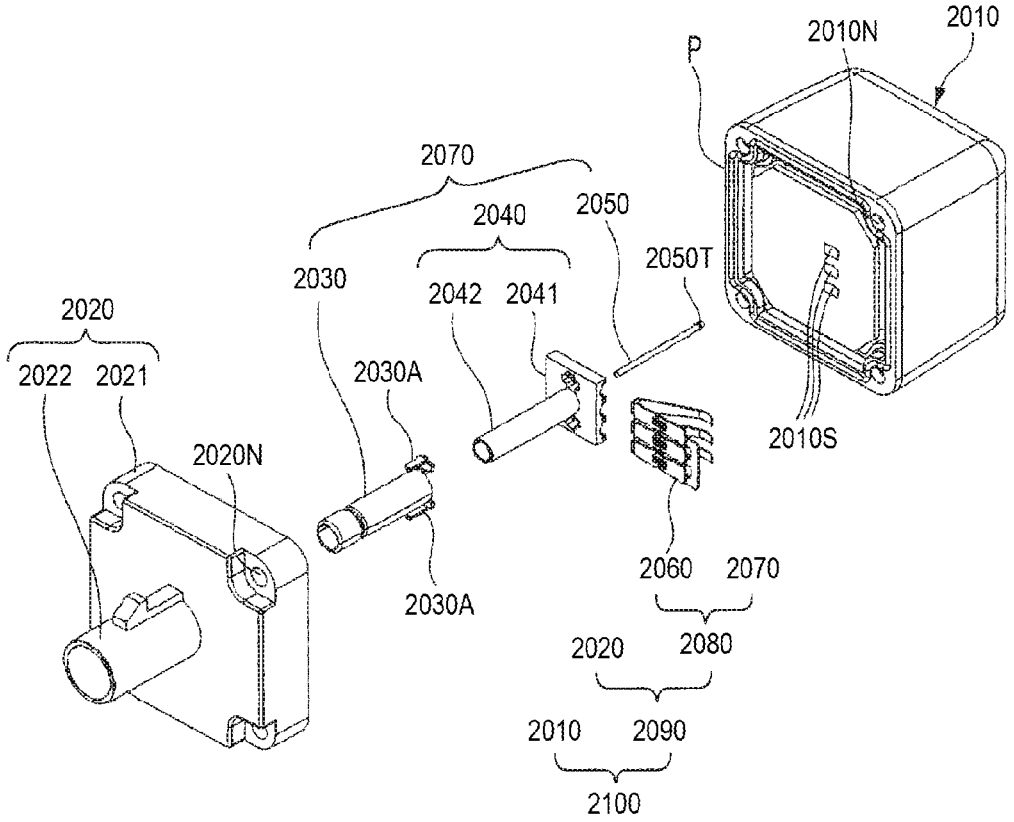
FIG. 35 is an exploded perspective view of the camera module shown in FIGS. 34A to 34C.

FIG. 35 is an exploded perspective view of the camera module 2100 shown in FIGS. 34A to 34C, and FIG. 36 is an exploded perspective view of a connector assembly 2080 shown in FIG. 35 when seen from the side of the electronic device 2010.

Figure 36:
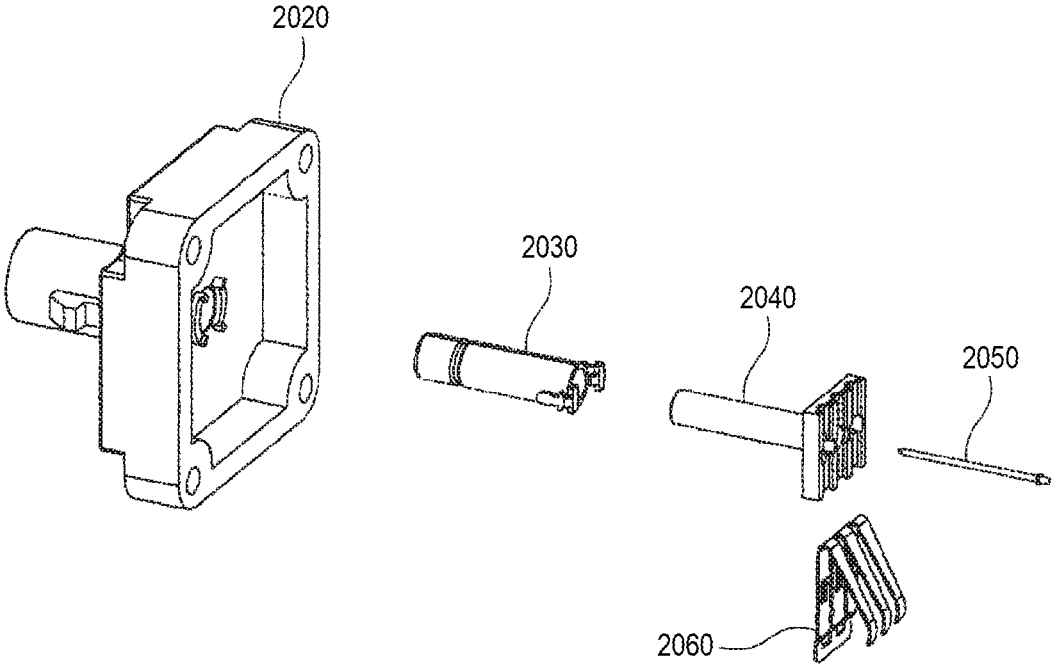
FIG. 36 is an exploded perspective view of a connector assembly 2080 shown in FIG. 35 when seen from an electronic device 2010.

In FIGS. 35 and 36, the camera module 2100 according to the present exemplary embodiment includes the electronic device (on-vehicle camera) 2010 and the electronic device connector 2090. Further, the electronic device connector 2090 includes an escutcheon 2020 and the connector assembly 2080. Further, the connector assembly 2080 includes a conductor portion 2070 and the substrate connecting spring 2060. In addition, the conductor portion 2070 includes an external conductor 2030, an insulator 2040, and an internal conductor 2050.

Accordingly, when describing the configuration of the camera module 2100 using end components, the camera module 2100 includes the electronic device 2010, the escutcheon 2020, the external conductor 2030, the insulator 2040, the internal conductor 2050, the substrate connecting spring 2060, and the packing P. Hereinafter, the components will be described in detail.

The escutcheon 2020 will be described with reference to FIGS. 37A to 38B.

Figure 37A:
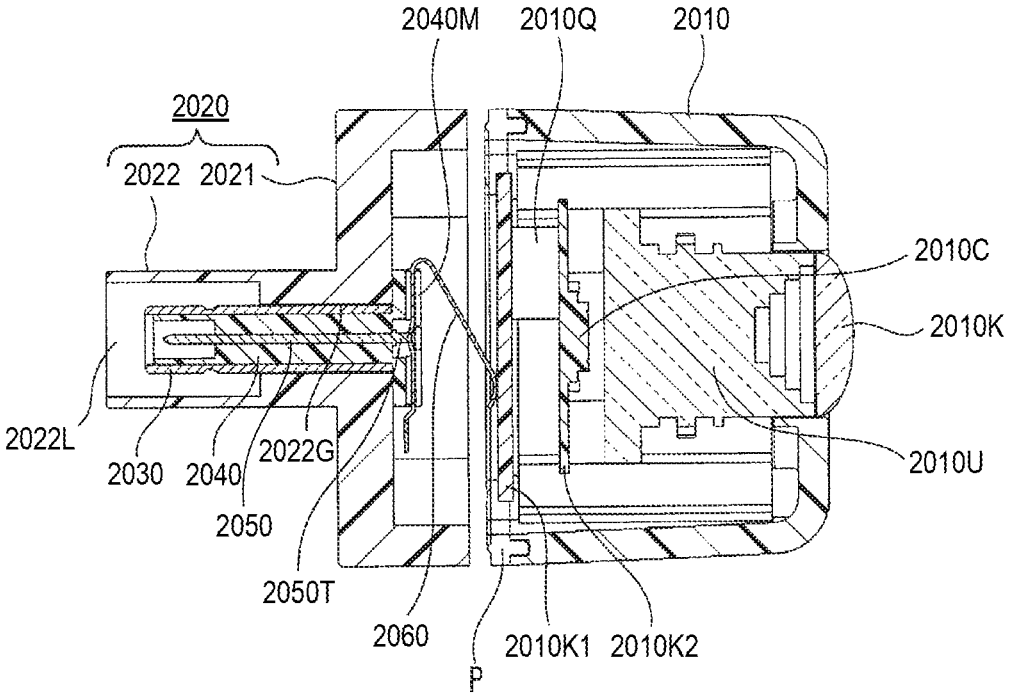
FIG. 37A is a longitudinal sectional view of the camera module before the electronic device connector is assembled into the on-vehicle camera.
Figure 37B:
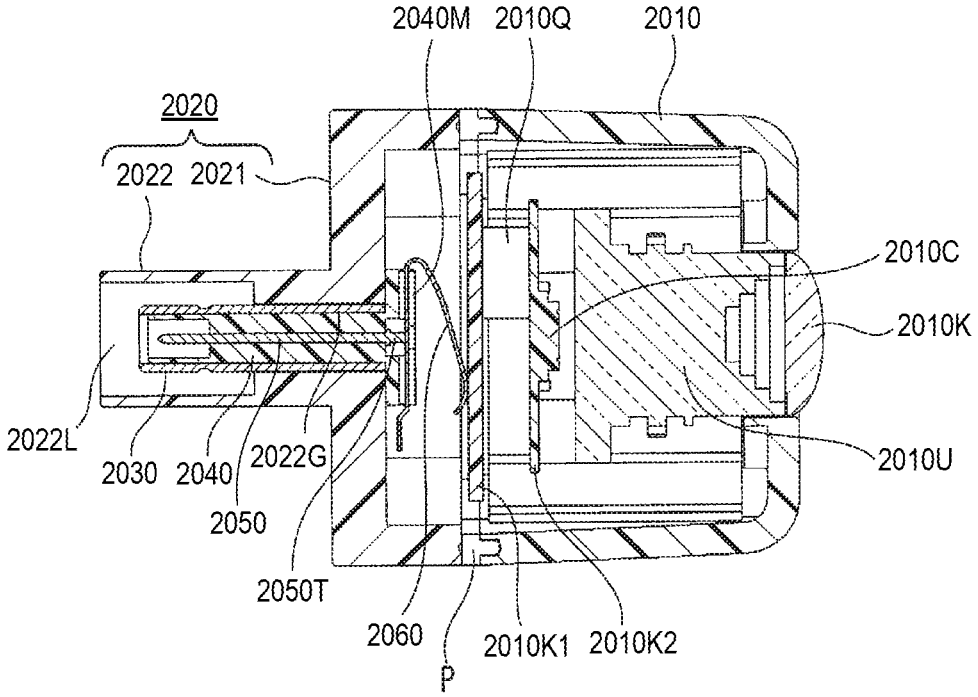
FIG. 37B is a longitudinal sectional view of the camera module after the electronic device connector is assembled into the on-vehicle camera.
Figure 38A:
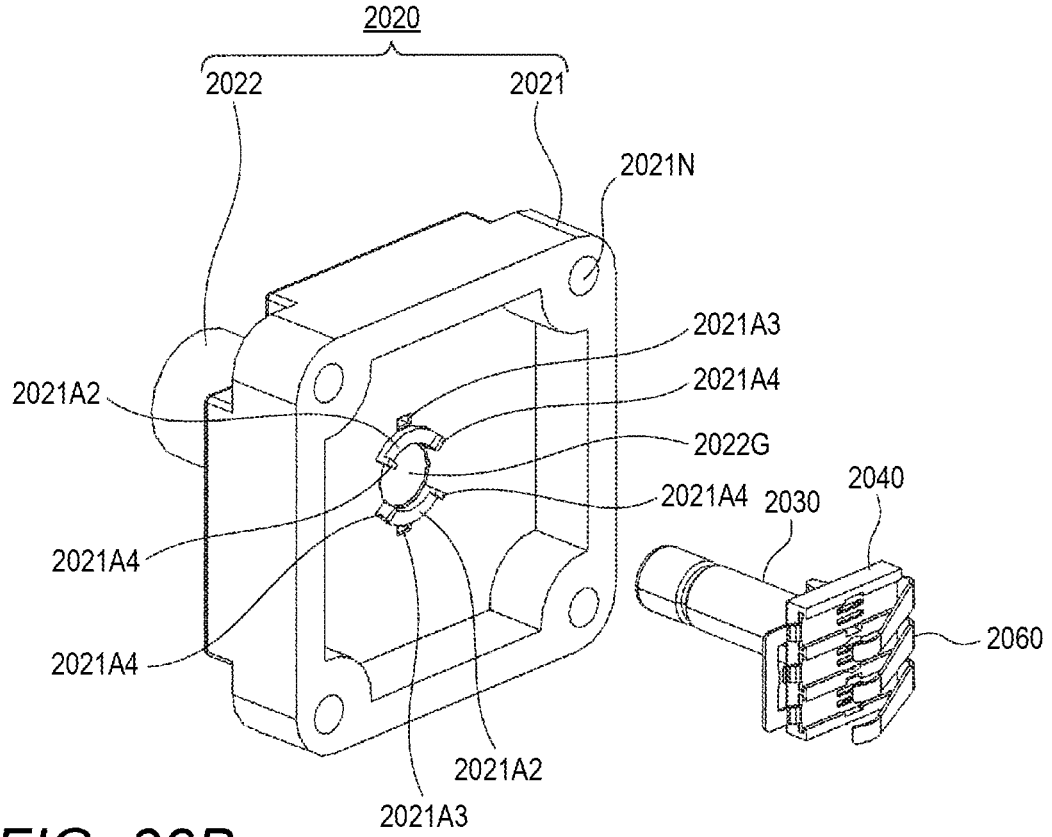
FIG. 38A is a perspective view illustrating a state where a conductor portion 2070 is removed from an escutcheon 2020 shown in FIG. 41A when seen from a rear surface side.
Figure 38B:
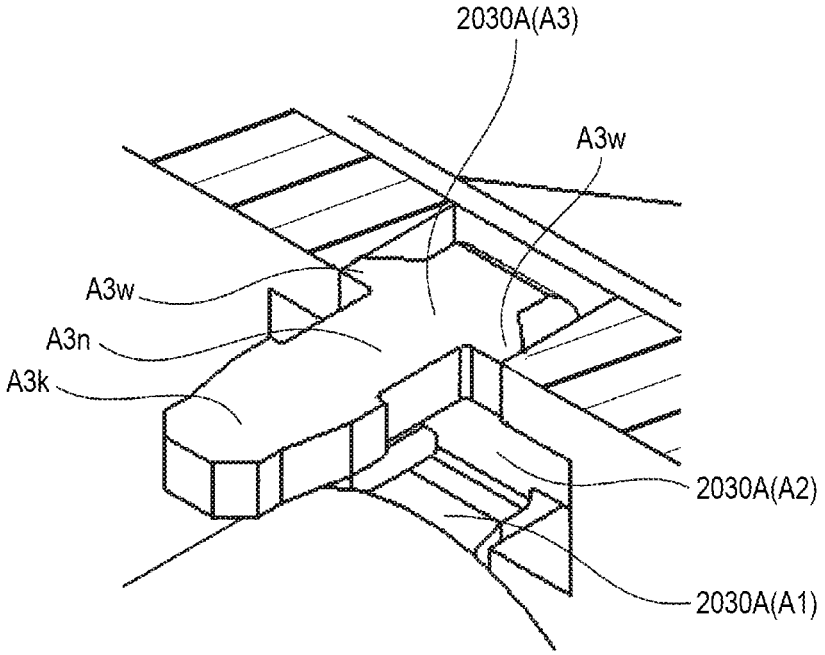
FIG. 38B is an enlarged sectional view illustrating a press-fit holding portion of an external conductor 2030 of the conductor portion 2070 shown in FIG. 41B.

FIG. 37A is a longitudinal sectional view of the camera module before the electronic device connector is assembled into the on-vehicle camera, and FIG. 37B is a longitudinal sectional view of the camera module after the electronic device connector is assembled into the on-vehicle camera. FIG. 38A is a perspective view illustrating a state where the conductor portion 2070 is removed from the escutcheon 2020 when seen from a rear surface side, and FIG. 38B is an enlarged sectional view illustrating a press-fit holding portion of the external conductor 2030.

The escutcheon 2020 is an integrally molded article made of an insulating resin, and includes a flange portion 2021 that includes the same opening as an opening of the housing 2010H of the electronic device 2010 (FIGS. 34A to 340), and a terminal holding portion 2022 formed to protrude from a central portion of the flange portion 2021 towards a side opposite to the electronic device.

The flange portion 2021 is formed by a rectangular insulating resin in which four sides are surrounded by side walls and a cavity is formed at the center thereof, and is formed with screw holes 2020N at four corners thereof. When the escutcheon 2020 is coupled with the electronic device 2010, the screw holes 2010N of the electronic device 2010 are overlapped with the screw holes 2020N of the escutcheon 2020 so that the escutcheon 2020 and the electronic device 2010 can be fixed by screws.

Further, an external conductor inserting path 2022G (FIGS. 37A and 38A) is formed towards the terminal holding portion 2022 from the central portion of the cavity.

Banks 2021A2 and 2021A2 (FIG. 38A) are formed along an outer edge part above and below the external conductor inserting path 2022G.

Tip inserting holes 2021A3 and 2021A3 (FIG. 38A) into which leg tips A3 (FIG. 39B) which are channel-shaped folded portions of press-fit holding portions 2030A (FIG. 35) are fitted are formed on outer sides of the banks 2021A2 and 2021 A2.

Engaging portions 2021A4 and 2021A4 (FIG. 38A) are formed at opposite ends of the banks 2021A2 and 2021A2.

If the flange portion 2021 of the escutcheon 2020 is coupled with the electronic device 2010 from the state shown in FIG. 37A to the state shown in FIG. 37B, the substrate connecting spring 2060 (to be described later) comes into contact with the contact portion 2010S disposed on the side of the electronic device 2010, and the video image signal of the imaging element 20100 mounted in the on-vehicle camera is transmitted to the escutcheon 2020.

The terminal holding portion 2022 will be described with reference to FIGS. 39A and 39B.

Figure 39A:
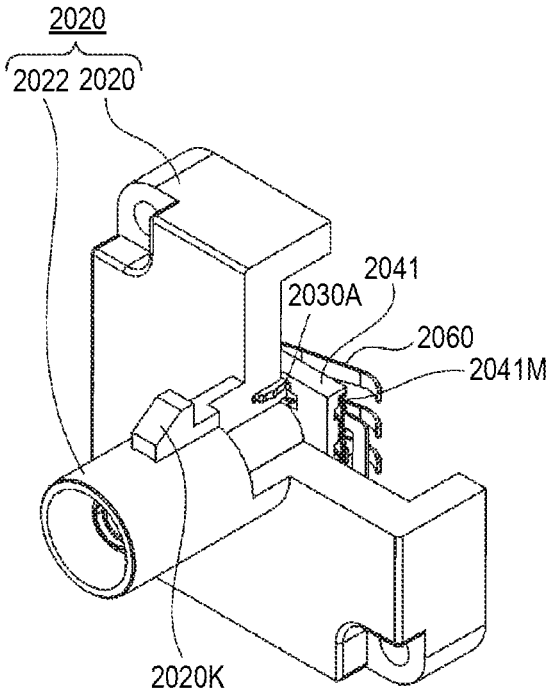
FIG. 39A is a perspective view illustrating the escutcheon 2020 shown in FIGS. 34A to 34C with a right upper side thereof being partially cut.
Figure 39B:
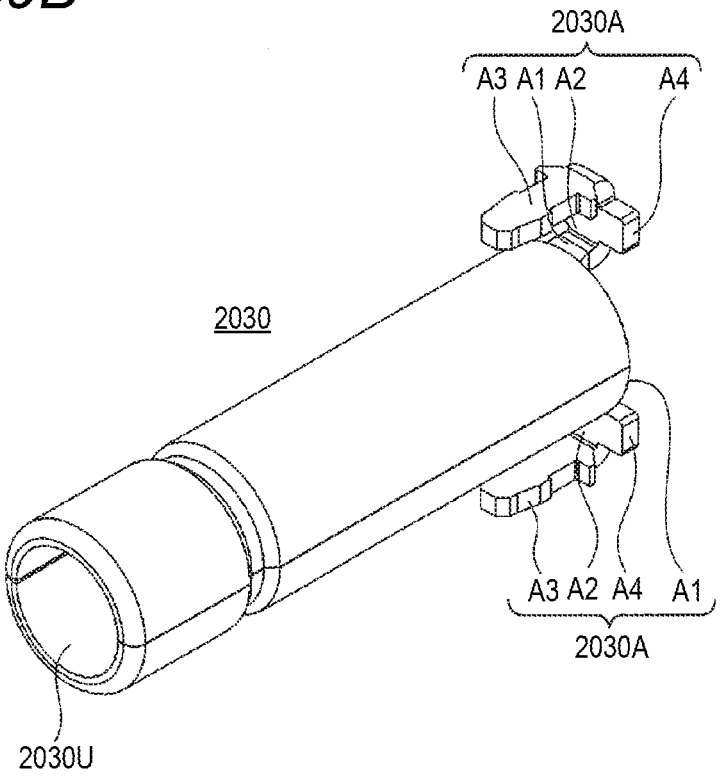
FIG. 39B is a perspective view of the external conductor 2030 shown in FIG. 35.

FIG. 39A is a perspective view illustrating the escutcheon 2020 shown in FIGS. 34A to 34C with a right upper side thereof being partially cut, and FIG. 39B is a perspective view of the external conductor 2030 shown in FIG. 35.

The terminal holding portion 2022 has a cylindrical shape, and includes an engaging piece 2020K to be engaged with the other party connector in an upper outer part thereof. Inside the cylinder, as shown in FIGS. 37A and 37B, the external conductor inserting path 2022G (FIG. 38A) in which the external conductor 2030 is inserted is formed from the side of the flange portion 2021 up to a middle part thereof, and a space 2022L in which a housing and a terminal portion of the other party connector are inserted is formed from the middle part up to a tip thereof.

Then, the external conductor 2030 will be described with reference to FIG. 40.

Figure 40:
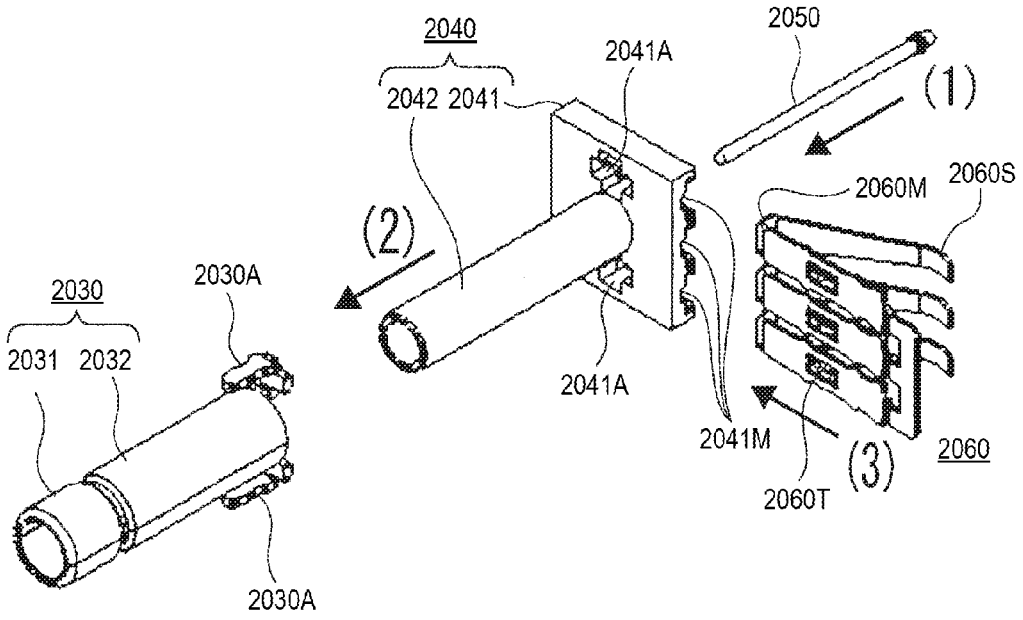
FIG. 40 is a perspective view illustrating an assembly order of the conductor portion 2070 shown in FIG. 35, in which assembly is performed in the order of (1) to (3).

FIG. 40 is a perspective view illustrating an assembly order of the conductor portion 2070 shown in FIG. 35, in which assembly is performed in the order of (1) to (3). The external conductor 2030 is formed in a hollow cylindrical shape, and includes a connecting portion 2031 with respect to a braid for shielding of a shield cable, and a fixed portion 2032 fixed to the external conductor inserting path 2022G of the escutcheon 2020. The press-fit holding portions 2030A are integrally formed in upper and lower parts on a base part side of the fixed portion 2032.

The press-fit holding portion 2030A is an important element of the exemplary embodiment for electrically connecting the external conductor 2030 and the substrate connecting spring 2060, and has a channel shape as shown in FIG. 39B.

A channel lower leg portion A1 is integrally formed with an end portion of the external conductor 2030 on the side of the electronic device, a channel connecting portion A2 is vertically provided from the channel lower leg portion A1, and a channel upper leg portion A3 is horizontally bent towards the escutcheon side in an upper part of the channel connecting portion A2. The channel lower leg portion A1 and the external conductor 2030 are integrally formed by punching processing or the like, but the channel lower leg portion A1 and the external conductor 2030 may be separately formed, and may be integrally formed by various methods of bonding, welding, fitting, pressure welding, screwing or the like.

The channel connecting portion A2 is formed to include a wide portion A4 having a width larger than the width of the lower leg portion A1. In this way, as the channel connecting portion A2 includes the wide portion A4 having the large width, a contact area with respect to the substrate connecting spring 2060 is enlarged to secure reliable contact.

Further, the channel upper leg portion A3 is formed to include a wedge portion A3*w* which gradually becomes wider from the bending portion towards a tip thereof, a narrow portion A3*n* which becomes narrower from the protrusion A3*w* towards the tip and has the same width as that of the lower leg portion A1, and an engaging portion A3*k* that is rapidly enlarged in its width from the narrow portion A3*n* and then gradually becomes narrower towards the tip.

Here, the connecting portion A2 and the wide portion A4 of the press-fit holding portion 2030A are press-fitted into a cross-shaped hole of a press-fit holding portion inserting hole 2041A of the flange portion 2041 of the insulator 2040, but the press-fitting is not essential, and may be held by engagement of engaging portions formed in the respective components.

Then, the assembly of the escutcheon 2020 and the external conductor 2030 described above will be described with reference to FIGS. 41A and 41B.

Figure 41A:
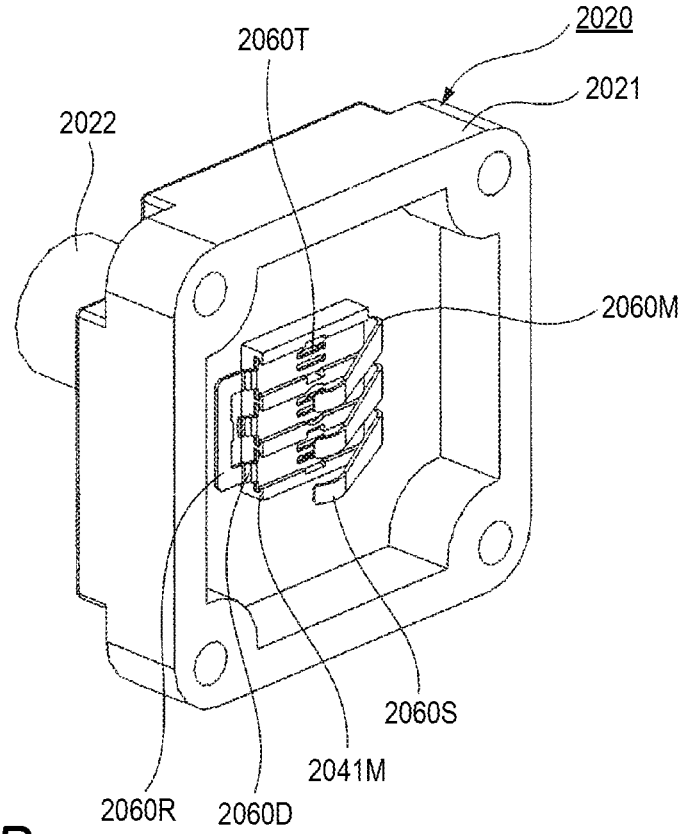
FIG. 41A is a perspective view illustrating a state where the escutcheon 2020 shown in FIG. 39A is not cut when seen from a rear surface side.
Figure 41B:
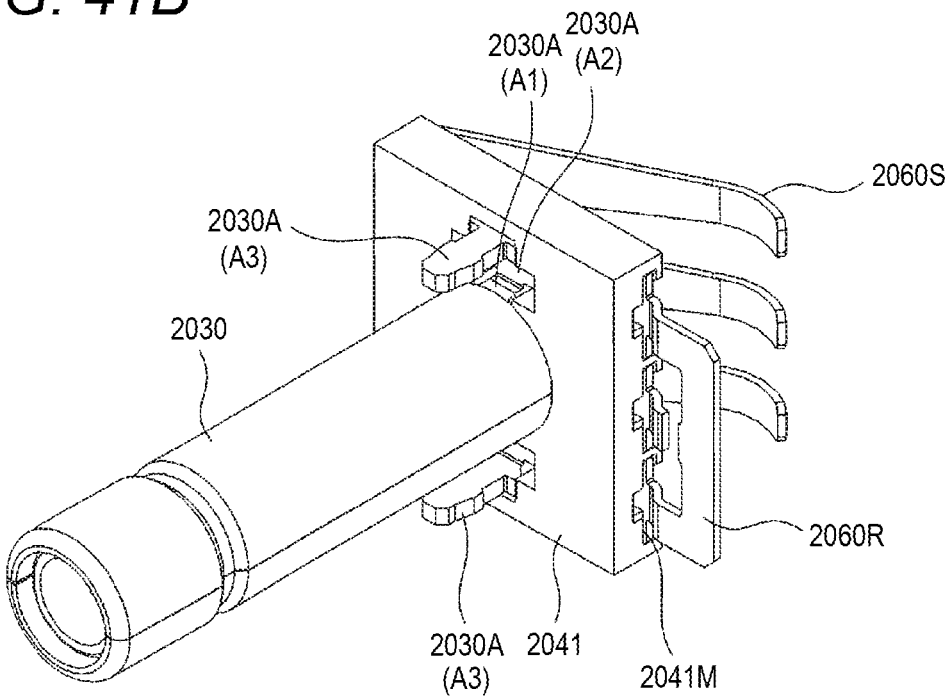
FIG. 41B is a perspective view of the conductor portion 2070 in which respective members shown in FIG. 40A are assembled.

FIG. 41A is a perspective view illustrating a state where the escutcheon 2020 shown in FIG. 39A is not cut when seen from a rear surface side, and FIG. 41B is a perspective view of the conductor portion 2070 in which respective members shown in FIG. 40A are assembled.

As described in FIG. 38A, the flange portion 2021 of the escutcheon 2020 is formed so that the external conductor inserting path 2022G is formed from the central part of the cavity towards the terminal holding portion 2022, and the cylindrical external conductor 2030 is inserted into the external conductor inserting path 2022G. The banks 2021A2 and 2021A2 are formed along the outer edge part above and below the external conductor inserting path 2022G, and the channel connecting portions A2 formed in the upper and lower press-fit holding portion 2030A of the external conductor 2030 (FIG. 39B) are in contact with the banks 2021A2 and 2021A2, respectively. Further, the leg portion tips A3 of the channel-shaped folded portions of the press-fit holding portions 2030A are inserted into the tip inserting holes 2021A3 and 2021A3 of the escutcheon 2020, respectively, and are pressed to be fitted into side walls of the tip inserting holes 2021A3 and 2021A3, so that the escutcheon 2020 and the external conductor 2030 are fixed to each other.

Here, the engaging portions 2021A4 and 2021A4 formed at the opposite ends of each of the banks 2021A2 and 2021A2 of the escutcheon 2020 are engaged with wall surfaces of horizontal (lateral) opposite ends of the cross-shaped hole of the press-fit holding portion inserting hole 2041A (to be described later, FIGS. 42C and 42D) of a dielectric 2040, so that the escutcheon 2020 and the insulator 2040 are fixed to each other.

Figure 42A:
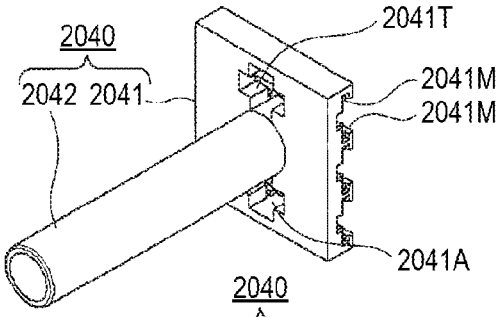
Figure 42B:
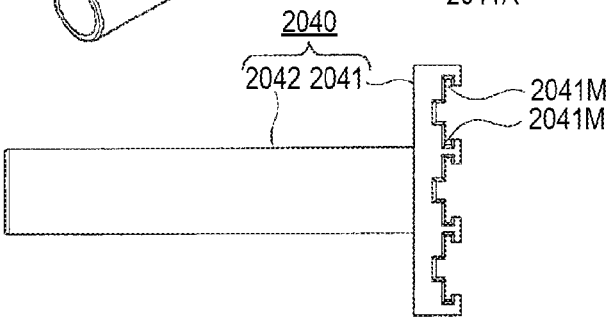
Figure 42C:
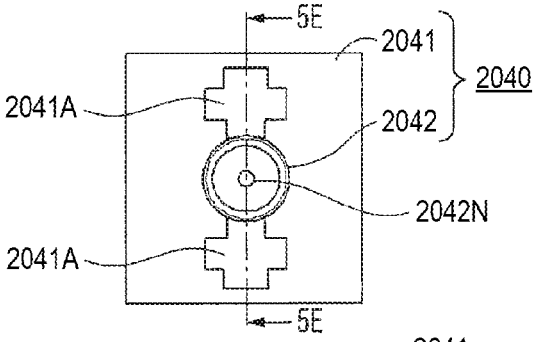
Figure 42D:
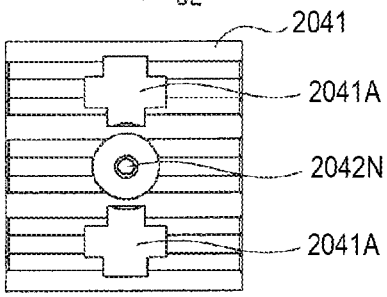
Figure 42E:
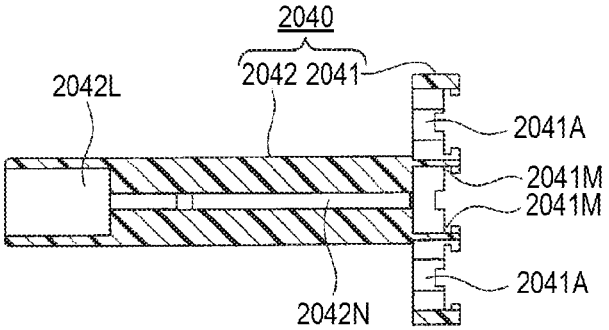

FIGS. 42A to 42E are diagrams illustrating an appearance of the insulator 2040 shown in FIG. 35, in which FIG. 42A is a perspective view of the insulator, FIG. 42B is a side view of the insulator shown in FIG. 42A, FIG. 42C is a rear view of the insulator shown in FIG. 42A, FIG. 42D is a front view of the insulator shown in FIG. 42A, and FIG. 42E is a sectional view taken along an arrow 5E-5E in FIG. 42C.

As shown in FIG. 42A, the insulator 2040 includes a rectangular flange portion 2041, and a hollow cylindrical portion 2042 that protrudes from a central part of the flange portion 2041 towards a side opposite to the electronic device, both of which are integrally formed of an insulator that performs an insulation function between the external conductor 2030 and the internal conductor 2050. The insulator 2040 may be realized by plastic, ceramic, rubber or the like.

When focusing on impedance matching, a dielectric having a desired dielectric constant may be used as the insulator 2040.

Further, in the exemplary embodiment, the flange portion 2041 is formed in the rectangular shape, but the shape is not limited to the rectangular shape, and may be a circular shape, an elliptical shape, a polygonal shape, or the like.

In addition, in the exemplary embodiment, the hollow cylindrical portion 2042 protrudes from the central part of the flange portion 2041, but the shape is not limited to the hollow cylinder, and may be a hollow elliptic cylinder, a hollow square tube, or the like.

In the flange portion 2041, the press-fit holding portion inserting holes 2041A are formed in upper and lower parts thereof in the vicinity of the base portion of the hollow cylindrical portion 2042. Further, plural spring inserting grooves 2041M (since two spring inserting grooves are used with respect to one terminal spring and three terminal springs are present in the figure, six spring inserting grooves 2041M are formed) are horizontally formed from one end to the other end of the flange portion 2041, on a surface of the flange portion 2041 that faces the electronic device.

As shown in FIGS. 42C and 42D, the press-fit holding portion inserting hole 2041A is formed in a cross shape. A vertical internal diameter of the cross-shaped press-fit holding portion inserting hole 2041A is formed as an internal diameter such that the length of the channel connecting portion A2 of the channel-shaped press-fit holding portion 2030A of the external conductor 2030 can be inserted therein. Further, a horizontal internal diameter of the cross-shaped press-fit holding portion inserting hole 2041A is formed as an internal diameter such that the wide portion A4 of the channel connecting portion A2 of the channel-shaped press-fit holding portion 2030A of the external conductor 2030 can be inserted therein. Accordingly, as the channel connecting portion A2 and the wide portion A4 of the channel-shaped press-fit holding portion 2030A of the external conductor 2030 into the channel shape are fitted into the cross-shaped press-fit holding portion inserting hole 2041A of the flange portion 2041 of the insulator 2040, the external conductor 2030 may be connected to the substrate connecting spring 2060 (FIGS. 43A to 43F) through the press-fit holding portion inserting hole 2041A of the insulator 2040.

In the spring inserting groove 2041M, as shown in FIGS. 42A, 42B, and 42E, a pair of grooves is formed to face each other so that two grooves extend in the horizontal direction from one end of the flange portion 2041 to the other end thereof, and three pairs of grooves are formed in the flange portion 2041. An interval between the pair of grooves is the same as the width of the substrate connecting spring 2060, and the depth of the groove is the same as the thickness of the substrate connecting spring 2060.

The hollow cylindrical portion 2042 is formed in a hollow cylindrical shape, and a hollow cylindrical part thereof functions as an internal conductor inserting path 2042N. The internal conductor inserting path 2042N is formed from the flange portion 2041 to a middle part thereof, and a space 2042L in which a terminal portion of the other party connector is inserted is formed from the middle part to a tip thereof.

As shown in FIGS. 35 and 36, the internal conductor 2050 is formed in a solid elongated rod shape. About ⅔ of the length of the internal conductor 2050 is inserted into the hollow cylindrical portion 2042 of the insulator 2040, and about the remaining ⅓ thereof protrudes forward from the hollow cylindrical portion 2042 (see FIGS. 37A and 37B).

Next, the substrate connecting spring 2060 will be described with reference to FIGS. 43A to 43F.

Figure 43A:
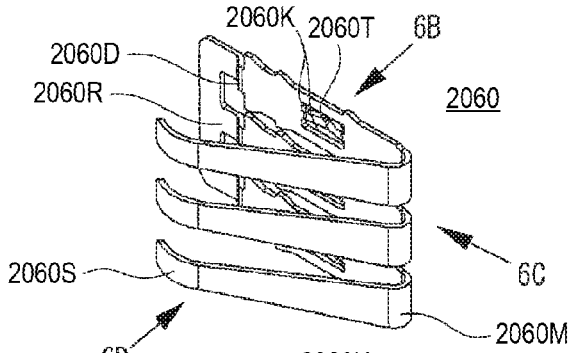
Figure 43B:
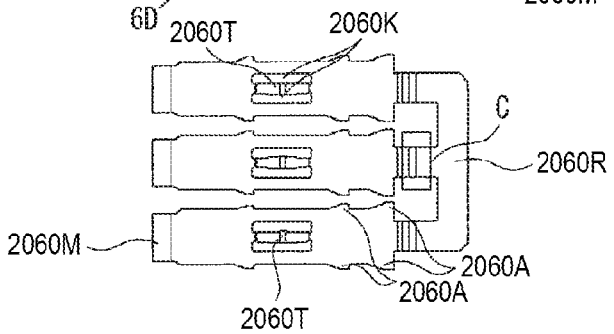
Figure 43C:
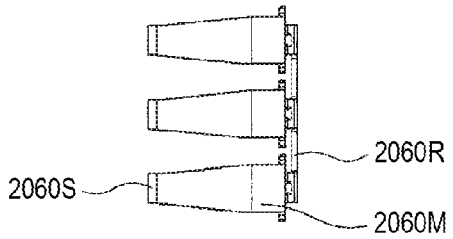
Figure 43D:
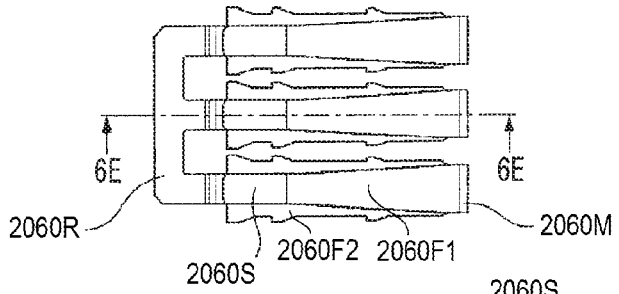
Figure 43E:
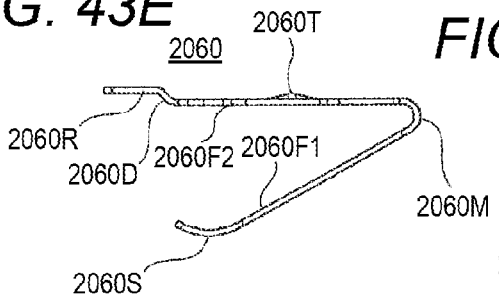

FIGS. 43A to 43F are diagrams illustrating an appearance of the substrate connecting spring 2060 shown in FIG. 35, in which FIG. 43A is a perspective view of the substrate connecting spring, FIG. 43B is a rear view of the substrate connecting spring shown when seen in a direction of an arrow 6B in FIG. 43A, FIG. 43C is a side view of the substrate connecting spring shown in FIG. 43A when seen in a direction of an arrow 6C, FIG. 43D is a front view of the substrate connecting spring shown in FIG. 43A when seen in a direction of an arrow 6D, and FIG. 43E is a sectional view taken along an arrow 6E-6E shown in FIG. 43D.

Figure 43F:
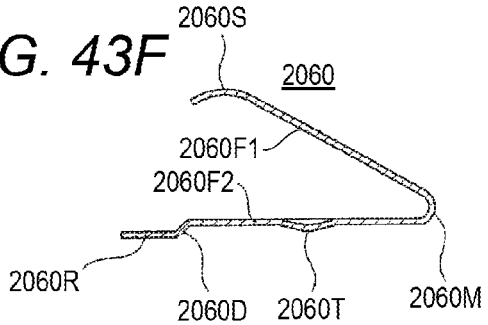

The substrate connecting spring 2060 includes plural V-shaped springs, in which respective end portions of one side leg portions of the plural V-shaped springs are integrally connected by a common connecting plate 2060R. As shown in FIG. 43F, the substrate connecting spring 2060 is formed by bending one metal plate into a V-shape at an approximately central part thereof to form a bending portion 2060M, and directing one leg portion 2060F1 towards the electronic device and directing the other leg portion 2060F2 toward the escutcheon. The leg portion 2060F1 is smoothly bent in the vicinity of a tip thereof, to thereby form the contact portion 2060S that comes into contact with the contact portion 2010S (see FIG. 35).

In the leg portion 2060F2, a protrusion portion 2060T is formed by bending a central part thereof with reference to a tip thereof from an inner side to an outer side using a tool, and opening portions 2060K and 2060K (FIGS. 43A and 43B) are formed by punching opposite parts with the protrusion portion 2060T being interposed therebetween in the length direction by a predetermined length, so that the protrusion portion 2060T can be easily deformed. The tip of the leg portion 2060F2 is formed as the common connecting plate 2060R.

The common connecting plate 2060R is formed with a step portion 2060D from the surface of the other leg portion 2060F2. When the step portion 2060D is pushed into the spring inserting groove 2041M of the flange portion 2041 of the insulator 2040 using a push-in tool, the tool is positioned so that the push-in tool holds only the common connecting plate 2060R.

The three V-shaped springs that are integrally formed with the common connecting plate 2060R have the same shape, and the V-shaped springs at opposite ends among the three V-shaped springs come into contact with the contact portions 2010S (FIG. 35) on the opposite sides through the contact portions 2060S, and the respective protrusion portions 2060T come into contact with the upper and lower channel connecting portions A2 (FIG. 39B) of the external conductor.

Further, the middle V-shaped spring among the three V-shaped springs comes into contact with the middle contact portion 2010S (FIG. 35) through the contact portion 2060S, and the protrusion portion 2060T comes into contact with an end portion 2050T of the internal conductor 2050 (FIG. 37A).

If an end portion C (FIG. 43B) of the leg portion of the middle V-shaped spring that is connected to the internal conductor 2050 among the plural V-shaped springs that are integrally formed with the common connecting plate 2060R is cut out by a tool before and after assembling to be separated from the common connecting plate 2060R, the manufacturing process is simplified, which is preferable.

In this way, if the common connecting plate 2060R is provided, handling of the substrate connecting spring 2060 becomes easy, and the manufacturing process is simplified, which is preferable.

However, the common connecting plate 2060R is not essential, and each of three V-shaped springs may be separately provided to be inserted into each fitting groove of the insulator.

Further, here, the V-shaped spring is used, but the V-shaped spring is not essential, and a U-shaped spring may be used, or a coil spring, a conductive sponge spring or the like may be used.

Further, in the present exemplary embodiment, three V-shaped springs are used. Theoretically, a total of two V-shaped springs, that is, one spring for the external conductor 2030 and one spring for the internal conductor 2050, are enough in view of the circuit, but if two springs are used for the external conductor 2030, a sense of balance is improved, and even when one V-shaped spring of the external conductor is in a contact error, the operation may be continued due to the backup of the other V-shaped spring.

Similarly, the press-fit holding portions 2030A (FIG. 39B) are provided in the upper and lower parts of the external conductor, but in view of the circuit, one of the upper and lower parts the external conductor may be enough. However, as the holding portions are provided in the upper and lower parts of the external conductor, the assembly is easily performed without recognition of the upper and lower parts, and even when one press-fit holding portion 2030A is in a contact error, the other press-fit holding portion 2030A performs a backup function.

Figure 44A:
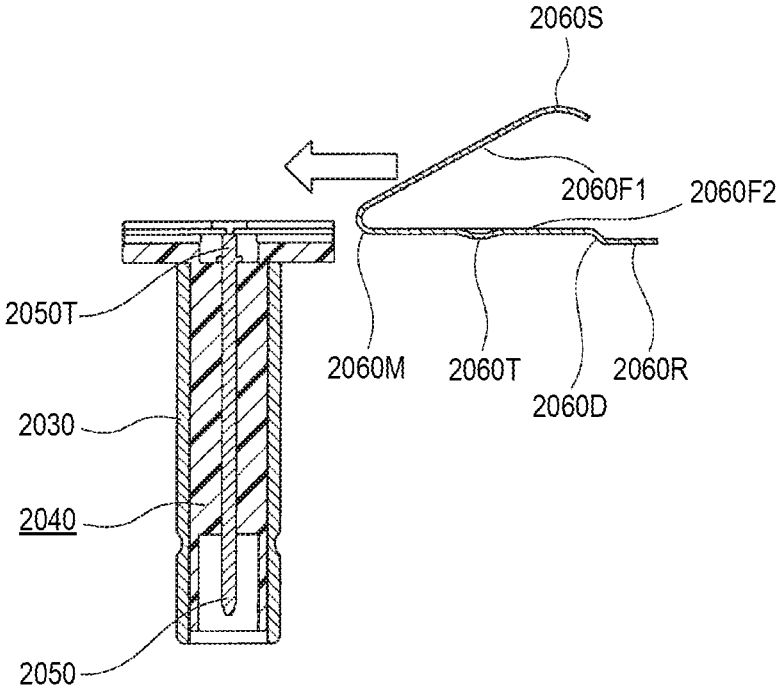
FIG. 44A is a cross-sectional view of the connector assembly before the substrate connecting spring is inserted into a fitting groove of the insulator.
Figure 44B:
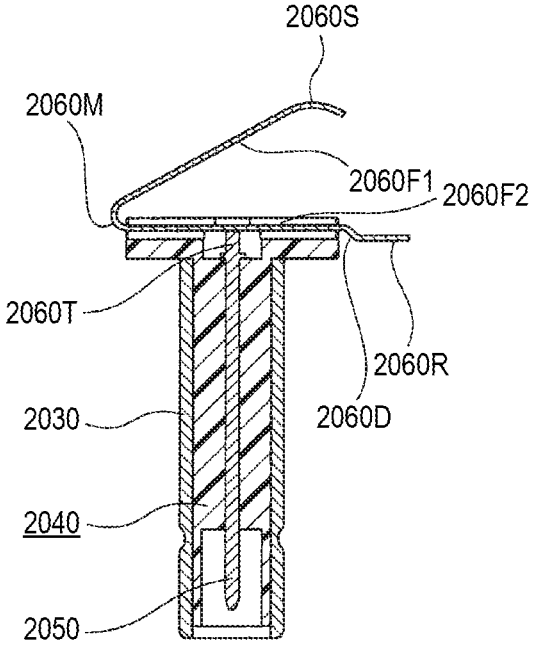
FIG. 44B is a cross-sectional view of the connector assembly after the substrate connecting spring is inserted and assembled into the fitting groove.

An operation of mounting the substrate connecting spring 2060 on the insulator 2040 is performed as shown in FIGS. 44A and 44B.

FIG. 44A is a cross-sectional view of the connector assembly before the substrate connecting spring is inserted into the fitting groove of the insulator, and FIG. 44B is a cross-sectional view of the connector assembly after the substrate connecting spring is inserted and assembled into the fitting groove.

If the bending portion 2060M of the substrate connecting spring 2060 moves closer to the spring inserting grooves 2041M formed on the side of the electronic device, on the surface of the flange portion 2041 of the insulator 2040 as an arrow direction in FIG. 44A and groove inserting portions 2060A and 2060A that protrude on opposite sides of the leg portion 2060F2 (FIG. 43B) of the substrate connecting spring 2060 are inserted into the spring inserting grooves 2041M and are further advanced, finally, as shown in FIG. 44B, the leg portions 2060F2 of the substrate connecting spring 2060 are accommodated in the spring inserting grooves 2041M, and the leg portions 2060F1 of the substrate connecting spring 2060 that extend from the bending portion 2060M extend toward the contact portion 2010S (FIG. 35) on the side of the electronic device from the spring inserting grooves 2041M.

On the other hand, the common connecting plate 2060R of the substrate connecting spring 2060 is exposed without entering the spring inserting grooves 2041M. In this way, since the common connecting plate 2060R and the base portion of each terminal are exposed from the spring inserting grooves 2041M, it is possible to easily cut out the base portion of the terminal that comes into contact with the internal conductor.

In this state, the middle v-shaped spring among the three V-shaped springs that are integrally formed with the common connecting plate 2060R is disposed such that the protrusion portion 2060T is in contact with the end portion 2050T of the internal conductor 2050.

Further, although not shown in FIGS. 44A and 44B, the V-shaped springs at the opposite ends thereof among the three V-shaped springs that are integrally formed with the common connecting plate 2060R are disposed such that the protrusion portions 2060T are in contact with the channel connecting portions A2 of the external conductor (FIG. 39B).

With such a configuration, one leg portion of the V-shaped spring is formed into a cantilevered spring, and thus, is easily movable by a weak pressing force to improve follow-up performance, and the other leg portion thereof is formed into a both-side fixed spring, and thus, is firmly connected and held to the holding portion by a strong pressing force.

Further, a configuration in which the cantilevered spring is connected to the holding portion and the both-side fixed spring is connected and held to the electronic device side may be used.

The order of assembly of the above-described three components of the insulator 2040, the internal conductor 2050, and the substrate connecting spring 2060 to the external conductor 2030 will be described with reference to FIG. 40. FIG. 40 is a perspective view illustrating an assembly order of the conductor portion 2070 shown in FIG. 35. First, the internal conductor 2050 is inserted into the insulator 2040 in an arrow direction (1) in FIG. 40. Then, the substrate connecting spring 2060 is mounted in the spring inserting groove 2041M of the insulator 2040 in an arrow direction (3) in FIG. 40. Then, the hollow cylindrical portion 2042 of the insulator 2040 is inserted into an inner space of the external conductor 2030 in an arrow direction (2), and then, the press-fit holding portions

2030A of the external conductor 2030 are inserted into the press-fit holding portion inserting holes 2041A of the insulator 2040.

The assembly is performed in the above-described order, and thus, the connector assembly 2080 (FIG. 35) is completed.

As the escutcheon 2020 is assembled into the connector assembly 2080, the electronic device connector 2090 according to the present exemplary embodiment is completed. Further, as the electronic device connector 2090 is combined with the electronic device 2010, the camera module 2100 is completed.

According to the above-described configuration of the electronic device connector 2090, as the press-fit holding portions of the external conductor are fitted into the press-fit holding portion inserting holes of the insulator, the press-fit holding portion of the external conductor and the end portion of the internal conductor on the side of the electronic device come into contact with each of the substrate connecting springs, and thus, the connection of the connector connecting portion, each member, and the substrate is simply performed without welding. Further, even though the substrate is slightly movable upward and downward, rightward and leftward, and forward and backward, an assembly of electrodes is simply performed without cutoff of an electrical connection.

Here, the features of the electronic device connector according to the above-described exemplary embodiments of the invention will be briefly described as the following to.

An electronic device connector 1030 includes: a connector housing 1031 that is combined with a case 1041 of an electronic device 1040; and a terminal fitting 1032 that is held by the connector housing 1031, in which when the connector housing 1031 is combined with the case 1041, the terminal fitting 1032 is electrically connected to a contact portion 1423 of the electronic device 1040. Here, the terminal fitting 1032 includes an internal conductor 1321, an external conductor 1322 disposed around the internal conductor 1321, and a dielectric 1323 disposed between the internal conductor 1321 and the external conductor 1322 which are concentrically disposed, and the internal conductor 1321 and the external conductor 1322 are integrally provided with spring portions 1324, 1325 capable of being elastically deformed in contact with the contact portion 1423 of the electronic device 1040.

In the electronic device connector 1030 according to, the spring portion 1324 of the internal conductor 1321 and the spring portion 1325 of the external conductor 1322 are orthogonal in their extending directions in a plane orthogonal to the axes of the internal conductor 1321 and the external conductor 1322.

In the electronic device connector 1030 according to or, the electronic device 1040 is an on-vehicle camera.

In the electronic device connector 1030A according to any one of to, each of the internal conductor 1321 and the external conductor 1322 includes a terminal body 3210, 3220 that is fixed and supported in the connector housing 1031, and the spring portion 1326, 1327 that extends from a base end 3210*a*, 3220*a* of the terminal body 3210, 3220 disposed on a side of the case 1041A of the electronic device 1040A, and the spring portion 1326, 1327 includes a flexible portion 1326*c*, 1327*c* that extends in a tilted straight line shape that connects one end 3210*b*, 3220*b* of the base end 3210*a*, 3220*a* of the terminal body 3210, 3220 and the contact portion 1423 in a plane that extends along an axis of the terminal body 3210, 3220, and generates a contact pressure with respect to the contact portion 1423 due to flexible deformation in an axial direction of the terminal body 3210, 3220.

In the electronic device connector 1030B according to, the flexible portion 1326*c*, 1327*c* is formed in the tilted straight line shape that extends from one end 3210*c*, 3220*c* of the base end 3210*a*, 3220*a* of the terminal body 3210, 3220 disposed on a side separated from the contact portion 1423 and is directed toward the contact portion 1423.

In the electronic device connector 1030C according to any one of to, the external conductor 1322 includes a shielding portion 1330 that shields an opening 1331 formed in the external conductor 1322.

(7) An electronic device connector 2090 includes: an escutcheon 2020 configured to be combined with an electronic device 2010; and a connector assembly 2080 configured to be held by the escutcheon, in which the connector includes a conductor portion 2070 that includes an external conductor 2030, an insulator 2040 including a cylinder portion that is protrudingly provided and is inserted into the external conductor and an internal conductor 2050 that is inserted into the cylinder portion of the insulator, and a substrate connecting spring 2060 that comes into contact with both the external conductor and the internal conductor, the external conductor is provided with a conductive holding portion that protrudes from an end portion thereof disposed on a side of the electronic device towards the electronic device, a holding portion inserting hole 2041A that passes through the holding portion is formed in a base of the insulator, the substrate connecting spring 2060 is provided in an outlet port of the holding portion inserting hole on the side of the electronic device and an end portion 2050T of the internal conductor on the side of the electronic device, the holding portion of the external conductor and the end portion of the internal conductor on the side of the electronic device come into contact with the substrate connecting spring as the holding portion of the external conductor is fitted into the holding portion inserting hole of the insulator, and a spring inserting groove 2041M is provided on a surface of the base of the insulator on the side of the electronic device, and the substrate connecting spring is inserted into the spring inserting groove in a direction orthogonal to an axial direction of the cylinder portion, and a portion that is in contact with a contact portion 2010S of the electronic device is exposed from the spring inserting groove.

(8) In the electronic device connector according to (7), the holding portion 2030A is formed in a channel shape, one leg portion A1 of the channel shape is provided in the external conductor 2030, a connecting portion A2 of the channel shape is fitted into the holding portion inserting hole of the insulator to come into contact with the substrate connecting spring 2060, an engaging portion A3*k* is formed at a tip of the other leg portion A3 of the channel shape, a tip inserting hole 2021A3 in which the engaging portion is inserted is formed in the escutcheon, and the engaging portion is inserted and fitted into the tip inserting hole.

(9) In the electronic device connector according to (8), a protrusion A3*w* to be press-fitted into the insulator is formed in the other leg portion of the channel shape on the side of the connecting portion thereof.

(10) In the electronic device connector according to any one of (7) to (9), the substrate connecting spring includes a plurality of springs each of which includes a bending portion and two leg portions that extend from the bending portion in both directions in which respective end portions of one side leg portions of the springs are integrally formed by a common connecting plate 2060R, an end portion of the leg portion of the spring that is connected to the internal conductor, among the plurality of springs that are integrally formed with the common connecting plate, is cut out to be separated from the common connecting plate, and a spring inserting groove 2041M is provided in the surface of the base of the insulator on the side of the electronic device, the bending portion of each of the plurality of springs of the substrate connecting spring is inserted into the spring inserting hole, and a portion that comes into contact with a contact portion 2010S of the electronic device is exposed from the spring inserting hole.

(11) In the electronic device connector according to any one of (7) to (10), as the bending portions of the plurality of springs each of which includes the bending portion and two leg portions that extend from the bending portion in both directions are inserted into the spring inserting holes and the one leg portion including the portion that comes into contact with the contact portion of the electronic device is exposed from the spring inserting hole, the one leg portion is formed into a cantilevered spring, and the other leg portion is formed into a both-side fixed spring.

According to the electronic device connector according to the invention, it is possible to enhance reliability and durability of the electrical connection between the terminal fitting and the contact portion of the electronic device, and to allow positional deviation of the electronic device connector and the electronic device for assembly without an increase in the number of components.

Hereinbefore, the invention is briefly described. Hereinafter, exemplary embodiments for realizing the invention (hereinafter, referred to as exemplary embodiments) will be described in detail with reference to the accompanying drawings to specifically clarify the invention.

The present invention is based on Japanese Patent Application (JP-2014-106470) filed on May 22, 2014, Japanese Patent Application (JP-2014-146064) filed on Jul. 16, 2014 and Japanese Patent Application (JP-2015-072762) filed on Mar. 31, 2015, the entire subject matter of which is incorporated herein by way of reference.

What is claimed is:

1. An electronic device connector comprising:

a connector housing that is combined with a case of an electronic device; and a terminal fitting that is held by the connector housing, wherein when the connector housing is combined with the case, the terminal fitting is electrically connected to a contact portion of the electronic device, the terminal fitting includes an internal conductor, an external conductor disposed around the internal conductor, and a dielectric disposed between the internal conductor and the external conductor which are concentrically disposed, and the internal conductor and the external conductor are integrally provided with spring portions capable of being elastically deformed in contact with the contact portion of the electronic device.

2. The electronic device connector according to claim 1, wherein the spring portion of the internal conductor and the spring portion of the external conductor are orthogonal in their extending directions in a plane orthogonal to axes of the internal conductor and the external conductor.

3. The electronic device connector according to claim 1, wherein the electronic device is an on-vehicle camera.

4. The electronic device connector according to claim 1, wherein each of the internal conductor and the external conductor includes a terminal body that is fixed and supported in the connector housing, and the spring portion that extends from a base end of the terminal body disposed on a side of the case of the electronic device, and the spring portion includes a flexible portion that extends in a tilted straight line shape that connects one end of the base end of the terminal body and the contact portion in a plane that extends along an axis of the terminal body, and generates a contact pressure with respect to the contact portion due to flexible deformation in an axial direction of the terminal body.

5. The electronic device connector according to claim 4, wherein the flexible portion is formed in the tilted straight line shape that extends from one end of the base end of the terminal body disposed on a side separated from the contact portion and is directed toward the contact portion.

6. The electronic device connector according to claim 1, wherein the external conductor includes a shielding portion that shields an opening formed in the external conductor.

7. An electronic device connector comprising:

an escutcheon configured to be combined with an electronic device; and a connector assembly configured to be held by the escutcheon, wherein the connector assembly includes a conductor portion that includes an external conductor, an insulator including a cylinder portion that is protrudingly provided and is inserted into the external conductor and an internal conductor that is inserted into the cylinder portion of the insulator, and a substrate connecting spring that comes into contact with both the external conductor and the internal conductor, the external conductor is provided with a conductive holding portion that protrudes from an end portion thereof disposed on a side of the electronic device towards the electronic device, a holding portion inserting hole that passes through the holding portion is formed in a base of the insulator, the substrate connecting spring is provided in an outlet port of the holding portion inserting hole on the side of the electronic device and an end portion of the internal conductor on the side of the electronic device, the holding portion of the external conductor and the end portion of the internal conductor on the side of the electronic device come into contact with the substrate connecting spring as the holding portion of the external conductor is fitted into the holding portion inserting hole of the insulator, and a spring inserting groove is provided on a surface of the base of the insulator on the side of the electronic device, and the substrate connecting spring is inserted into the spring inserting groove in a direction orthogonal to an axial direction of the cylinder portion, and a portion that is in contact with a contact portion of the electronic device is exposed from the spring inserting groove.

8. The electronic device connector according to claim 7, wherein the holding portion is formed in a channel shape, one leg portion of the channel shape is provided in the external conductor, a connecting portion of the channel shape is fitted into the holding portion inserting hole of the insulator to come into contact with the substrate connecting spring, an engaging portion is formed at a tip of the other leg portion of the channel shape, a tip inserting hole in which the engaging portion is inserted is formed in the escutcheon, and the engaging portion is inserted and fitted into the tip inserting hole.

9. The electronic device connector according to claim 8, wherein a protrusion to be press-fitted into the insulator is formed in the other leg portion of the channel shape on the side of the connecting portion thereof.

10. The electronic device connector according to claim 7, wherein the substrate connecting spring includes a plurality of springs each of which includes a bending portion and two leg portions that extend from the bending portion in both directions in which respective end portions of one side leg portions of the springs are integrally formed by a common connecting plate, an end portion of the leg portion of the spring that is connected to the internal conductor, among the plurality of springs that are integrally formed with the common connecting plate, is cut out to be separated from the common connecting plate, and a spring inserting hole is provided in the surface of the base of the insulator on the side of the electronic device, the bending portion of each of the plurality of springs of the substrate connecting spring is inserted into the spring inserting hole, and a portion that comes into contact with a contact portion of the electronic device is exposed from the spring inserting hole.

11. The electronic device connector according to claim 7, wherein as the bending portions of the springs each of which includes the bending portion and two leg portions that extend from the bending portion in both directions are inserted into the spring inserting holes and the one leg portion including the portion that comes into contact with the contact portion of the electronic device is exposed from the spring inserting hole, the one leg portion is formed into a cantilevered spring, and the other leg portion is formed into a both-side fixed spring.

* * * * *